US006427135B1

(12) United States Patent
Miseki et al.

(10) Patent No.: US 6,427,135 B1
(45) Date of Patent: Jul. 30, 2002

(54) METHOD FOR ENCODING SPEECH WHEREIN PITCH PERIODS ARE CHANGED BASED UPON INPUT SPEECH SIGNAL

(75) Inventors: Kimio Miseki; Masahiro Oshikiri; Tadashi Amada; Masami Akamine, all of Kobe (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 5 days.

(21) Appl. No.: 09/696,962

(22) Filed: Oct. 27, 2000

Related U.S. Application Data

(62) Division of application No. 09/039,317, filed on Mar. 16, 1998, now Pat. No. 6,167,375.

(30) Foreign Application Priority Data

| | | |
|---|---|---|
| Mar. 17, 1997 | (JP) | 9-063450 |
| Jul. 4, 1997 | (JP) | 9-179677 |
| Aug. 29, 1997 | (JP) | 9-235129 |
| Dec. 24, 1997 | (JP) | 9-354806 |

(51) Int. Cl.[7] ..... G10L 11/04

(52) U.S. Cl. ..... 704/258; 704/207; 704/220; 704/208

(58) Field of Search ..... 704/258, 207, 704/200, 1, 229, 205, 208, 222, 219, 230, 206, 500, 501, 203, 211, 214, 220

(56) References Cited

U.S. PATENT DOCUMENTS

| | | | | |
|---|---|---|---|---|
| 4,731,846 A | * | 3/1988 | Secrest et al. | 704/207 |
| 4,821,324 A | * | 4/1989 | Ozawa et al. | 704/216 |
| 4,959,865 A | * | 9/1990 | Stettiner et al. | 704/233 |
| 5,012,519 A | * | 4/1991 | Aldersberg et al. | 704/225 |
| 5,596,676 A | * | 1/1997 | Swaminathan et al. | 704/208 |
| 5,630,011 A | * | 5/1997 | Lim et al. | 704/205 |
| 5,657,420 A | * | 8/1997 | Jacobs et al. | 704/219 |
| 5,699,477 A | * | 12/1997 | McCree | 704/216 |
| 5,734,789 A | * | 3/1998 | Swaminathan et al. | 704/206 |
| 5,754,974 A | * | 5/1998 | Griffin et al. | 704/205 |
| 5,765,127 A | * | 6/1998 | Nishiguchi et al. | 704/208 |
| 5,774,837 A | * | 6/1998 | Yeldener et al. | 704/208 |
| 5,819,213 A | * | 10/1998 | Oshikiri et al. | 704/222 |
| 5,864,798 A | * | 1/1999 | Miseki et al. | 704/225 |
| 5,911,128 A | * | 6/1999 | deJaco | 704/221 |
| 5,924,064 A | * | 7/1999 | Helf | 704/204 |
| 6,138,092 A | * | 10/2000 | Zinser et al. | 704/223 |
| 6,167,375 A | * | 12/2000 | Miseki et al. | 704/229 |

* cited by examiner

*Primary Examiner*—Vijay B Chawan
(74) *Attorney, Agent, or Firm*—Oblon, Spivak, McClelland, Maier & Neustadt, P.C.

(57) ABSTRACT

A method for encoding speech wherein an input speech signal is separated by a component separator into a first component mainly constituted by speech and a second component mainly constituted by a background noise at each predetermined unit of time, a bit allocation selector selects bit allocation for each component based on the first and second components from among a plurality of predetermined candidates for bit allocation, a speech encoder and a noise encoder encode the first and second components from the component separator based on the bit allocation according to predetermined different methods for encoding, and a multiplexer multiplexes encoded data of the first and second components and information on the bit allocation and outputs them as transmitted encoded data.

10 Claims, 51 Drawing Sheets

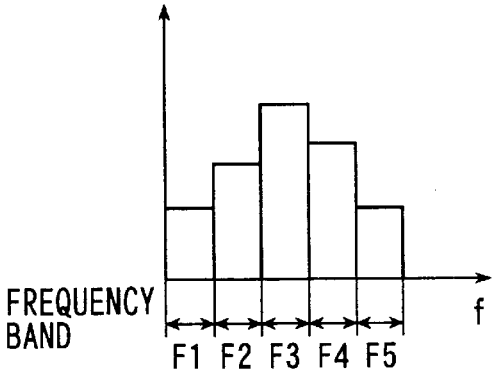
FIG. 31A
| FRAME NO. | 1 | 2 | 3 | 4 | 5 | 6 | 7 | ------ |
|---|---|---|---|---|---|---|---|---|
| SELECTED FREQUENCY BAND | F1 | F2 | F3 | F4 | F5 | F1 | F2 | ------ |
FIG. 31B
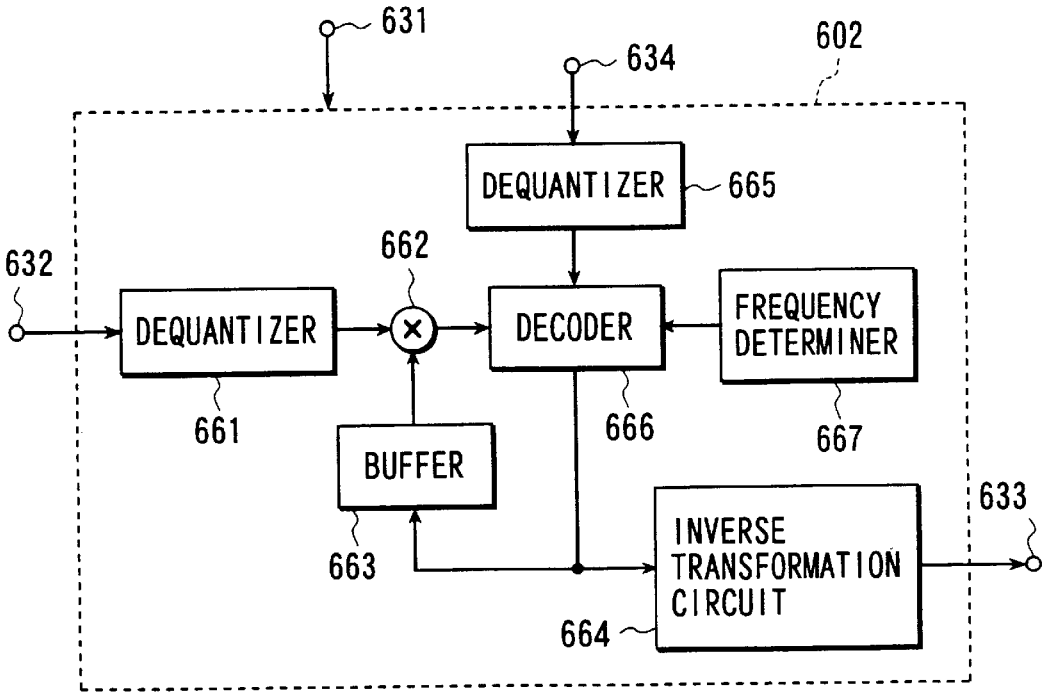
FIG. 34

| FRAME NO. | 1 | 2 | 3 | 4 | 5 | 6 | 7 | -------- |
|---|---|---|---|---|---|---|---|---|
| SELECTED FREQUENCY BAND #1 | F1 | F2 | F3 | F4 | F5 | F1 | F2 | -------- |
| SELECTED FREQUENCY BAND #2 | F3 | F4 | F5 | F1 | F2 | F3 | F4 | -------- |

METHOD FOR ENCODING SPEECH WHEREIN PITCH PERIODS ARE CHANGED BASED UPON INPUT SPEECH SIGNAL

This application is a division of application Ser. No. 09/039,317, filed Mar. 16, 1998, now U.S. Pat. No. 6,167, 375.

BACKGROUND OF THE INVENTION

The present invention relates to a method for encoding speech at a low bit rate and, more particularly, to a method for encoding speech and a method for decoding speech wherein a speech signal including a background noise is encoded by compressing it efficiently in a state which is as close to the original speech as possible.

Further, the present invention relates to a method for encoding speech wherein a speech signal is compressed and encoded, and, more particularly, to speech encoding used for digital telephones and the like and a method for encoding speech for speech synthesis used for text read-out software and the like.

Conventional low-bit-rate speech coding is directed to efficient coding of a speech signal and is carried out according to speech coding methods which employ a model of a speech production process. Among such methods for speech coding, methods based on a CELP system have recently been spreading remarkably. When such a method for encoding speech on a CELP basis is used, a speech signal input in an environment having little background noise can be encoded efficiently because the signal matches the model for encoding, and this allows encoding with deterioration of speech quality at a relatively low level.

However, it is known that when a method for encoding speech on a CELP basis is used for a speech signal input under a condition where a background noise is at a high level, the background noise included in a reproduced output signal comes out very differently to produce speech which is very unstable and uncomfortable. Such a tendency is significant especially at an encoding bit rate of 8 kbps or less.

In order to mitigate this problem, a method has been proposed wherein the CELP encoding is performed using a more noisy excitation signal for a time window which has been determined to be a background noise to mitigate deterioration of speech quality in such a window of a background noise. Although such a method provides some improvement of speech quality in the window for a background noise, the improvement is problematically insufficient in that the tendency of producing a noise that sounds differently from the background noise in the original speech still remains because a model of a speech production process is used in which speech is synthesized by having the excitation signal passed through a synthesis filter.

As described above, the conventional method for encoding speech has a problem in that when a speech signal input under a condition where a background noise is at a high level is encoded, the background noise included in a reproduced output signal comes out very differently to produce speech which is very unstable and uncomfortable.

BRIEF SUMMARY OF THE INVENTION

It is an object of the present invention to provide a method for low-rate speech coding and decoding wherein speech including a background noise can be reproduced in a state as close to the original speech as possible.

It is another object of the invention to provide a method for a low-rate speech coding and decoding wherein a background noise can be encoded with a number of bits as small as possible to reproduce speech including a background noise in a state as close to the original speech as possible.

It is still another object of the invention to provide a method for encoding speech wherein encoding can be performed such that abrupt changes and fluctuations of pitch periods are reflected to obtain high quality decoded speech.

According to the present invention, there is provided a method for encoding speech comprising separating an input speech signal into a first component mainly constituted by speech and a second component mainly constituted by a background noise at each predetermined unit of time, selecting bit allocation for each of the first and second components from among a plurality of candidates for bit allocation based on the first and second components, encoding the first and second components under such bit allocation using predetermined different methods for encoding, and outputting data on the encoding of the first and second components and information on the bit allocation as encoded data to be transmitted.

According to the CELP encoding, as described above, when a speech signal input under a condition wherein a background noise is at a high level, the background noise included in a reproduced speech signal comes out very differently to produce speech which is very unstable and uncomfortable. This phenomenon is attributable to the fact that the background noise has a model which is completely different from that for speech signals to which CELP works well, and it is desirable to perform a background noise using a method appropriate for it.

According to the present invention, an input speech signal is separated into a first component mainly constituted by speech and a second component mainly constituted by a background noise at each predetermined unit of time, and encoding is performed using methods for encoding based on different models which are respectively adapted to the characteristics of the speech and background noise to improve the efficiency of the encoding as a whole.

The first and second components are encoded using bit allocation selected from among a plurality of candidates for bit allocation based on the first and second components such that each component can be more efficiently encoded. This makes it possible to encode the input speech signal efficiently with the overall bit rate kept low.

In the method for encoding according to the invention, the first component is preferably encoded in the time domain and the second component is preferably encoded in the frequency domain or transform domain. Specifically, since speech is information which quickly changes at relatively short intervals on the order of 10 to 15 ms, the first component mainly constituted by speech can be encoded with high quality by using a method such as the CELP type encoding which suppresses distortion of a waveform in the time domain. On the other hand, since a background noise slowly changes at relatively long intervals in the range from several tens ms to several hundred ms, the information of the second component mainly constituted by a background noise can be more easily extracted with less bits by encoding the components after converting them into parameters in the frequency domain or transform domain.

In the method for encoding speech according to the invention, the total number of bits for encoding that are allocated for the predetermined units of time is preferably fixed. Since this makes it possible to encode an input speech signal at a fixed bit rate, encoded data can be more easily processed.

Further, in the method for encoding speech according to the invention, it is preferable that a plurality of methods for encoding are provided for encoding the second component and that at least one of those method encodes the spectral shape of the current background noise utilizing the spectral shape of a previous background noise which has already been encoded. Since this method for encoding allows the second component to be encoded with a very small number of bits, resultant spare encoding bits can be allocated for the encoding of the first component to prevent deterioration of the quality of decoded speech.

When an input speech signal is encoded using the method for encoding based on models adapted respectively to the first component mainly constituted by speech and the second component mainly constituted by a background noise, although the production of an uncomfortable sound can be avoided. However, if the background noise is superimposed on the speech signal, i.e., if both of the first and second components separated from the input speech signal have power which can not be ignored, the absolute number of the bits for encoding the first component runs short and, as a result, the quality of the decoded speech is significantly reduced.

In such a case, with the above-described method for encoding the spectral shape of the current back ground noise utilizing the spectral shape of a previous background noise which has already been encoded, the second component mainly constituted by a background noise can be encoded with a very small number of bits, and the resultant spare encoding bits cam be allocated for the encoding of the first speech mainly constituted by speech to maintain the decoded speech at a high quality level.

According to the method for encoding the spectral shape of the current background noise utilizing the spectral shape of a previous background noise, for example, a power correction coefficient is calculated from the spectral shape of the previous background noise and the spectral shape of the current background noise, the power correction coefficient is quantized thereafter, the spectral shape of the previous background noise is multiplied by the quantized power correction coefficient to obtain the spectral shape of the current background noise, and an index obtained during the quantization of the power correction coefficient is used as encoded data.

The spectral shape of a background noise is constant for a relatively long period as one can easily assume from, for example, a noise in a traveling automobile or a noise from a machine in an office. One can consider that such a background noise is subjected to substantially no change in the spectral shape thereof but a change of the power thereof. Therefore, once the spectral shape of a background noise is encoded, the spectral shape of the background noise may be regarded fixed thereafter and encoding is required only for the amount of change in power. This makes it possible to represent the spectral shape of a background noise using a very small number of bits.

Further, according to the method for encoding the spectral shape of the current background noise utilizing the spectral shape a previous background noise, the spectral shape of the current background noise may be predicted by multiplying the spectral shape of the previous background noise by the above-described quantized power correction coefficient, the spectrum of the background noise in a frequency band determined according to predefined rules may be encoded using the predicted spectral shape, and the index obtained during the quantization of the power correction coefficient and an index obtained during the encoding of the spectrum of the background noise in the frequency band determined by predefined rules may be used as encoded data.

While the spectral shape of a background noise can be regarded substantially constant for a relatively long period as described above, it is not likely that the same shape remains unchanged for several tens seconds, and it is natural to assume that the spectral shape of the background noise gradually changes in such a long period. Thus, a frequency band is determined according to predefined rules, a signal representing an error between the spectral shape of the current background noise and a predicted spectral shape of the current background noise obtained by multiplying the spectral shape of a previous background noise by a coefficient, and the error signal is encoded. As a result, the above-described rules for determining the frequency band can be defined such that they are circulated throughout the entire frequency band of a background noise during a certain period of time. Thus, the shape of a background noise that gradually changes can be efficiently encoded.

According to method for decoding speech of the present invention, in order to decode transmitted encoded data obtained by encoding as described above to reproduce the speech signal, the input transmitted encoded data is separated into encoded data of the first component mainly constituted by speech, encoded data of the second component mainly constituted by a background noise, and information on bit allocation for each of the encoded data for the first and second components, the information on bit allocation is decoded to obtain bit allocation for the encoded data for the first and second components, the encoded data for the first and second component is decoded according to the bit allocation to reproduce the first and second components, and the reproduced first and second components are combined to produce a final output speech signal.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 31A and 31B are diagrams for describing rules for determining a frequency band for the second noise encoder according to the sixth embodiment;

FIG. 34 is a block diagram showing an internal configuration of a second noise decoder according to the sixth embodiment;

FIGS. 56A to 55D are illustrations of a pitch excitation signal for long pitch periods that describes the operation of the seventeenth embodiment;

DETAILED DESCRIPTION OF THE INVENTION

Preferred embodiment of the invention will now be described with reference to the accompanying drawings.

Figure 1:
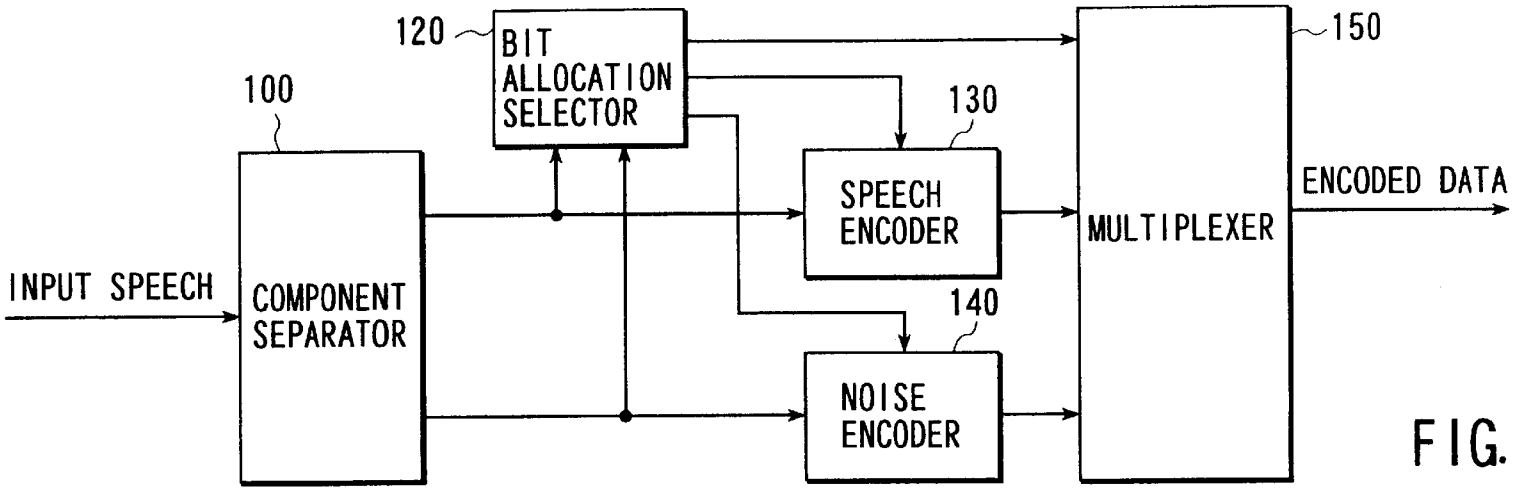
FIG. 1 is a block diagram showing a schematic configuration of a speech encoding apparatus according to a first embodiment of the invention.

FIG. 1 shows a configuration of a speech encoding apparatus in which a method for encoding speech according to a first embodiment of the invention is implemented. The speech encoding apparatus is comprised of a component separator 100, a bit. allocation selector 120, a speech encoder 130, a noise encoder 140 and a multiplexer 150.

The component separator 100 analyzes an input speech signal at each predetermined unit of time and performs component separation to separate the signal into a component mainly constituted by speech (a first component) and a component mainly constituted by a background noise (a second component). Normally, an appropriate unit of time for the analysis at the component separation is in the range from about 10 to 30 ms and it is preferable that it substantially corresponds to a frame length which is the unit for speech encoding. While a variety of specific methods are possible for this component separation, since a background noise is normally characterized in that its spectral shape fluctuates more slowly than that of speech, the component separation is preferably carried out using a method that utilizes such a difference between the characteristics of them.

For example, a component mainly constituted by speech can be preferably separated from an input speech signal in an environment having a background noise by using a technique referred to as "spectral subtraction" wherein the background noise is estimated while processing the spectral shape of the background noise which is subjected to less fluctuation over time and wherein, in a time interval during which there is abrupt fluctuations, the spectrum of the noise which has been estimated until that time is subtracted from the spectrum of the input speech. On the other hand, a component mainly constituted by a background noise can be obtained by subtracting the component mainly constituted by speech obtained from the input speech signal from the spectrum of the input speech in the time domain or the frequency domain. As the component mainly constituted by a background noise, the estimated spectrum of the background noise described above may be used as it is.

The bit allocation selector 120 selects the number of encoding bits to be allocated to each of the speech encoder 130 and the background noise encoder 140 to be described later from among predetermined combinations of bit allocation based on the two types of components from the component separator 100, i.e., the component mainly constituted by speech and the component mainly constituted by a background noise, and outputs the information on the bit allocation to the speech encoder 130 and noise encoder 140. At the same time, the bit allocation selector 120 outputs the information on bit allocation to the multiplexer 150 as transmission information.

While the bit allocation is preferably selected by comparing the quantities of the component mainly constituted by speech and the component mainly constituted by a background noise, the present invention is not limited thereto. For example, there is another method effective in obtaining more stable speech quality, which is a combination of a mechanism that reduces the possibility of an abrupt change in bit allocation while monitoring the history of changes in bit allocation and comparison of the quantities of the above-described components.

Table 1 below shows examples of the combinations of bit allocation prepared in the bit allocation selector 120 and symbols to represent them.

TABLE 1

| Symbol for Bit Allocation | 0 | 1 |
|---|---|---|
| Number of Bits/Frame for Speech Encoding | 79 | 69 |
| Number of Bits/Frame for Noise Encoding | 0 | 10 |
| Number of Bits/Frame Required to Transmit Symbol for Bit Allocation | 1 | 1 |
| Total Number of Bits/Frame Required to Encode Input Signal | 80 | 80 |

Referring Table 1, when the bit allocation symbol "0" is selected, 79 bits per frame are allocated to the speech encoder 130, and no bit is allocated to the noise encoder 140. Since one bit for the bit allocation symbol is sent in addition to this, the total number of bits required to encode an input speech signal is 80. It is preferable that this bit allocation is selected for a frame in which the component mainly constituted by a background noise is almost negligible in comparison to the component mainly constituted by speech. As a result, more bits are allocated to the speech encoder 130 to improve the quality of reproduced speech.

On the other hand, when the bit allocation symbol "1" is selected, 69 bits per frame is allocated to the speech encoder 130, and 10 bits are allocated to the noise encoder 140. Since one bit for the bit allocation symbol is sent in addition to this, the total number of bits required for encoding the input speech signal is 80 again. It is preferable that this bit allocation is selected for a frame in which the component mainly constituted by a background noise is so significant that it can not be ignored in comparison to the component mainly constituted by speech. This makes it possible to encode the speech and background noise at the speech encoder 130 and the noise encoder 140 respectively and to reproduce speech accompanied by a natural background noise at the decoding end.

An appropriate frame length of the speech encoder 130 is in the range from about 10 to 30 ms. In this example, the total number of bits per frame of the encoded data is fixed at 80 for the two kinds of combination of bit allocation. When the total number of bits per frame of transmitted encoded data is thus fixed, encoding can be performed at a fixed bit rate irrespective of the input speech signal. Another configuration may be employed which uses combinations of bit allocation as shown in Table 2 below.

TABLE 2

| | | |
|---|---|---|
| Symbol for Bit Allocation | 0 | 1 |
| Number of Bits/Frame for Speech Encoding | 79 | 79 |
| Number of Bits/Frame for Noise Encoding | 0 | 10 |
| Number of Bits/Frame Required to Transmit Symbol for Bit Allocation | 1 | 1 |
| Total Number of Bits/Frame Required to Encode Input Signal | 80 | 90 |

In this case, for a frame having substantially no component mainly constituted by a background noise, 79 bits are allocated only to the speech encoder 130, and no bit is allocated to the noise encoder 140 to provide the transmitted encoded data with 80 bits per frame. For a frame in which the component mainly constituted by a background noise can not be ignored, 10 bits are allocated to the noise encoder 140 in addition to the 79 bits to the speech encoder 130, and no bit is allocated to the noise encoder 140 to perform encoding at a variable rate in which the number of bits per frame of the transmitted encoded data is increased to 90.

According to the present invention, speech encoding can be carried out using configuration different from those described above wherein the information on bit allocation need not be transmitted. Specifically, encoding may be designed to determine bit allocation for the speech encoder 130 and noise encoder 140 based on previous such information which has been encoded. In this case, since the decoding end also has the same encoded previous information, the same bit allocation determined at the encoding end can be reproduced at the decoding end without transmitting the information on bit allocation. This is advantageous in that the bits allocated to the speech encoder 130 and noise encoder 140 can be increased to improve the performance of encoding itself. The bit allocation may be determined by comparing the magnitudes of a previous component mainly constituted by speech and a previous component mainly constituted by a background noise.

Although examples of two kinds of bit allocation have been described above, the present invention may obviously be applied to configurations wherein more kinds of bit allocation are used.

The speech encoder 130 receives input of the component mainly constituted by speech from the component separator 100 and encodes the component mainly constituted by speech through speech encoding that reflects the characteristics of the speech signal. Although it is apparent that any method capable of efficient encoding of a speech signal may be used in the speech encoder 130, the CELP system which is one of methods capable of producing natural speech is used here a s an example. As is well-known, the CELP system is a system which normally performs encoding in the time domain and is characterized in that an excitation signal is encoded such that a waveform thereof synthesized in the time domain is subjected to less distortion.

The noise encoder 140 is configured such that i t can receive the component mainly constituted by a background noise from the component separator 100 and can encode the background noise preferably. Normally, a background noise is characterized in that its spectrum fluctuates over time more slowly than that of a speech signal and in that the information on the phase of its waveform is random and is not so important for the ears of a person.

In order to encode such a background noise component efficiently, methods such as transform encoding is better than waveform encoding such as the CELP system wherein waveform distortion is suppressed. The transform encoding attains efficient encoding by transforming the time domain in to the transform domain and extracting the transform coefficient or a parameter from the transform coefficient. Especially, encoding efficiency can be further improved by the use of encoding involving transformation into the frequency domain wherein human perceptual characteristics are taken into consideration.

Processing steps of the method for encoding speech according to the present embodiment will now be described with reference to FIG. 2.

First, an input speech signal is taken in at each predetermined unit of time (step S100) and is analyzed by the component separator 100 to be separated into a component mainly constituted by speech and a component mainly constituted by a background noise (step S101).

Next, he bit allocation selector 120 selects the number of encoding bits to be allocated to each of the speech encoder 130 and the background noise encoder 140 from among predetermined combinations of bit allocation based on the two types of components from the component separator 100, i.e., the component mainly constituted by speech and the component mainly constituted by a background noise, and outputs the information on the bit allocation to the speech encoder 130 and background noise encoder 140 (step S102).

The speech encoder 130 and noise encoder 140 perform encoding processes according to the respective bit allocation selected at the bit allocation selector 120 (step S103). Specifically, the speech encoder 130 receives the component mainly constituted by speech from the component separator 100 and encodes it with the number of bits allocated to the speech encoder 130 to obtain encoded data corresponding to the component mainly constituted by speech.

On the other hand, the noise encoder 140 receives the component mainly constituted by a background noise from the component separator 100 and encodes it with the number of bits allocated to the noise encoder 140 to obtain encoded data corresponding to the component mainly constituted by a background noise.

Next, the multiplexer 150 multiplexes the encoded data from the encoders 130 and 140 and the information on bit allocation to the encoders 130 and 140 to output them as transmitted encoded data onto a transmission path (step S104). This terminates the encoding process performed in the predetermined time window. It is determined whether encoding is to be continued in the next time window (step S105).

Figure 3:
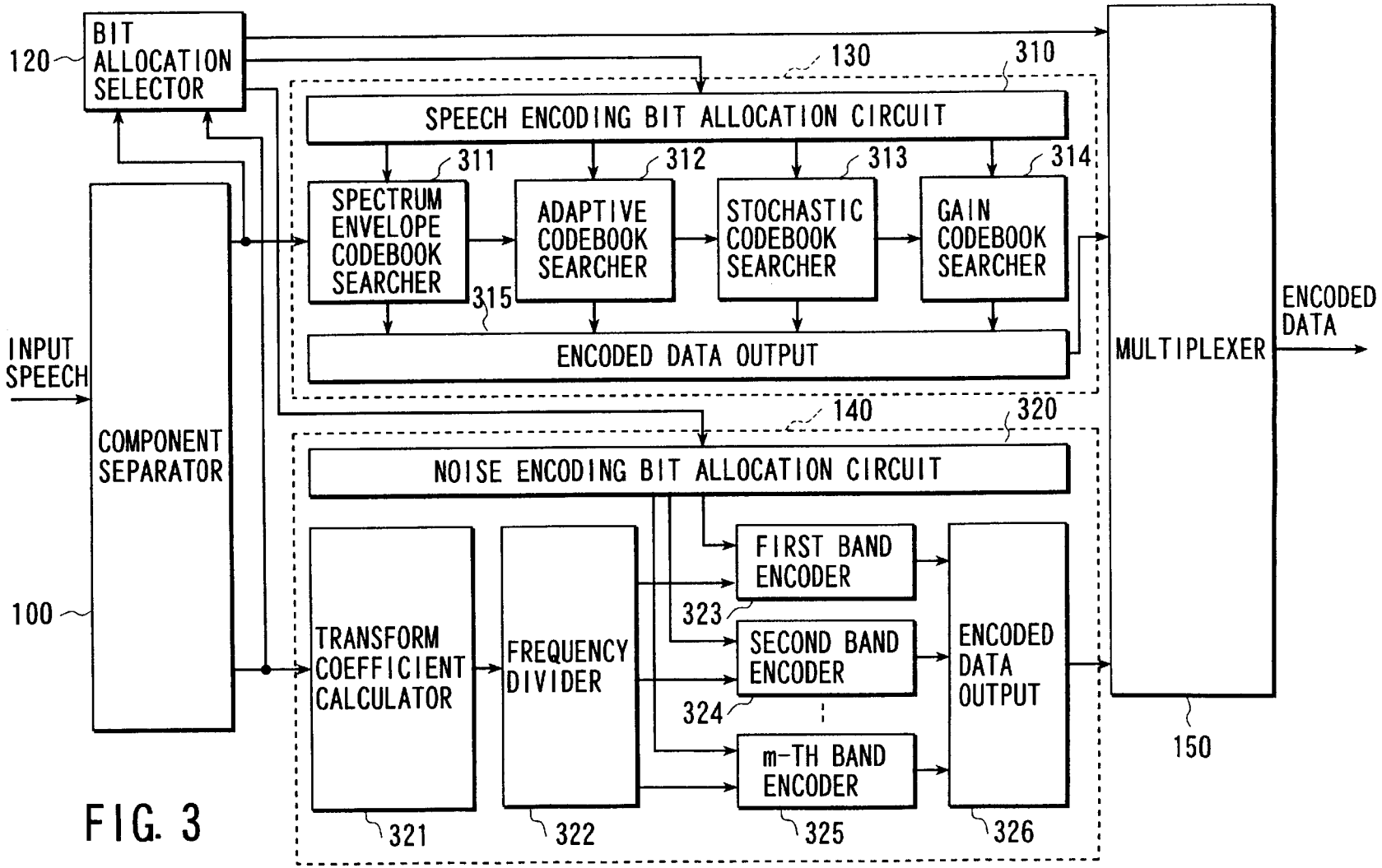
FIG. 3 is a block diagram showing a more detailed configuration of the speech encoding apparatus according to the first embodiment.

FIG. 3 shows a specific example of a speech encoding apparatus in which the speech encoder 130 and the noise encoder 140 employ the CELP system and transform encoding, respectively. According to the CELP system, a vocal cords signal as a model of a speech production process is associated with the excitation signal, spectrum envelope characteristics of a vocal tract is represented by a synthetic filter, and the excitation signal is input to the synthetic filter to represent the excitation signal by the output of the synthetic filter. The characteristic of this method is that the excitation signal is encoded to perceptually suppress waveform distortion that occurs between the speech signal subjected to the CELP encoding and the reproduced encoded speech.

The speech encoder 130 receives the input of the component mainly constituted by speech from the component separator 100 and encodes this component such that the waveform distortion thereof in the time domain is suppressed. In doing so, each process of encoding in the encoder 130 is carried out under bit allocation which is determined in advance in accordance with the bit allocation at the bit allocation selector 120. At this time, the performance of the speech encoder 130 can be maximized by making the sum of the number of bits used in each of the encoding sections in the encoder 130 equal to the bit allocation to the encoder 130 by the selector 120. This equally applies to the encoder 140.

According to the CELP encoding described here, encoding is performed using a spectrum envelope codebook searcher 311, an adaptive codebook searcher 312, a stochastic codebook searcher 313 and a gain codebook searcher 314. Information on indices into the codebooks searched in the codebook searcher 313 through 314 is input to an encoded data output section 315 and is output from the encoded data output section 315 to the multiplexer 150 as encoded speech data.

A description will now be made on the function of each of the codebook searchers 311 through 314 in the speech encoder 130. The spectrum envelope codebook searcher 311 receives the input of the component mainly constituted by speech from the component separator 100 on a frame-by-frame basis, searches a spectrum envelope codebook prepared in advance to select an index into the codebook which allows a preferable representation of a spectrum envelope of the input signal and outputs information on this index to the encoded data output section 315. While the CELP system normally employs an LSP (line spectrum pair) parameter as a parameter to be used for encoding a spectrum envelope, the present invention is not limited thereto and other parameters may be used as long as they can represent a spectrum envelope.

The adaptive codebook searcher 312 is used to represent a component included in a speech excitation that is repeated for each pitch period. The CELP system has an architecture wherein a previous encoded excitation signal is stored for a predetermined duration as an adaptive codebook which is shared by both of the speech encoder and speech decoder to allow a signal that is repeated in association with specified pitch periods to be extracted from the adaptive codebook. Since output signals from the adaptive codebook and pitch periods correspond in one-to-one relationship, a pitch period can be associated to an index into the adaptive codebook. In such an architecture, the adaptive codebook searcher 312 makes an evaluation at a perceptually weighted level on distortion of a synthesized signal obtained by synthesizing the output signals from the codebook from a target speech signal to search the index of the pitch period at which the distortion is small. Then, information on the searched index is output to the encoded data output section 315.

The stochastic codebook searcher 313 is used to represent stochastic component in a speech excitation. The CELP system has an architecture wherein a stochastic component in a speech excitation is represented using a stochastic codebook and various stochastic signals can be extracted from the stochastic codebook in association with specified stochastic indices. In such an architecture, the stochastic codebook searcher 313 makes an evaluation at a perceptually weighted level on distortion of a synthesized speech signal reproduced using output signals from the codebook from a target speech signal of the stochastic codebook searcher 313 and searches a stochastic index which results in reduced distortion. Information on the searched stochastic index is output to the encoded data output section 315.

The gain codebook searcher 314 is used to represent a gain component in a speech excitation. In the CELP system, the gain codebook searcher 314 encodes two kinds of gain, i.e., a gain used for a pitch component and a gain used for a stochastic component. During search into the codebook, an evaluation at a perceptually weighted level is made on distortion of a synthesized speech signal reproduced using gain candidates extracted from the codebook from a target speech signal to search the index to a gain at which the distortion is small. The searched gain index is output to the encoded data output section 315. The encoded data output section 315 outputs encoded data to the multiplexer 150.

A description will now be made on an example of a detailed configuration of the noise encoder 140 which receives the component mainly constituted by a background noise and encodes the same.

The noise encoder 140 is significantly different in the method for encoding from the above-described speech encoder 130 in that it receives the component mainly constituted by a background noise, performs predetermined transformation to obtain a transform coefficient for this component and encodes it such that distortion of parameters in the transform domain is reduced. While there are various possible methods for representing the parameter in the transform domain, a method will be described here as an example wherein the band of background noise component is divided by a band divider in the transform domain, a parameter that represents each band is obtained, the parameters are quantized by a predetermined quantizer, and indices of the parameters are transmitted.

First, a transform coefficient calculator 321 performs predetermined transformation to obtain a transform coefficient of the component mainly constituted by a background noise. For example, discrete Fourier transform and fast Fourier transform (FFT) may be used. Next, the band divider 322 divides the frequency axis into predetermined bands, and the parameter in each of m bands is quantized by a first band encoder 323, a second band encoder 324, . . . , and an m-th band encoder 325 using quantization bits in a quantity in accordance with bit allocation by a noise encoding bit allocation circuit 320. The number of the bands m is preferably in the range from 4 to 16 for sampling at 8 kHz.

The parameter used here may be a value which is obtained by averaging spectrum amplitude or power spectrum obtained from the transform coefficient in each band. Information of an index representing a quantized value of the parameter from each band is input to an encoded data output section 326 and is output from the encoded data output section 326 to the multiplexer 150 as encoded data.

Figure 4:
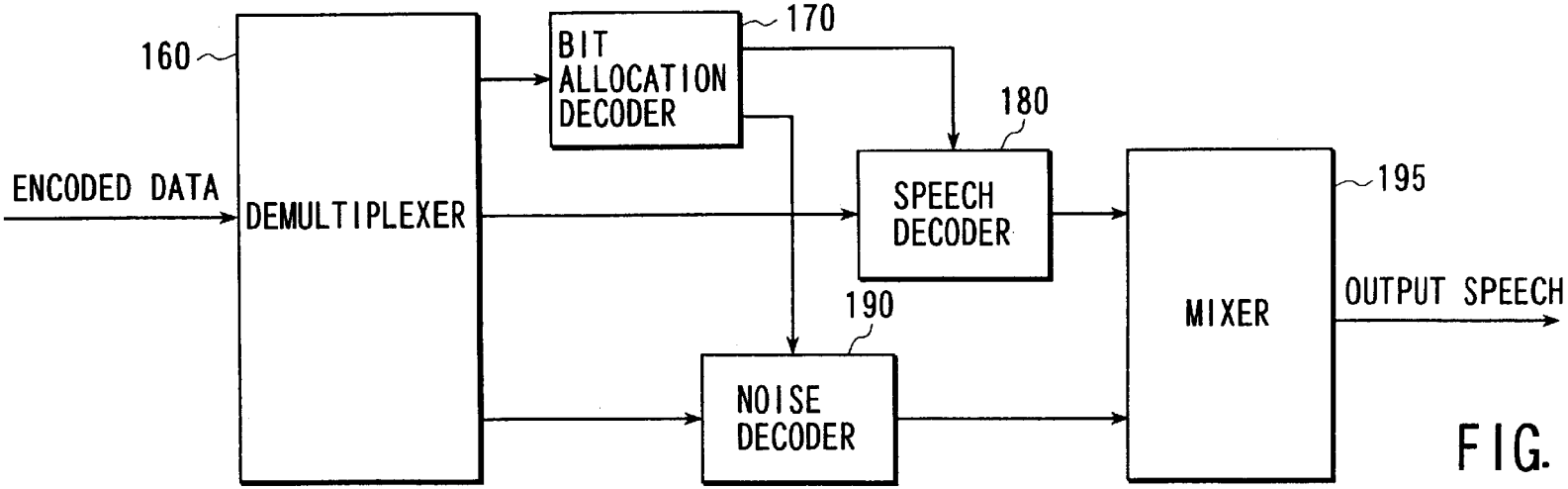
FIG. 4 is a block diagram showing a schematic configuration of a speech decoding apparatus according to the first embodiment of the invention.

FIG. 4 shows a configuration of a speech decoding apparatus in which a method for decoding speech according to the present invention is implemented. The speech decoding apparatus comprises a demultiplexer 160, a bit allocation decoder 170, a speech decoder 180, a noise decoder 190 and a mixer 195.

The demultiplexer 160 receives the encoded data transmitted from the speech encoding apparatus shown in FIG. 1 at each predetermined unit of time as described above and separates it to output information on bit allocation, encoded data to be input to the speech encoder 180 and encoded data to be input to the noise encoder 190.

The bit allocation decoder 170 decodes the information on bit allocation and outputs the number of bits to be allocated to each of the speech decoder 180 and noise encoder 190 selected from among combinations for bit quantity allocation defined by the same mechanism as the encoding end.

The speech decoder 180 decodes the encoded data based on the bit allocation made by the bit allocation decoder 170 to generate a reproduction signal of the component mainly constituted by speech which is output to the mixer 195.

The noise encoder 190 decodes the encoded data based on the bit allocation from the bit allocation decoder 170 to generate a reproduction signal of the component mainly constituted by a background noise which is output to the mixer 195.

The mixer 195 concatenates the reproduction signal of the component mainly constituted by speech decoded and reproduced by the speech decoder 180 and the reproduction signal of the component mainly constituted by a background noise decoded and reproduced by the noise encoder 190 to generate a final output speech signal.

Processing steps of the method for decoding speech in the present embodiment will now be described with reference to the flow chart in FIG. 5.

First, the input transmitted encoded data is fetched at each predetermined unit of time (step S200), and the encoded data is separated by the demultiplexer 160 into the information on bit allocation, the encoded data to be input to the speech decoder 180 and the encoded data to be input to the noise encoder 190 (step S201).

Next, at the bit allocation decoder 170, the information on bit allocation is decoded, and the number of bits to be allocated to each of the speech decoder 180 and noise decoder 190 is set to a value selected from among combinations of bit quantity allocation defined by the same mechanism as that of the speech encoding apparatus, the value being output (step S202). The speech decoder 180 and noise decoder 190 generate the respective reproduction signals based on the bit allocation from the bit allocation decoder 170 and output them to the mixer 195 (step S203).

Next, the mixer 195 concatenates the reproduced component mainly constituted by a speech signal and the reproduced component mainly constituted by a noise (step S204) to generate and output the final speech signal (step S205).

Figure 6:
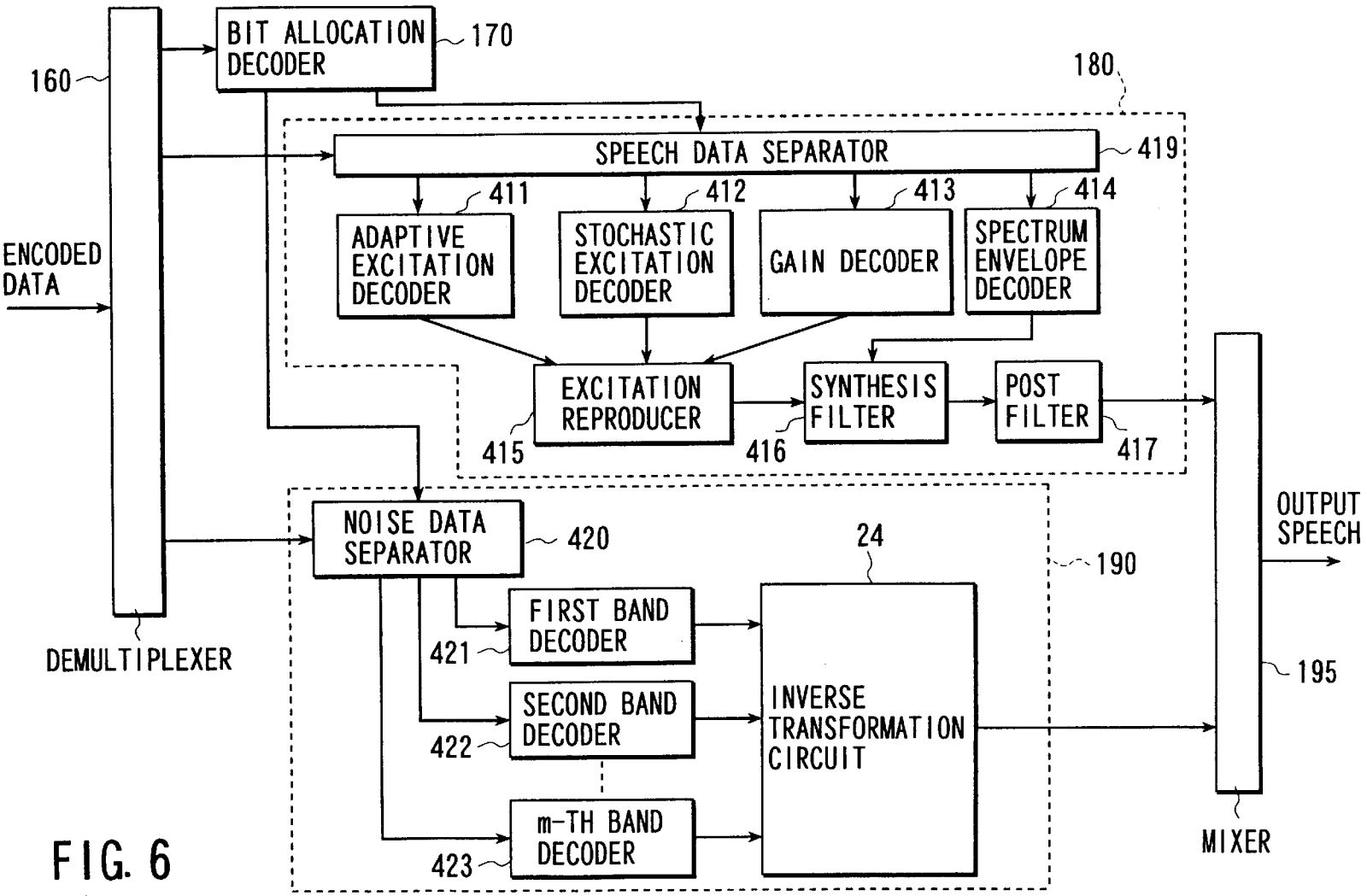
FIG. 6 is a block diagram showing a more detailed configuration of the speech decoding apparatus according to the first embodiment.

FIG. 6 shows a specific example of a speech decoding apparatus which is associated with the speech encoding apparatus in FIG. 3. From the encoded data for each predetermined unit of time transmitted by the speech encoding apparatus in FIG. 3, the demultiplexer 160 outputs information on bit allocation, information on an index of a spectrum envelope, an adaptive index, a stochastic index and a gain index which are the encoded data to be input to the speech decoder 180 and information on a quantization index for each band which is the encoded data to be input to the noise decoder 190. The bit allocation decoder 170 decodes the information on bit allocation and selects and outputs the number of bits to be allocated to each of the speech decoder 180 and noise decoder 190 from among combinations of bit quantity allocation defined by the same mechanism as that used for encoding.

The speech decoder 180 decodes the encoded data based on the bit allocation from the bit allocation decoder 170 to generate a reproduction signal of the component mainly constituted by speech which is output to the mixer 195. Specifically, a spectrum envelope decoder 414 reproduces the index of the spectrum envelope and information on the spectrum envelope from the spectrum envelope codebook which is prepared in advance and sends then to a synthesis filter 416. An adaptive excitation decoder 411 receives the information on the adaptive index, extracts a signal which repeats at pitch periods corresponding thereto from the adaptive codebook and outputs it to an excitation reproducer 415.

A stochastic excitation decoder 412 receives the information on the stochastic index, extracts a stochastic signal corresponding thereto from the stochastic codebook and outputs it to the excitation reproducer 415.

The gain decoder 413 receives the information on the gain index, extracts two kinds of gains, i.e., a gain to be used for a pitch component corresponding thereto and a gain to be used for a stochastic component corresponding thereto from the gain codebook and outputs them to the excitation reproducer 415.

The excitation reproducer 415 reproduces an excitation signal (vector) Ex using a signal (vector) Ep repeating at the pitch periods from the adaptive excitation decoder 411, a stochastic signal (vector) En from the stochastic excitation decoder 412 and two kinds of gains Gp and Gn from the gain decoder 413 according Equation 1 below.

$$Ex=Gp\cdot Ep+Gn\cdot En \tag{1}$$

The synthesis filter 416 sets synthesis filter parameters for synthesizing speech using the information on the spectrum envelope and receives the input of the excitation signal from the excitation reproducer 415 to generate a synthesized speech signal. Further, a post filter 417 shapes encoding distortion included in the synthesized speech signal to obtain more perceptually comfortable speech which is output to the mixer 195.

The noise decoder 190 in FIG. 6 will now be described.

The noise decoder 190 receives encoded data required for itself based on the bit allocation from the bit allocation decoder 170, decodes it to generate a reproduction signal of the component mainly constituted by a background noise which is output to the mixer 195. Specifically, a noise data separator 420 separates the encoded data into a quantization index for each band, a first band decoder 421, a second band decoder 422, . . . , and an m-th band decoder 423 decode a parameter in respective bands, and an inverse transformation circuit 424 performs transformation inverse to the transformation carried out at the encoding end using the decoded parameters to generate a reproduction signal including the component mainly constituted by a background noise. The reproduction signal of the component mainly constituted by a background noise is sent to the mixer 195.

The mixer 195 concatenates the reproduction signal of the component mainly constituted by speech shaped by the post filter and the reproduction signal of the reproduced component mainly constituted by a background such that they are smoothly connected between adjoining frames to provide an output speech signal which becomes the final output from the decoder.

Figure 7:
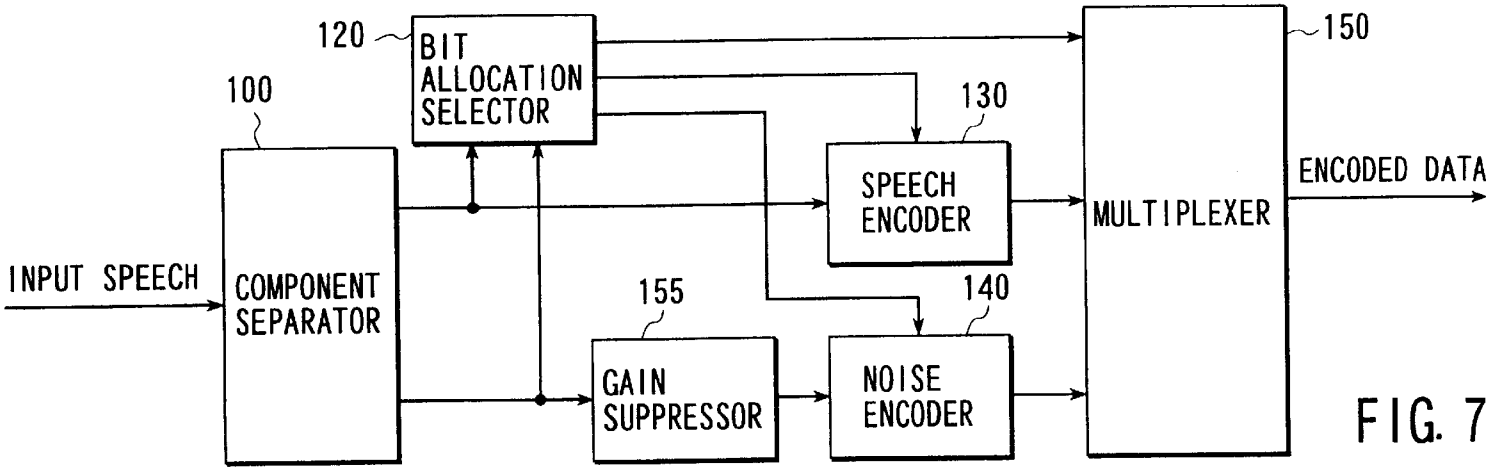
FIG. 7 is a block diagram showing a schematic configuration of a speech encoding apparatus according to a second embodiment of the invention.

FIG. 7 shows a configuration of a speech encoding apparatus in which a method for encoding speech according to a second embodiment of the invention is implemented. The present embodiment is different from the first embodiment in that the process of noise encoding is carried out after suppressing the gain of the component mainly constituted by a background noise input to the noise encoder 140. The component separator 100, bit allocation selector 120, speech encoder 130, noise encoder 140 and multiplexer 150 will not be described here because they are the same as those in FIG. 1, and only differences from the first embodiment will be described.

A gain suppressor 155 suppresses the gain of the component mainly constituted by a background noise output by the component separator 100 according to a predetermined method and inputs the input speech signal with this component suppressed to the noise encoder 140. This reduces the amount of the background noise coupled to a speech signal at the decoding end. This is advantageous not only in that the background noise mixed in the final output speech signal output at the decoding end feels natural and in that the output speech is more perceptually comfortable because only the noise level is reduced with the level of the speech itself kept unchanged.

Figure 8:
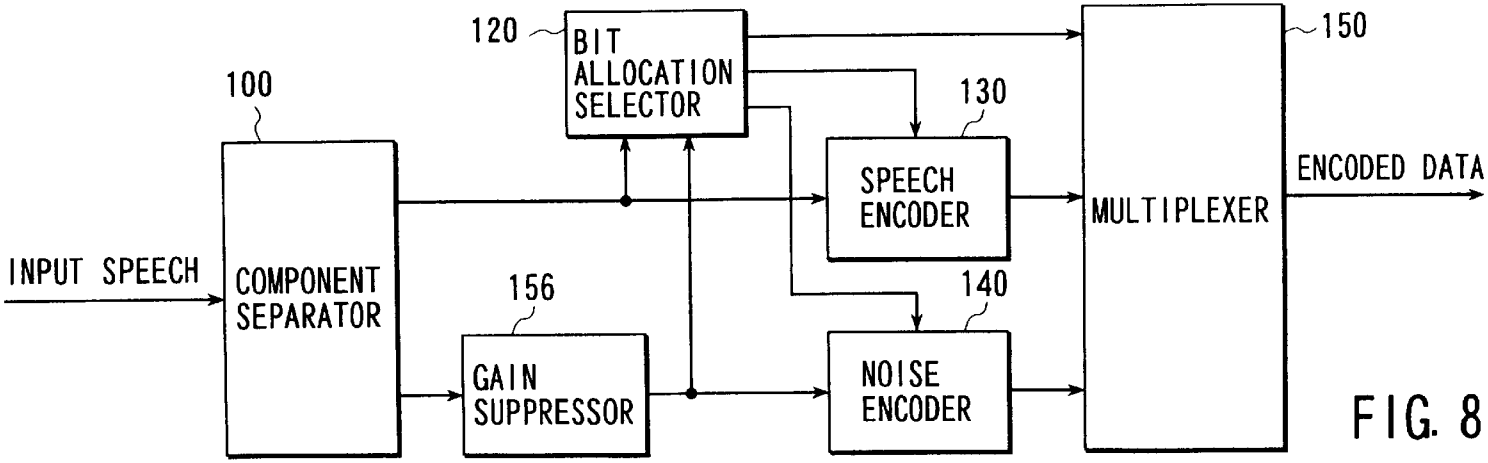
FIG. 8 is a block diagram showing a schematic configuration of another speech encoding apparatus according to the second embodiment of the invention.

FIG. 8 shows an example of a minor modification to the configuration shown in FIG. 7. FIG. 8 is different from FIG. 7 in that the input speech signal is input to the bit allocation selector 110 and noise encoder 140 after being subjected to the suppression of the component mainly constituted by a background noise at the gain suppressor 156. This makes it possible to select bit allocation based on comparison between the component mainly constituted by speech and the component mainly constituted by a background noise with a suppressed gain. As a result, the bit allocation can be carried out according to the magnitude of each of the speech signal and background noise signal which are actually output at the decoding end to provide an advantage that the reproduction quality of the decoded speech is improved.

Figure 9:
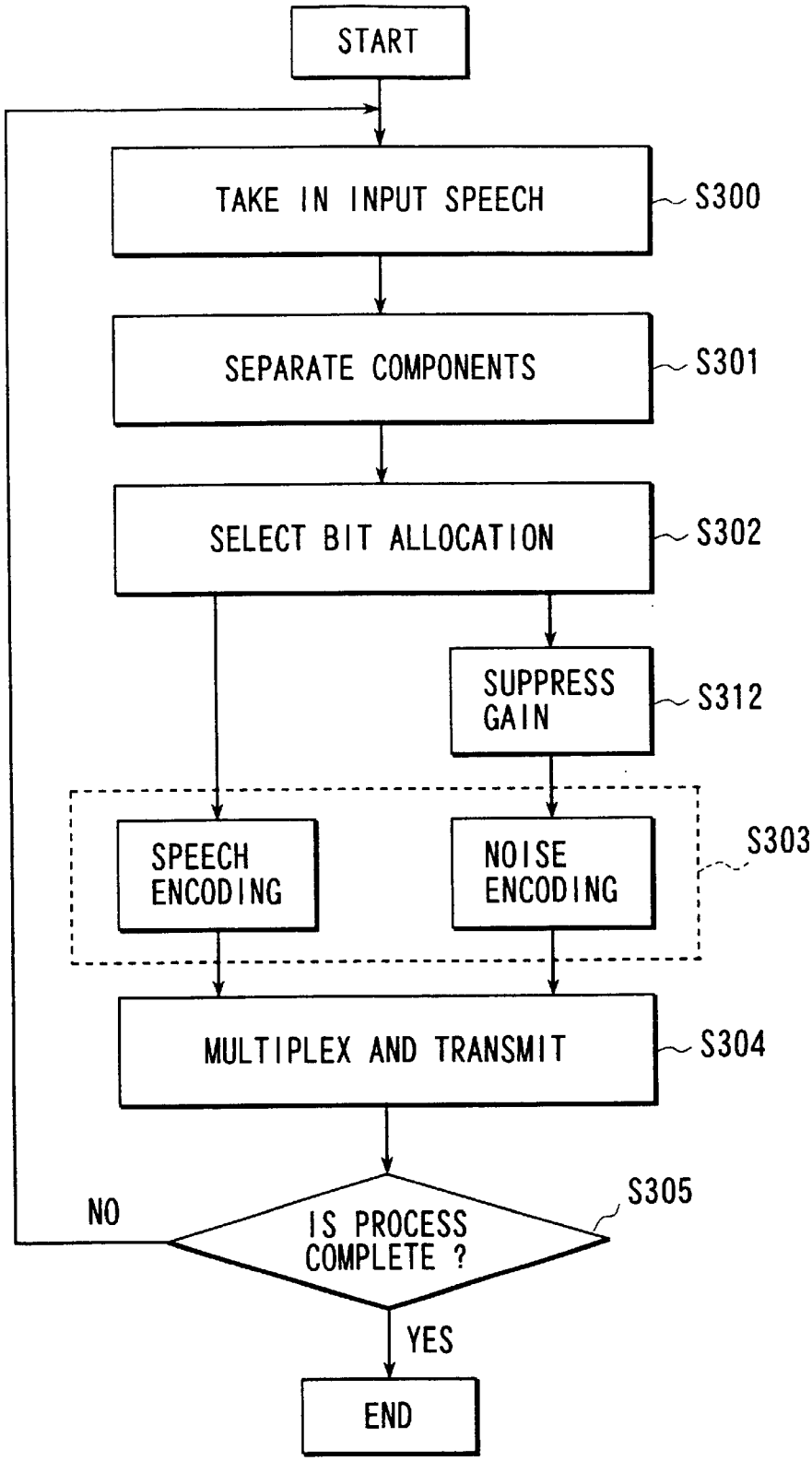
FIG. 9 is a flow chart showing processing steps of a method for encoding speech according to the second embodiment.

A description will now be made on the method for encoding speech according to the present embodiment with reference to the flow chart shown in FIG. 9.

First, the input speech signal is taken in at each predetermined unit of time (step S300), and the component separator 100 analyzes it and separates it into the component mainly constituted by speech and the component mainly constituted by a background noise (step S301).

Next, based on the two kinds of components from the component separator 100, i.e., the component mainly constituted by speech and the component mainly constituted by a background noise, the bit allocation selector 110 selects the number of bits to be allocated to each of the speech encoder 130 and noise encoder 140 from among combinations of bit quantity allocation and output information on the bit allocation to each of the encoders 130 and 140 (step S304).

Next, the gain suppressor 155 suppresses the gain of the component mainly constituted by a background noise output by the component separator 100 according to a predetermined method and inputs the suppressed component to the noise encoder 140 (step S312).

The speech encoder 130 and noise encoder 140 performs encoding processes according to the respective bit allocation selected at the bit allocation selector 120 (step S303). Specifically, the speech encoder 130 receives the component mainly constituted by speech from the component separator 100 and encodes it with the number of bits allocated thereto to obtain encoded data of the component mainly constituted by speech. The noise encoder 140 receives the component mainly constituted by a background noise from the component separator 100 and encodes it with the number of bits allocated thereto to obtain encoded data of the component mainly constituted by a background noise.

Next, the multiplexer 150 multiplexes the encoded data from the encoders 130 and 140 and information on the bit allocation to the encoders 130 and 140 and outputs the result on to a transmission path (step S304). This terminates the process of encoding to be performed at the predetermined time window. It is determined whether encoding is to be continued in the next time window or to be terminated here (step S305).

Figure 10:
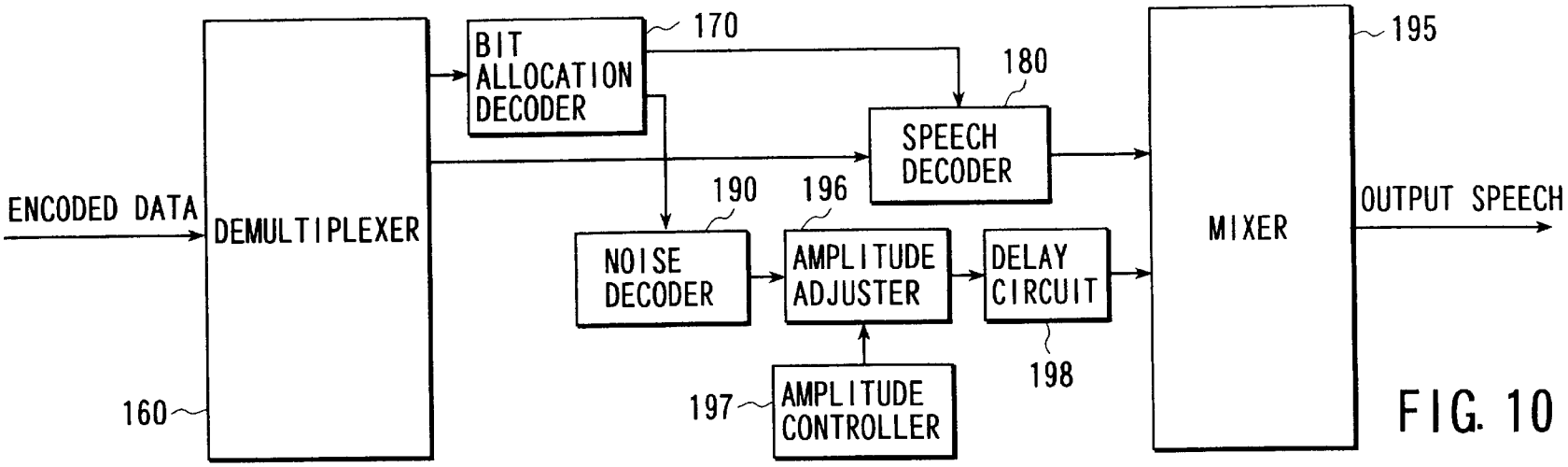
FIG. 10 is a block diagram showing a schematic configuration of a speech decoding apparatus according to a third embodiment of the invention.

FIG. 10 shows a configuration of a speech encoding apparatus in which a method for decoding speech according to a third embodiment of the invention is implemented. The demultiplexer 160, bit allocation decoder 170, speech decoder 180, noise decoder 190 and mixer 195 in FIG. 10 are identical to those in FIG. 4 and, therefore, those elements will not be described here and only other elements will be described in detail.

The present embodiment is different from the speech decoding apparatus in FIG. 4 described in the first embodiment in that the amplitude of the waveform of the component mainly constituted by a background noise reproduced by the noise decoder 190 is adjusted by an amplitude adjuster 196 based on information specified an amplitude controller 197; a delay circuit 198 for delaying the waveform of the component mainly constituted by a background noise such that a phase lag occurs; and the delayed component waveform is combined with the waveform of the component mainly constituted by speech to generate an output speech signal.

According to the present embodiment, the use of the amplitude adjuster 196 makes it possible to suppress a phenomenon that an uncomfortable noise is produced by extremely high power in a certain band. Further, a noise included in finally output speech can be made more perceptually comfortable by controlling the amplitude such that power does not significantly change from the value in the preceding frame.

The delay of the waveform of the component mainly constituted by a background noise at the delay circuit 198 is provided based on the fact that the waveform of the speech reproduced as a result of speech decoding is delayed when it is output. By delaying the background noise by the same degree as that of the speech at this delay circuit 198, the subsequent mixer 195 can combine the speech and the background noise in synchronism.

Since a speech decoding process normally reduces a quantization noise included in a reproduced speech signal on a subjective basis, an adaptive post filter is used to adjust the spectral shape of the reproduced speech signal. In the present embodiment, such an adaptive post filter is used to also delay the waveform of the reproduced component mainly constituted by a background noise considering the amount of the delay that occurs at the speech decoding end, which is advantageous in that the speech and background noise are combined in a more natural manner to provide final output speech with higher quality.

Figure 11:
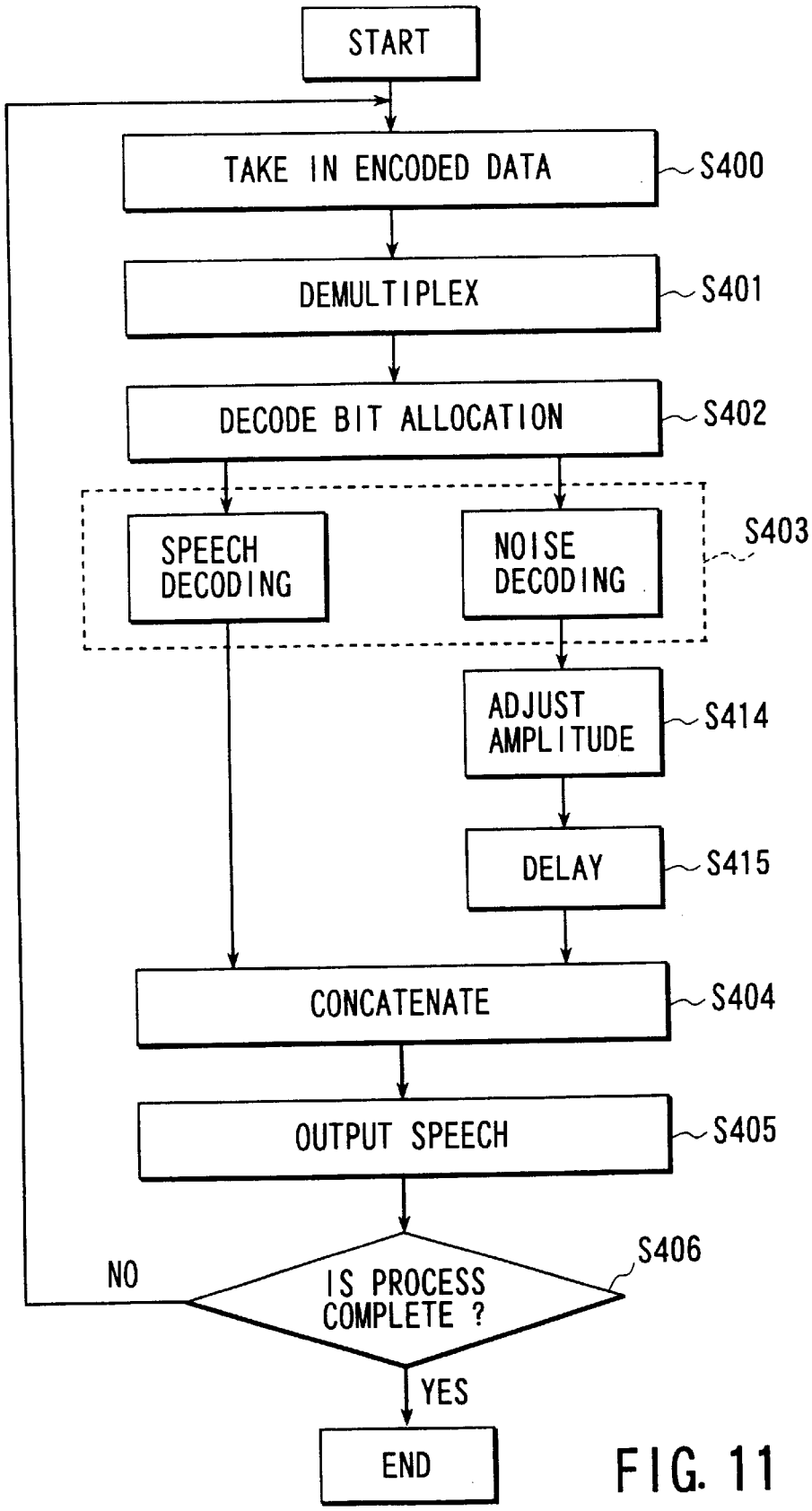
FIG. 11 is a flow chart showing processing steps of a method for decoding speech according to the third embodiment.

A description will now be made on the method for decoding speech according to the present embodiment with reference to the flow chart shown in FIG. 11.

First, input transmitted encoded data is fetched at each predetermined unit of time (step S400), and the encoded data is separated by the demultiplexer 160 into information on bit allocation, encoded data to be input to the speech decoder 180 and encoded data to be input to the noise decoder 190 which are to be output (step S401).

Next, the bit allocation decoder 170 decodes the information on bit allocation and selects and outputs the number of bits to be allocated to the speech decoder 180 and noise decoder 190 from among combinations of bit quantity allocation defined by the same mechanism as that at the encoding end (step S402).

Next, based on the bit allocation by the bit allocation decoder 170, the speech decoder 180 and noise decoder 190 generates respective reproduction signals from the respective encoded data (step S403).

The amplitude of the waveform of the component mainly constituted by a background noise reproduced by the noise decoder 190 is adjusted by the amplitude adjuster 196 (step S414) and, further, the phase of the waveform of the component mainly constituted by a background noise is delayed by the delay circuit 198 by a predetermined amount (step S415).

Next, the mixer 195 concatenates the reproduction signal of the component mainly constituted by speech decoded and reproduced by the speech decoder 180 and the reproduction signal of the component mainly constituted by a background noise decoded and reproduced by the delay circuit 198 (step S404) to generate and output a final speech signal (step S405).

Figure 12:
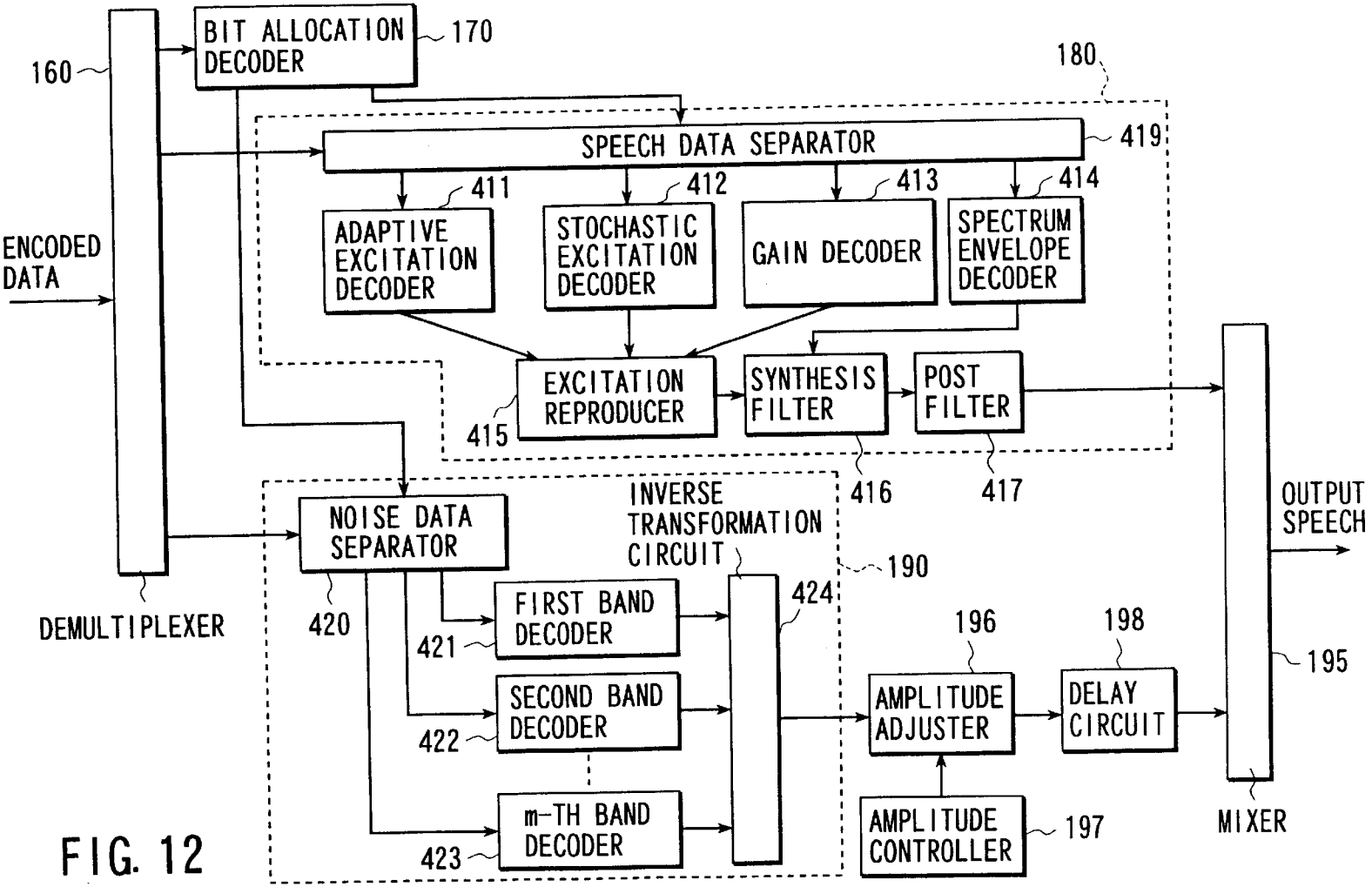
FIG. 12 is a block diagram showing a more detailed configuration of the speech decoding apparatus according to the third embodiment.

FIG. 12 shows a more detailed configuration of the speech decoding apparatus according to the present embodiment.

The demultiplexer 160 separates the encoded data sent from the encoder at each predetermined unit of time as described above, outputs information on bit allocation and information on an index of a spectrum envelope, an adaptive index, a stochastic index and a gain index which are the encoded data to be input to the speech decoder and information on a quantization index for each band which is the encoded data to be input to the noise decoder. The bit allocation decoder 170 decodes the information on bit allocation and selects and outputs the number of bits to be allocated to each of the speech decoder 180 and noise decoder 190 from among combinations of bit quantity allocation defined by the same mechanism as that used for encoding.

The speech decoder 180 decodes the encoded data based on the bit allocation from the bit allocation decoder 170 to generate the reproduction signal of the component mainly constituted by speech which is output to the mixer 195. Specifically, the spectrum envelope decoder 414 reproduces the index of the spectrum envelope and information on the spectrum envelope from the spectrum envelope codebook which is prepared in advance and sends then to the synthesis filter 416. The adaptive excitation decoder 411 receives the information on the adaptive index, extracts a signal which repeats at pitch periods corresponding thereto from the adaptive codebook and outputs it to the excitation reproducer 415.

The stochastic excitation decoder 412 receives the information on the stochastic index, extracts a stochastic signal corresponding thereto from the stochastic codebook and outputs it to the excitation reproducer 415.

The gain decoder 413 receives the information on the gain index, extracts two kinds of gains, i.e., a gain to be used for a pitch component corresponding thereto and a gain to be used for a stochastic component corresponding thereto from the gain codebook and outputs them to the excitation reproducer 415.

The excitation reproducer 415 reproduces an excitation signal (vector) Ex using a signal (vector) Ep repeating at the pitch periods from the adaptive excitation decoder 411, a stochastic signal (vector) En from the stochastic excitation decoder 412 and two kinds of gains Gp and Gn from the gain decoder 413 according Equation 1 described above.

The synthesis filter 416 sets synthesis filter parameters for synthesizing speech using the information on the spectrum envelope and receives the input of the excitation signal from the excitation reproducer 415 to generate a synthesized speech signal. Further, the post filter 417 shapes encoding distortion included in the synthesized speech signal to obtain more perceptually comfortable speech which is output to the mixer 195.

The noise decoder 190 in FIG. 12 will now be described.

The noise decoder 190 receives encoded data required for itself based on the bit allocation from the bit allocation decoder 170, decodes it to generate a reproduction signal of the component mainly constituted by a background noise which is output to the mixer 195. Specifically, the noise data separator 420 separates the encoded data into a quantization index for each band; the first band decoder 421, second band decoder 422, . . . , and m-th band decoder 423 decode a parameter in respective bands; and the inverse transformation circuit 424 performs transformation inverse to the transformation carried out at the encoding end using the decoded parameters to generate a reproduction signal including the component mainly constituted by a background noise.

The amplitude of the waveform of the reproduced component mainly constituted by a background noise is adjusted by the amplitude adjuster 196 based on information specified by the amplitude controller 197. The waveform of the component mainly constituted by a background noise is delayed by the delay circuit 198 to delay the phase thereof and is output to the mixer 195 where it is concatenated with the component mainly constituted by speech which has been shaped by the post filter to generate an output speech signal.

Figure 13:
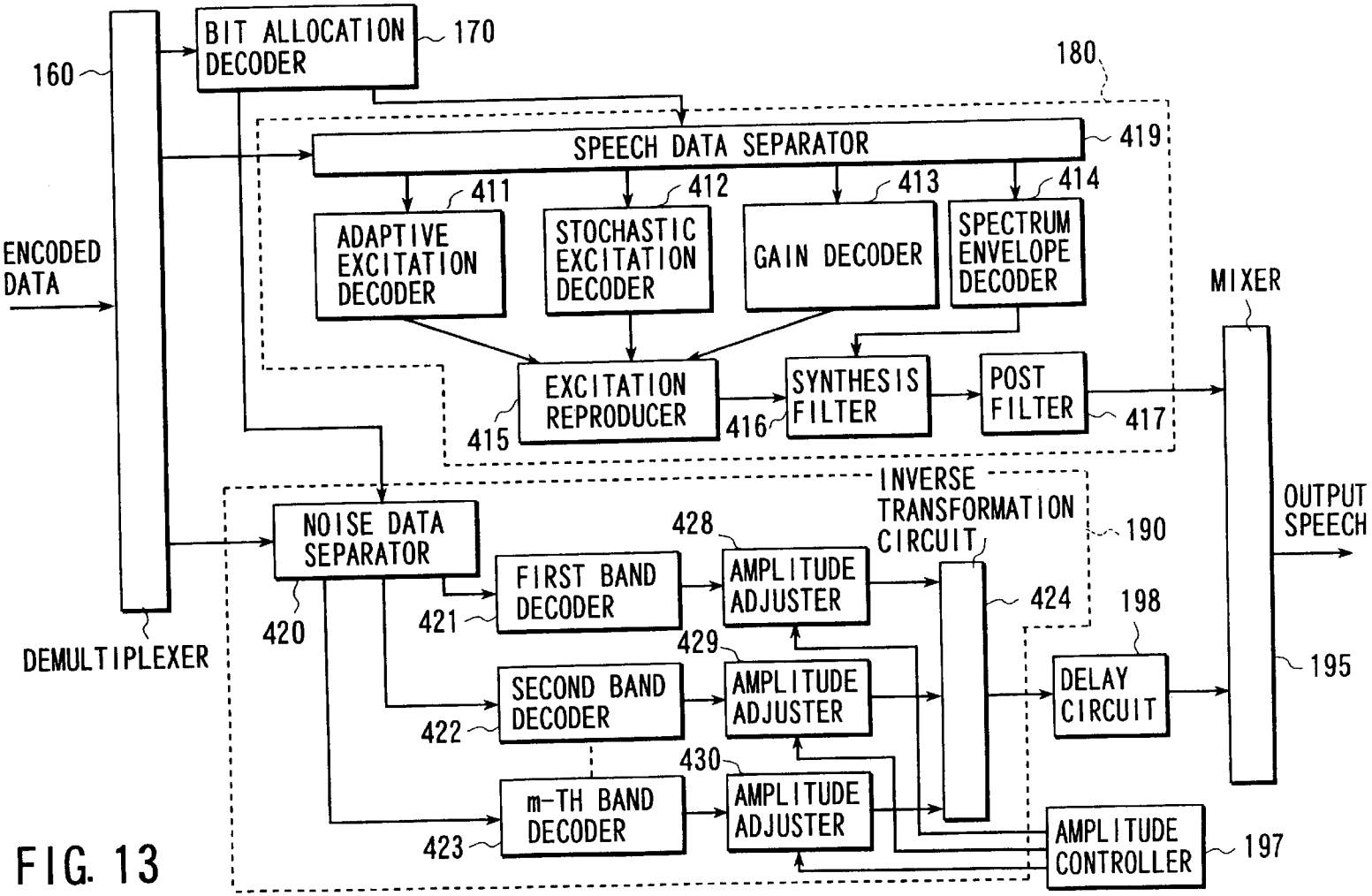
FIG. 13 is a block diagram showing another configuration of the speech decoding apparatus according to the third embodiment in detail.

FIG. 13 shows another configuration of a speech decoding apparatus according to the present embodiment in detail. Referring to FIG. 13 in which parts identical to those in FIG. 12 are indicated by like reference numbers, the present embodiment is different in that the background noise encoder 190 performs the amplitude control on a band-by-band basis.

Specifically, according to the present embodiment, the background noise decoder 190 includes additional amplitude adjusters 428, 429 and 430. Each of the amplitude adjusters 428, 429 and 430 has a function of suppressing any uncomfortable noise resulting from extremely high power in a certain band based on information specified by the amplitude controller 197. This makes it possible to generate a more perceptually comfortable background noise. In this case, the amplitude control performed by the inverse transformation circuit 424 as shown in FIG. 12.

Figure 14:
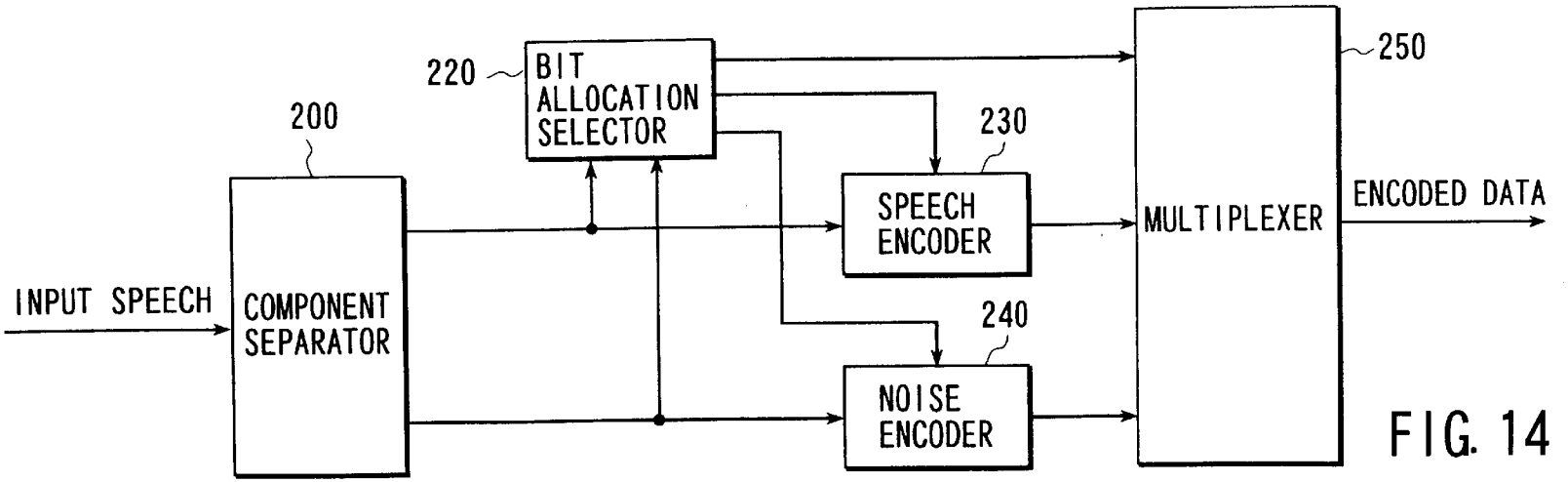
FIG. 14 is a block diagram showing a schematic configuration of a speech encoding apparatus according to a fourth embodiment of the invention.

FIG. 14 shows a configuration of a speech encoder in which a method for encoding speech according to a fourth embodiment of the invention is implemented. This speech encoding apparatus is comprised of a component separator 200, a bit allocation selector 220, a speech decoder 230, a noise encoder 240 and a multiplexer 250.

The component separator 200 analyzes an input speech signal at each predetermined unit of time and performs component separation to separate the signal into a component mainly constituted by speech (a first component) and a component mainly constituted by a background noise (a second component). Normally, an appropriate unit of time for the analysis at the component separation is in the range from about 10 to 30 ms and it is preferable that it substantially corresponds to a frame length which is the unit for speech encoding. While a variety of specific methods are possible for this component separation, since a background noise is normally characterized in that its spectral shape fluctuates more slowly than that of speech, the component separation is preferably carried out using a method that utilizes such a difference between the characteristics of them.

For example, a component mainly constituted by speech can be preferably separated from an input speech signal in an environment having a background noise by using a technique referred to as "spectral subtraction" wherein the background noise is estimated while processing the spectral shape of the background noise which is subjected to less fluctuation over time and wherein, in a time window during which there is abrupt fluctuations, the spectrum of the noise which has been estimated until that time is subtracted from the spectrum of the input speech. On the other hand, a component mainly constituted by a background noise can be obtained by subtracting the component mainly constituted by speech obtained from the input speech signal from the spectrum of the input speech in the time domain or the frequency domain. As the component mainly constituted by a background noise, the estimated spectrum of the background noise described above may be used as it is.

The bit allocation selector 220 selects the number of encoding bits to be allocated to each of the speech encoder 230 and the background noise encoder 240 to be described later from among predetermined combinations of bit allocation based on the two types of components from the component separator 200, i.e., the component mainly constituted by speech and the component mainly constituted by a background noise, and outputs the information on the bit allocation to the speech encoder 230 and noise encoder 240. At the same time, the bit allocation selector 220 outputs the information on bit allocation to the multiplexer 250 as transmission information.

While the bit allocation is preferably selected by comparing the quantities of the component mainly constituted by speech and the component mainly constituted by a background noise, the present invention is not limited thereto. For example, there is another method effective in obtaining more stable speech quality, which is a combination of a mechanism that reduces the possibility of an abrupt change in bit allocation while monitoring the history of changes in bit allocation and comparison of the quantities of the above-described components.

Table 3 below shows examples of the combinations of bit allocation prepared in the bit allocation selector 220 and symbols to represent them.

TABLE 3

| | | | |
|---|---|---|---|
| Symbol for Bit Allocation (Mode) | 0 | 1 | 2 |
| Number of Bits/Frame for Speech Encoding | 78 | 0 | 78-Y |
| Number of Bits/Frame for Noise Encoding | 0 | 78 | Y(0 < Y < 78) |
| Number of Bits/Frame Required to Transmit Symbol for Bit Allocation | 2 | 2 | 2 |
| Total Number of Bits/Frame Required to Encode Input Signal | 80 | 80 | 80 |

Referring Table 3, the mode "0" is selected, 78 bits per frame are allocated to the speech encoder 230, and no bit is allocated to the noise encoder 240. Since two bits for the bit allocation symbol are sent in addition to this, the total number of bits required to encode an input speech signal is 80. It is preferable that this mode "0" bit allocation is selected for a frame in which the component mainly constituted by a background noise is almost negligible in comparison to the component mainly constituted by speech. As a result, more bits are allocated to the speech encoder to improve the quality of reproduced speech.

On the other hand, when the mode "1" is selected, no bit is allocated to the speech encoder 230, and 78 bits are allocated to the noise encoder 240. Since two bits for the bit allocation symbol are sent in addition to this, the total number of bits required for encoding the input speech signal is 80. It is preferable that this mode "1" bit allocation is selected for a frame in which the component mainly constituted by speech is at a negligible level relative to the component mainly constituted by a noise.

When the mode "2" is selected, 78−Y bits are allocated to the speech encoder 230, and Y bits are allocated to the noise encoder 240. Y represents a positive integer which is sufficiently small. Although the description will proceed on an assumption that Y=8, the present invention is not limited to this value. In the mode "2", since two bits for the bit allocation symbol are sent in addition, the total number of bits required for encoding the input signal is 80.

Bit allocation like this mode "2" is preferable for a frame in which both of the component mainly constituted by speech and the component mainly constituted by a background noise exist. In this case, since it is apparent that the component mainly constituted by speech is more important perceptually, a very small number of bits are allocated to the noise encoder as described above and the number of bits allocated to the speech encoder 230 is increased accordingly to encode the component mainly constituted by speech accurately. What is important at this point is how to efficiently encode the component mainly constituted by a background noise with such a small number of bits. A specific method for achieving this will be described later in detail.

As described above, it is possible to encode the speech and background noise at the respective encoders and to reproduce speech accompanied by a natural background noise. An appropriate frame length for speech encoding is in the range from about 10 to 30 ms. In this example, the total number of bits per frame is fixed at 80 for the two kinds of combination of bit allocation. When the total number of bits per frame is thus fixed, encoding can be performed at a fixed bit rate irrespective of the input speech signal.

The speech encoder 230 receives the component mainly constituted by speech from the component separator 200 and encodes the component mainly constituted by speech through speech encoding that reflects the characteristics of the speech signal. Although it is apparent that any method capable of efficient encoding of a speech signal may be used in the speech encoder 230, the CELP system which is one of methods capable of producing natural speech is used here as an example. The CELP system is a system which normally performs encoding in the time domain and is characterized in that an excitation signal is encoded such that a waveform thereof synthesized in the time domain is subjected to less distortion.

The noise encoder 240 is configured such that it can receive the component mainly constituted by a background noise from the component separator 200 and can encode the background noise preferably. Normally, a background noise is characterized in that its spectrum fluctuates over time more slowly than that of a speech signal and in that the information on the phase of its waveform is random and is not so important for the ears of a person.

In order to encode such a background noise component efficiently, methods such as transform encoding wherein the time domain is transformed into the transform domain and wherein the transform coefficient or a parameter extracted from the transform coefficient is encoded allows more efficient encoding than waveform encoding such as the CELP system wherein waveform distortion is suppressed. Especially, encoding efficiency can be further improved by the use of encoding involving transformation into the frequency domain wherein human perceptual characteristics are taken into consideration.

Figure 2:
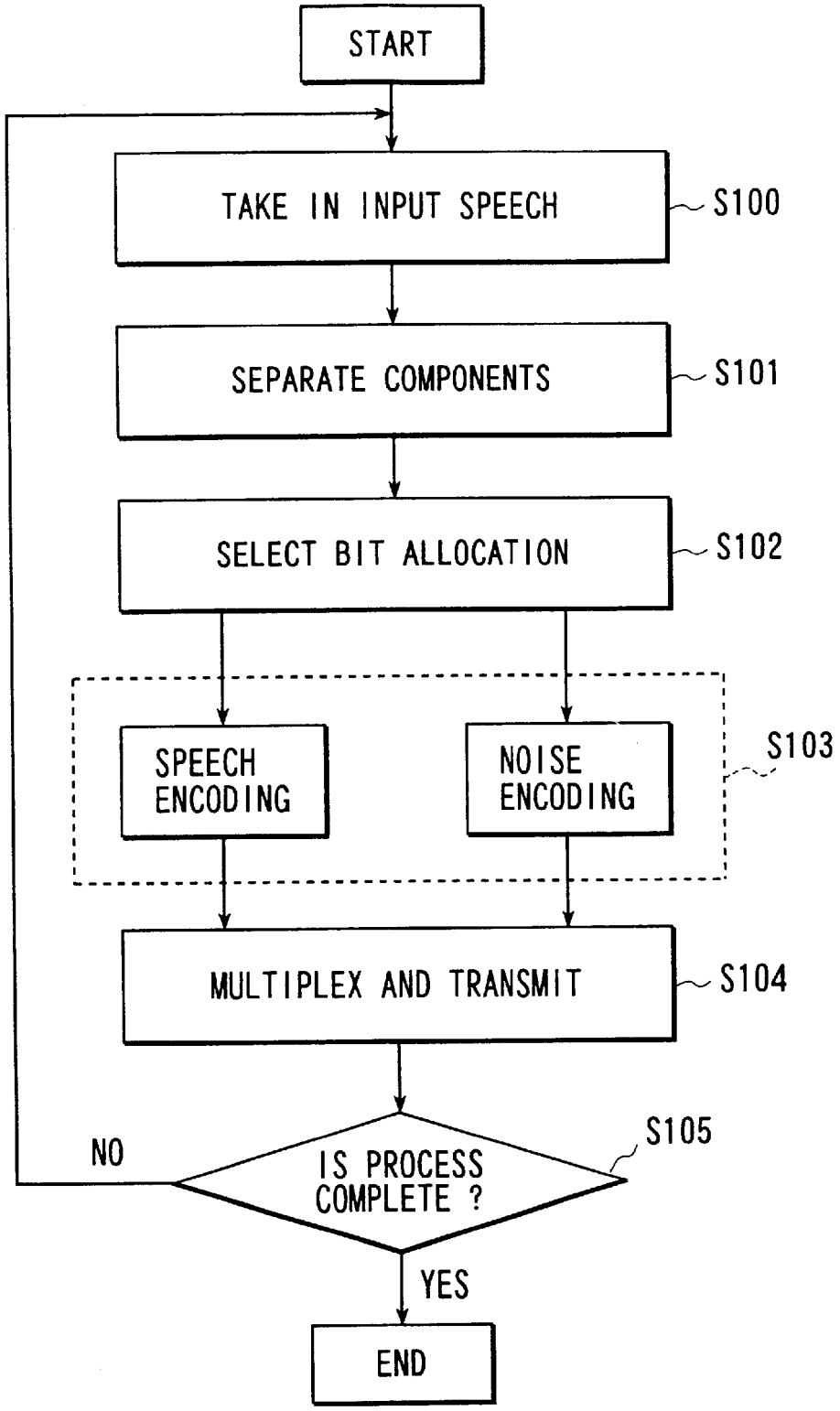
FIG. 2 is a flow chart showing processing steps of a method for encoding speech according to the first embodiment.

The flow of basic processes of the method for encoding speech of this embodiment is as shown in FIG. 2 like the first embodiment and therefore will not be described here.

Figure 15:
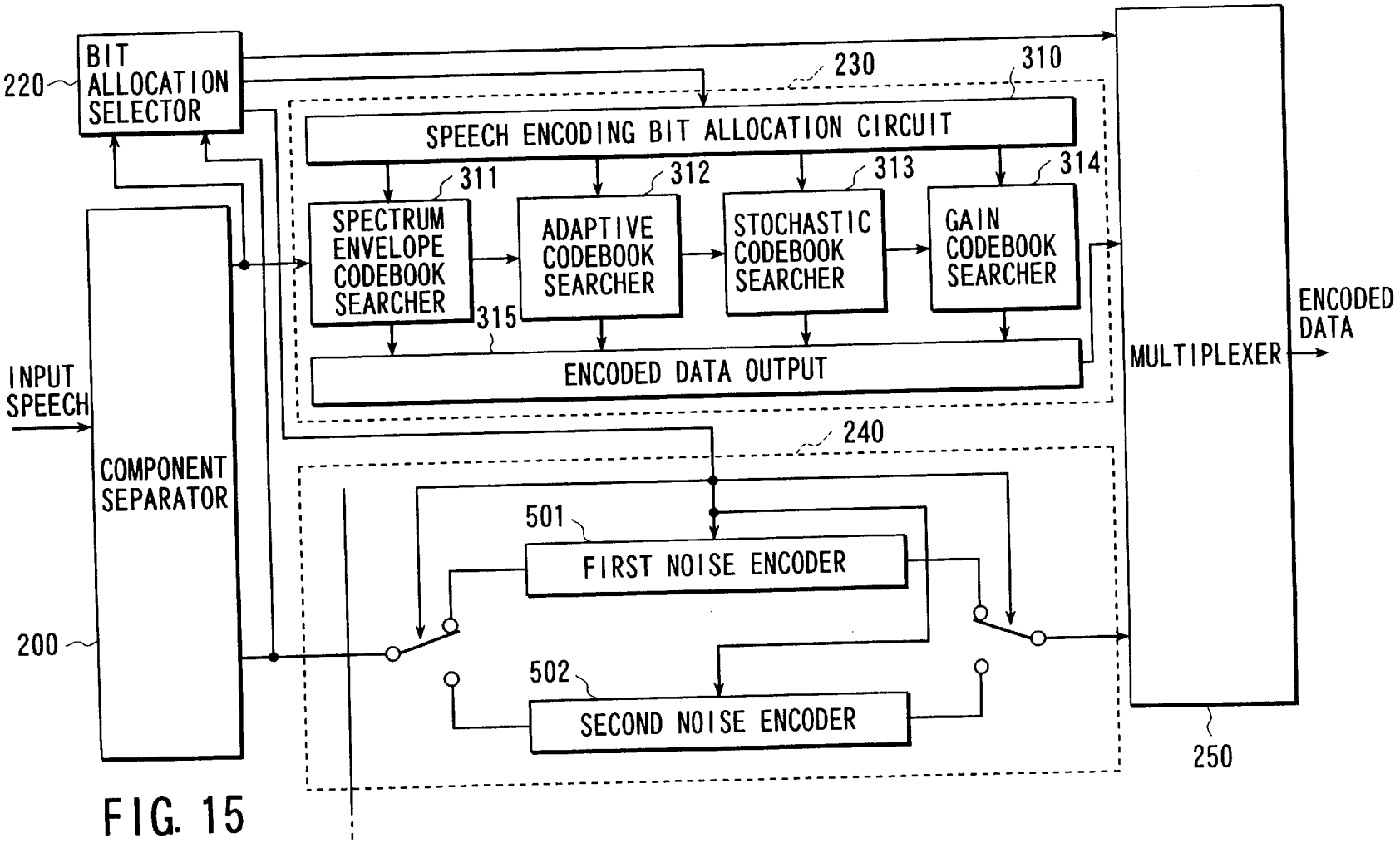
FIG. 15 is a block diagram showing a more detailed configuration of the speech encoding apparatus according to the fourth embodiment.

FIG. 15 shows a specific example of a speech encoding apparatus according to the present embodiment in which the speech encoder 230 and the noise encoder 240 employ the CELP system and transform encoding, respectively.

The speech encoder 230 receives the component mainly constituted by speech from the component separator 200 and encodes this component such that distortion of its waveform in the time domain is suppressed. In doing so, mode information is supplied from the bit allocation selector 220 to a speech encoding bit allocation circuit 310 to allow each of the encoders to perform encoding under bit allocation which is defined in advance according to the mode information. The mode "0" wherein a great number of bits are allocated will be described first, and a description of the modes "1" and "2" will follow.

The operation of the speech encoder in the mode "0" is basically the same as that in the first embodiment. It performs CELP encoding using a spectrum envelope codebook searcher 311, an adaptive codebook searcher 312, a stochastic codebook searcher 313 and a gain codebook searcher 314. Information on indices into the codebooks searched by the codebook searchers 311 through 314 is input to the encoded data output section 315 and is output from the encoded data output section 315 to the multiplexer 150 as encoded speech data.

Next, in mode "1", the number of bits allocated to the speech encoder 230 is 0. Therefore, the speech encoder 230 is put in a non-operating state such that it outputs no code to the multiplexer 250. At this point, attention must be paid to the internal state of the filter used for speech encoding. A process must be performed to return it to the initial state in synchronism with the decoder to be described later, or to update the internal state to prevent any discontinuity of decoded speech signal, or to clear it to zero.

Next, in mode "2", the speech encoder 230 can use only 78−Y bits. The process in this mode "2" is basically the same as that in the mode "1" except that the encoding is carried out reducing the size of the stochastic codebook 313 or gain codebook 314 which is assumed to have relatively small influence on overall quality by Y bits. Obviously, the codebooks 311, 312, 313 and 314 must be the same as the codebobks in the speech decoder to be described later.

The details of the noise encoder 240 will now be described.

The mode information from the bit allocation selector 220 is supplied to the noise encoder 240 in which a first noise encoder 501 is used for the mode "1" and a second noise encoder 501 is used for the mode "2".

The first noise encoder 501 uses as many as 78 bits for noise encoding to encode the shape of the background noise component accurately. On the other hand, the number of bits used for noise encoding at the second noise encoder 502 is as very small as Y bits, and this encoder is used when the background noise component must be efficiently represented with a small number of bits. In mode "0", the number of bits allocated to the noise encoder 240 is 0. Therefore, it encodes nothing and outputs nothing to the multiplexer 250. At this point, an appropriate process must be performed on the internal state of the buffer and filter in the noise encoder 240. For example, it is necessary to clear the internal state to zero, or to update the internal state to prevent any discontinuity of decoded noise signal, or to return it to the initial state. This internal state must be made identical to the internal state of the noise decoder to be described later by establishing synchronism between them.

The first noise encoder 501 will now be described in detail with reference to FIG. 16.

The first noise encoder 501 is activated by a signal supplied to an input terminal 511 thereof from the bit allocation selector 220 and receives a component mainly constituted by a background noise from the component separator 200 at an input terminal 512 thereof. It is different from the speech encoder 230 in its method of encoding wherein it obtains a transform coefficient of the component using predetermined transformation and encodes it such that distortion of parameters in the transform domain is suppressed.

While there are various possible methods for representing parameters in the transform domain, a method will be described here as an example wherein a background noise component is subjected to band division in the transform domain; a parameter representing each band; and those parameters are quantized and indices thereof are transmitted.

First, a transform coefficient calculator 521 obtains a transform coefficient of the component mainly constituted by a background noise, using predetermined transformation. The transformation may be carried out using discrete Fourier transform. Next, a band divider 522 divides the frequency axis into predetermined bands and quantizes a parameter in each of m bands of a first band encoder 523, a second band encoder 524, . . . , and an m-th band encoder 525 using quantization bits in a quantity in accordance with bit allocation by the noise encoding bit allocation circuit 520 input to the input terminal 511. The parameter may be a value which is an average of spectrum amplitude or power spectrum in each band obtained from the transform coefficient. The indices representing quantized values of the parameters of those bands are collected by the encoded data output section 526 which outputs encoded data to the multiplexer 250.

The second noise encoder 502 will now be described in detail with reference to FIGS. 17 and 18. The second noise encoder 502 is used in the mode "2", i.e., when the number of bits available for noise encoding is very small as described above and, therefore, it must be able to represent the background noise component efficiently with a small number of bits.

Figures 17A, 17B, 17C, 17D:
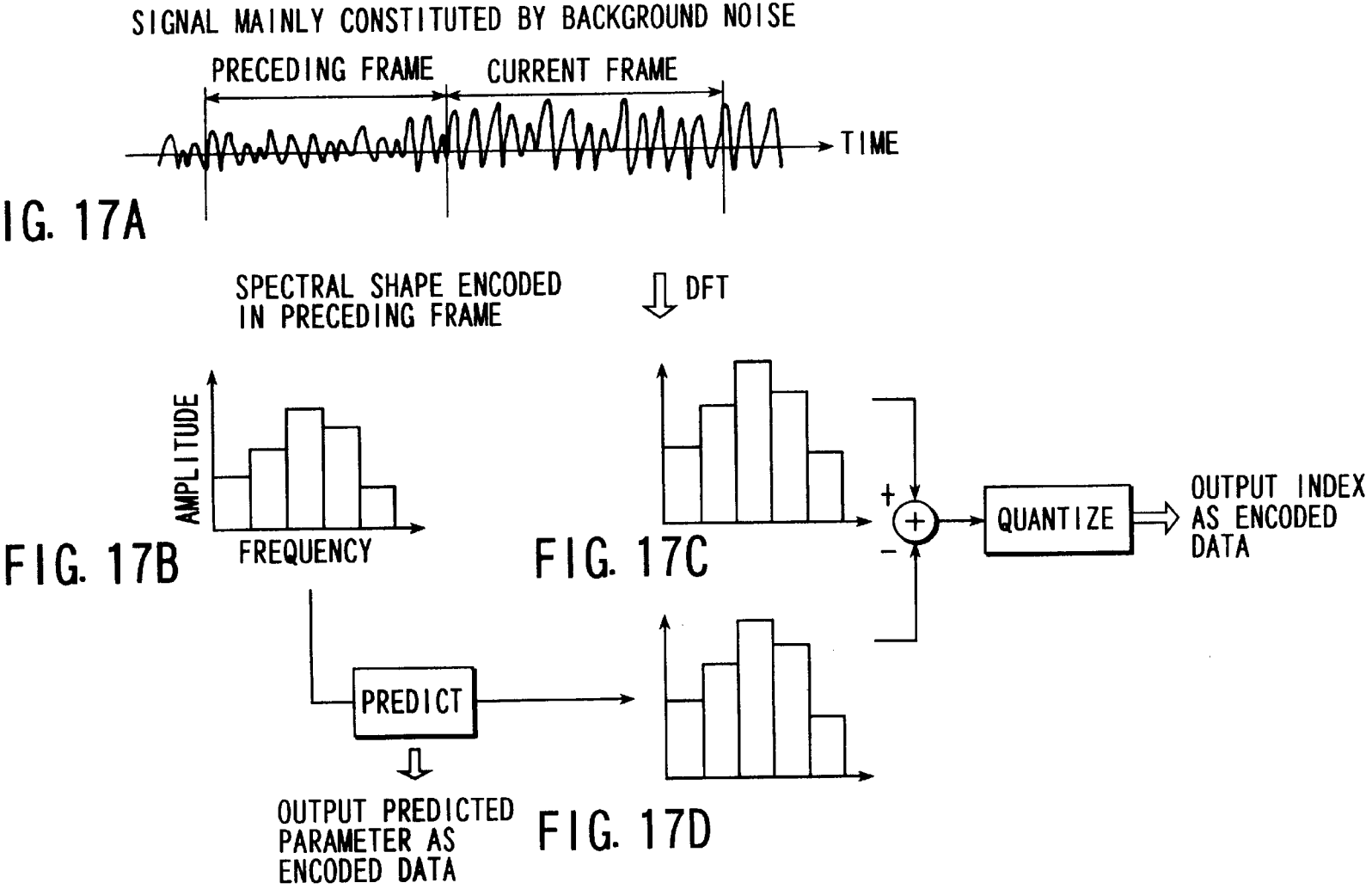
FIGS. 17A to 17D are diagrams for describing the operation of the second noise encoder in FIG. 15.

FIGS. 17A through 17D are diagrams for describing a basic operation of the second noise encoder 502. FIG. 17A shows the waveform of a signal whose main component is a background noise; FIG. 17B shows a spectral shape obtained as a result of encoding in the preceding frame; and FIG. 17C shows a spectral shape obtained in the current frame. Since the characteristics of a background noise component can be regarded substantially constant for a relatively long period of time, a background noise component can be efficiently encoded by outputting a predicted parameter, as encoded data, obtained by making a prediction using the spectral shape of the background noise component encoded in the preceding frame and by quantizing the difference between the predicted spectral shape (FIG. 17D) and the spectral shape of the background noise component obtained in the current frame (FIG. 17C).

Figure 18:
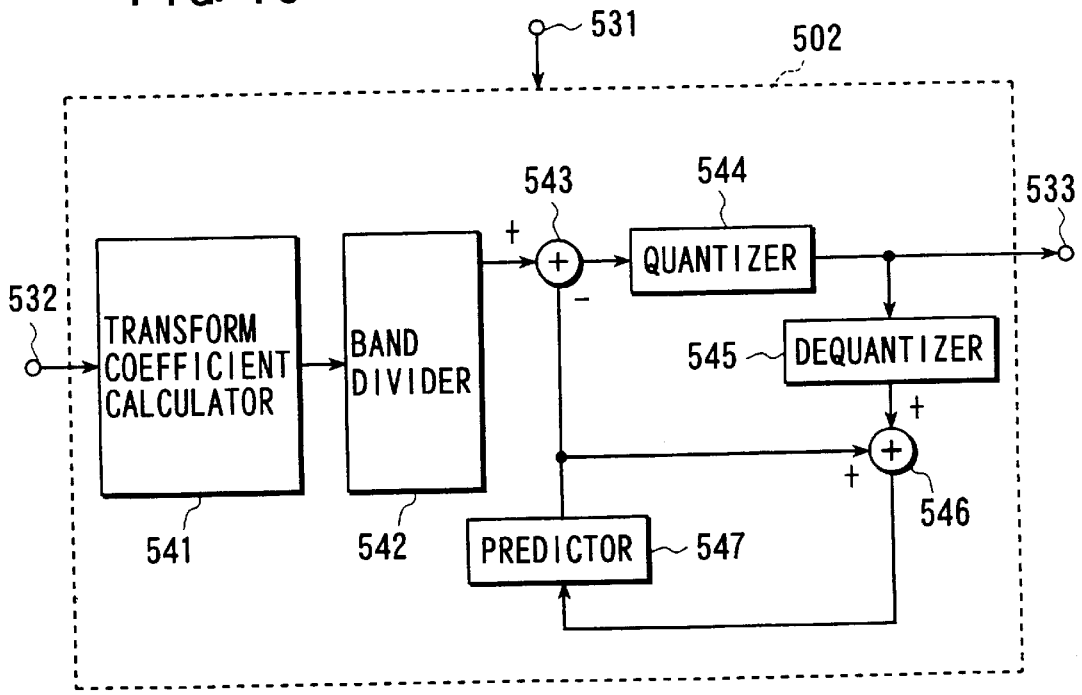
FIG. 18 is a block diagram showing an internal configuration of the second noise encoder in FIG. 15.
Figure 19:
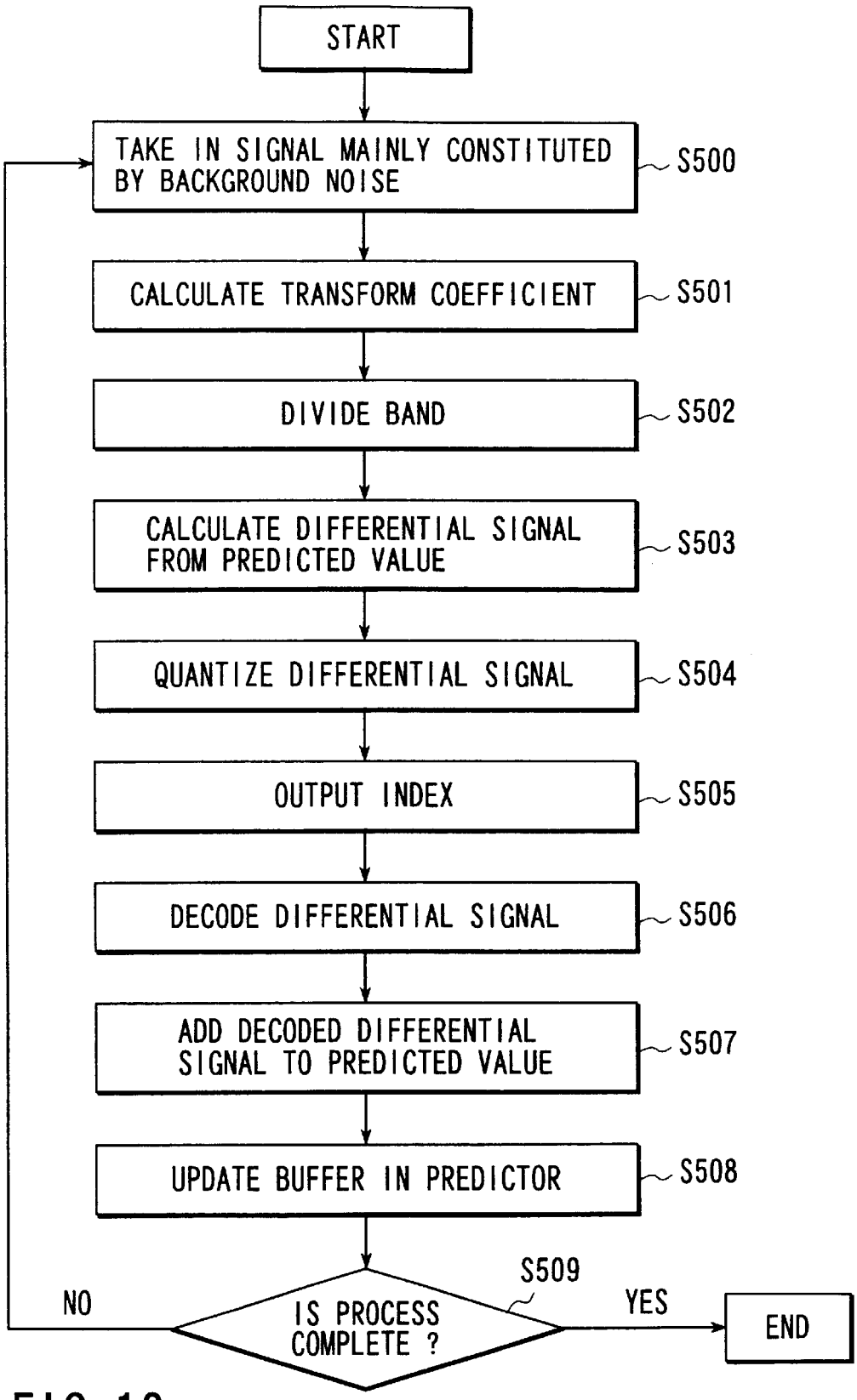
FIG. 19 is a flow chart showing processing steps of the second noise encoder in FIG. 15.

FIG. 18 is a block diagram showing an example of the implementation of the second noise encoder 502 based on this principle, and FIG. 19 is a flow chart showing the configuration and processing steps of the second noise encoder 502.

The second noise encoder 502 is activated by a signal supplied to an input terminal 521 thereof by the bit allocation selector 220 in the mode "2". It takes in a signal mainly constituted by a background noise through an input terminal 532 (step S500), calculates a transform coefficient at a transform coefficient calculator 541 as in FIG. 16 (Step S501), performs band division in a band divider 542 (step S502) and calculates the spectral shape in the current frame.

Figure 16:
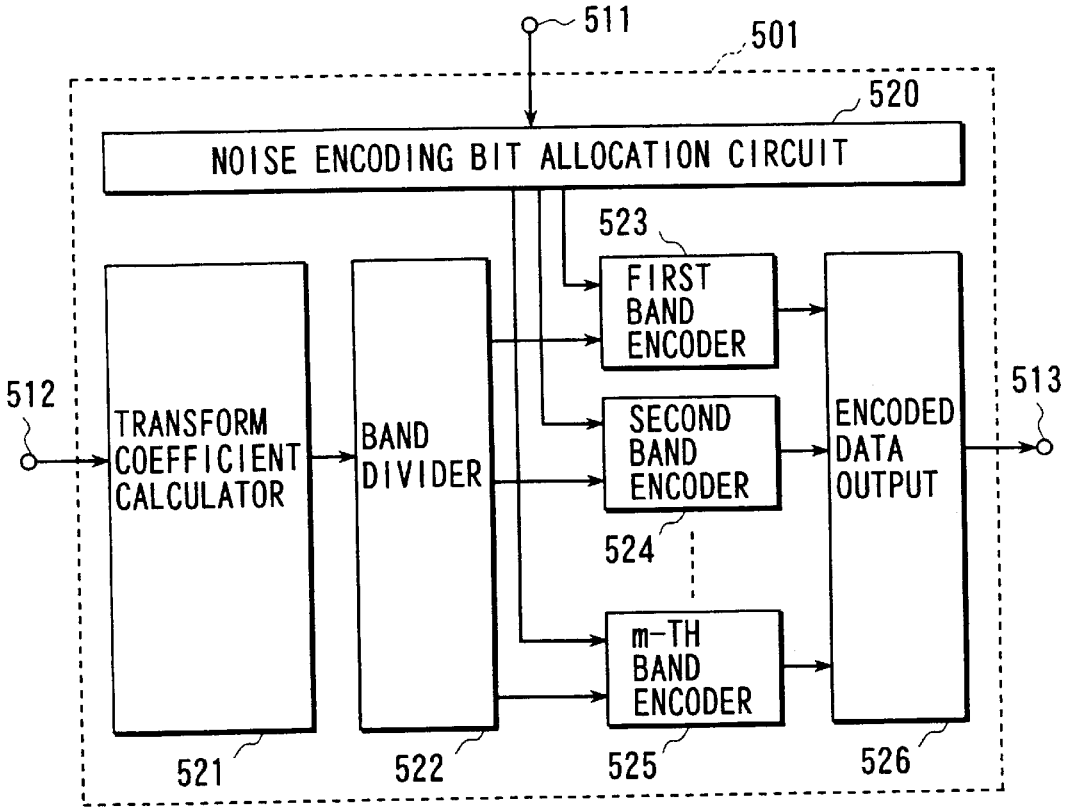
FIG. 16 is a block diagram showing internal configuration of the first noise encoder in FIG. 15.

The transform coefficient calculator 541 and band divider 542 used here may be different from or the same as the transform coefficient calculator 521 and band divider 522 in the first noise encoder 501 shown in FIG. 16. When the same parts are used, they may be used on a shared basis instead of providing them separately. This equally applies to other embodiments of the invention to be described later.

Next, a predictor 547 estimates the spectral shape of the current frame from the spectral shape of a previous frame, and a differential signal between the spectral shape of the previous frame and the spectral shape of the current frame by an adder 543 (step S503). This differential signal is quantized by a quantizer 544 (step S504). An index representing the quantized value is output from an output terminal 533 as encoded data (step S505). At the same time, dequantization is performed by a dequantizer 545 to decode the differential signal (step S506). The predicted value from the predictor 547 is added to this decoded value in an adder 546 (step S507), and the result of this addition is supplied to the predictor 547 to update a buffer in the predictor 547 (step S508) in preparation for the input of the spectral shape of the next frame. The above-described series of operations is repeated until step S509 determines that the process has been completed.

As the spectral shape of a background noise input to the predictor 547, the most recently decoded value must be always supplied and, even when the first noise encoder 501 is selected, a decoded value of the spectral shape of the background noise at that time is to be supplied to the predictor 547.

Although AR prediction of first order has been described so far, the present invention is not limited thereto. For example, the predictive order may be two or more to improve prediction efficiency. Further, the prediction may be carried out using MA prediction or ARMA prediction. Further, feedforward type prediction wherein information on a prediction coefficient is also transmitted to the decoder may be performed to improve prediction efficiency. This equally applies to other embodiments which will be described later.

Prediction is performed for each band, although FIG. 18 shows it in a simplified manner for convenience in illustration. Referring to quantization, scalar quantization is performed for each band or a plurality of bands are collectively converted into a vector to perform vector quantization.

Such encoding makes it to possible to efficiently represent the spectral shape of a background noise component with a small amount of encoded data.

Figure 20:
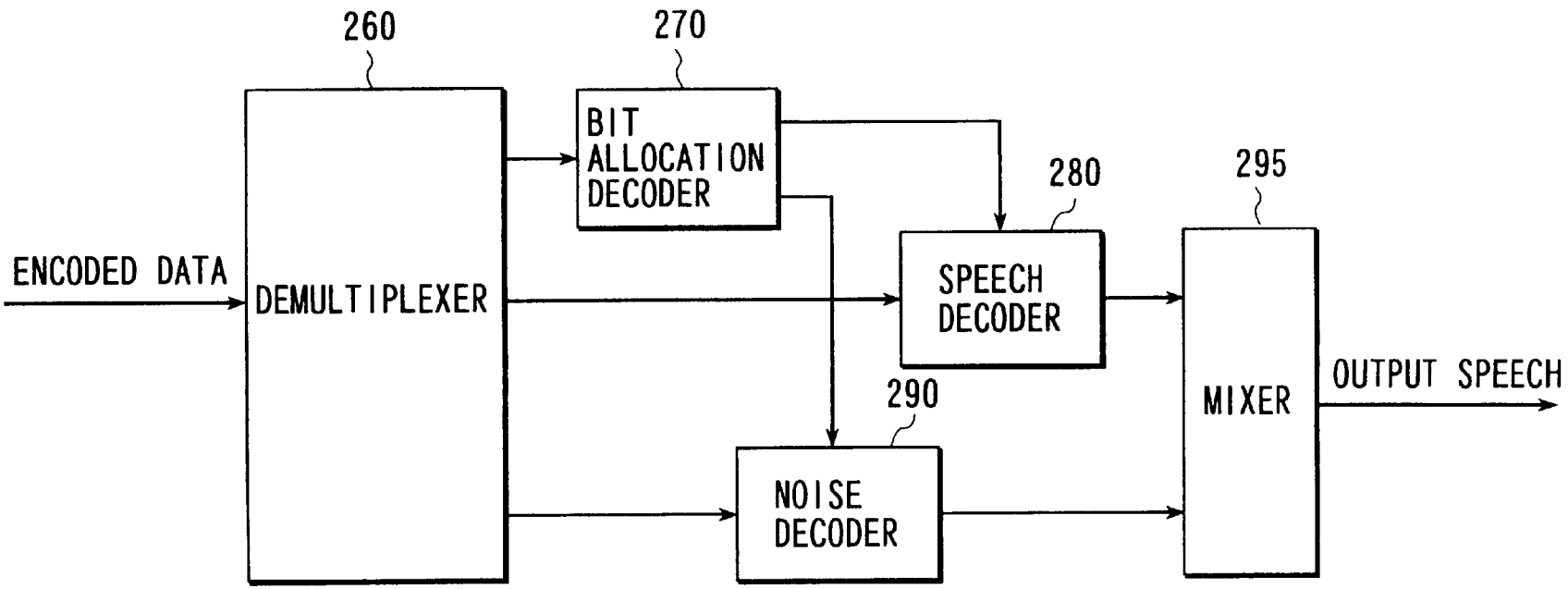
FIG. 20 is a block diagram showing a schematic configuration of a speech decoding apparatus according to a fourth embodiment of the invention.

FIG. 20 shows a configuration of a speech decoding apparatus in which the method for decoding speech according to the present embodiment is implemented. This speech decoding apparatus comprises a demultiplexer 260, a bit allocation decoder 270, a speech decoder 280, a noise decoder 290 and a mixer 295.

The demultiplexer 260 receives encoded data sent from the speech encoding apparatus shown in FIG. 14 at each predetermined unit of time as described above, separates it into information on bit allocation, encoded data to be input to the speech decoder 280 and encoded data to be input to the noise decoder 290 which are to be output.

The bit allocation decoder 270 decodes the information on bit allocation and selects and outputs the number of bits to be allocated to the speech decoder 280 and noise decoder 290 from among combinations of bit quantity allocation defined by the same mechanism as that at the encoding end.

Based on the bit allocation by the bit allocation decoder 270, the speech decoder 280 decodes the encoded data to generate a reproduction signal of the component mainly constituted by the speech and outputs it to the mixer 295.

Based on the bit allocation by the bit allocation decoder 270, the noise decoder 290 decodes the encoded data to generate a reproduction signal of the component mainly constituted by a background noise and outputs it to the mixer 295.

The mixer 295 concatenates the reproduction signal of the component mainly constituted by the speech which is decoded and reproduced by the speech decoder 280 and the reproduction signal of the component mainly constituted by a background noise which is decoded and reproduced by the noise decoder 290 to generate a final output speech signal.

Figure 5:
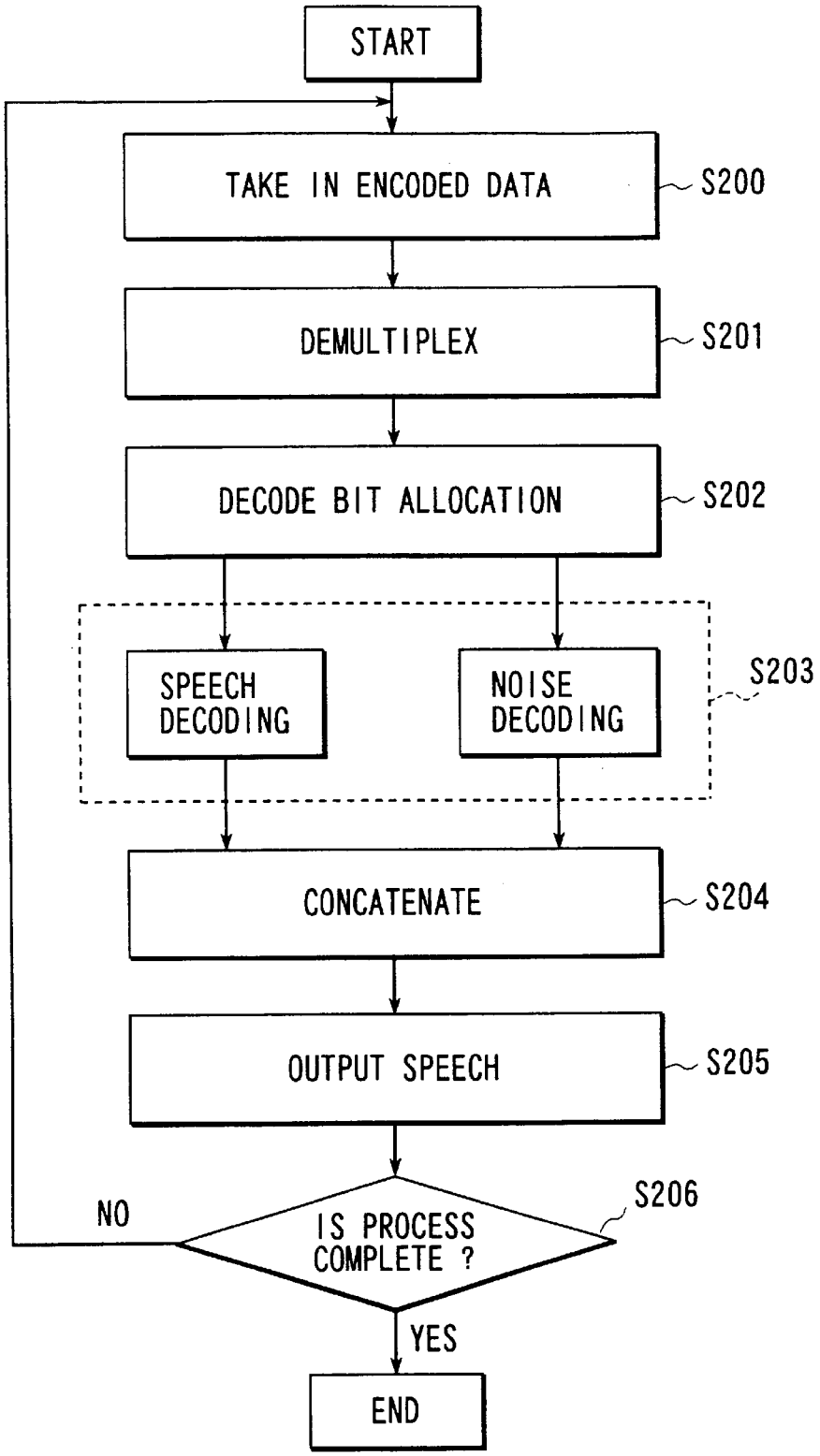
FIG. 5 is a flow chart showing processing steps of a method for decoding speech according to the first embodiment.

The flow of basic processes of the method for decoding speech according to the present embodiment is as shown in FIG. 5 like the first embodiment and will be therefore not described here.

Figure 21:
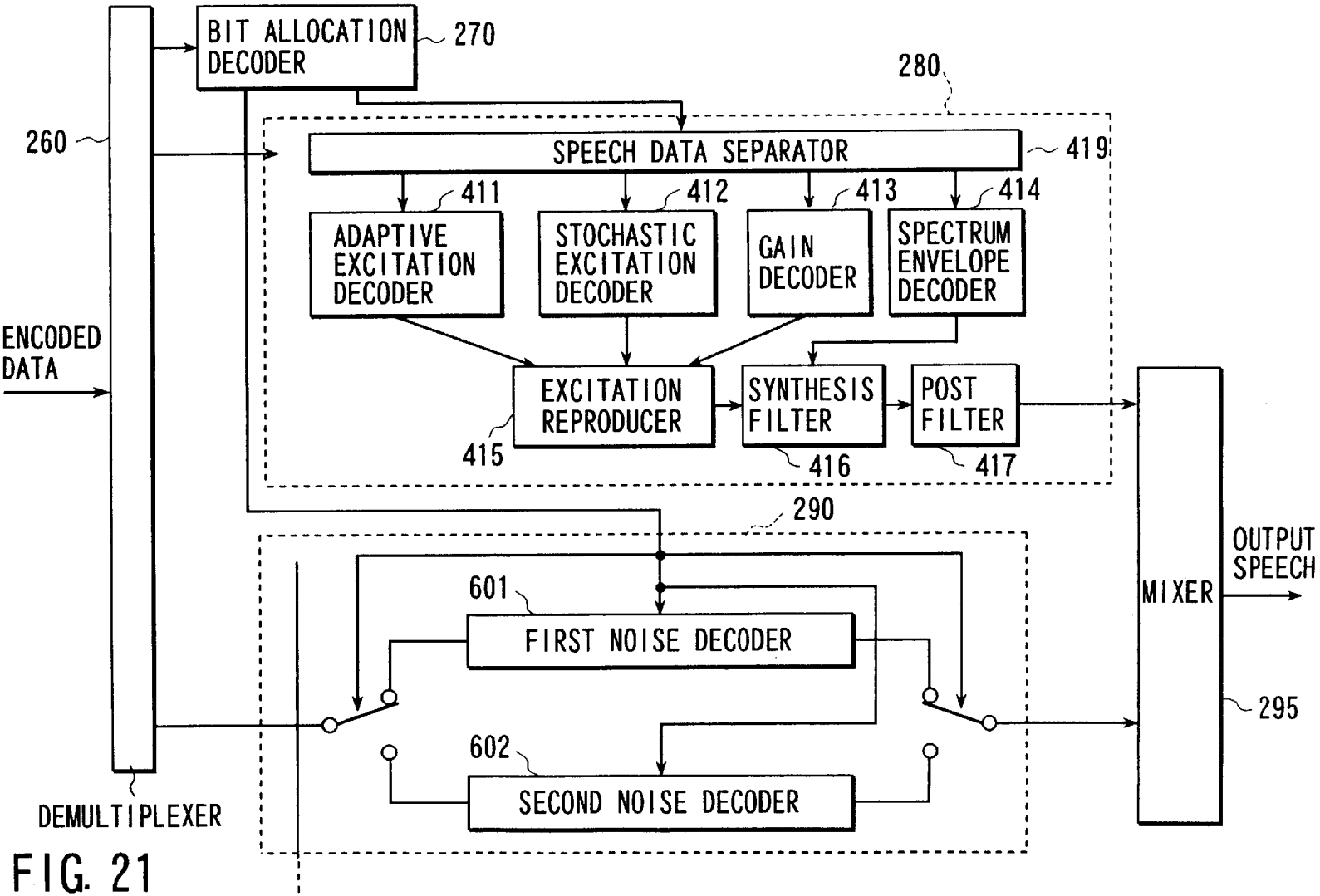
FIG. 21 is a block diagram showing a more detailed configuration of the speech decoding apparatus according to the fourth embodiment.

FIG. 21 shows a specific example of a speech decoding apparatus which is associated with the configuration of the speech decoding apparatus in FIG. 14. The demultiplexer 260 separates encoded data at each predetermined unit of time transmitted by the speech encoding apparatus in FIG. 14 to output information on bit allocation an index of a spectrum envelope, an adaptive index, a stochastic index and a gain index which are the encoded data to be input to the speech decoder 280 and information on a quantization index for each band which is the encoded data to be input to the noise decoder 290. The bit allocation decoder 270 decodes the information on bit allocation and selects and outputs the number of bits to be allocated to each of the speech decoder 280 and noise decoder 290 from among combinations of bit quantity allocation defined by the same mechanism as that used for encoding.

In the mode "0", the information on bit allocation is input to the speech decoder 280 at each unit of time. Here, a description will be made on a case wherein information indicating the mode "0" is input as the formation on bit allocation. The mode "0" is a mode which is selected when the number of bits allocated for speech encoding is as great as 78 and the signal mainly constituted by a speech component is so significant that the signal mainly constituted by a stochastic component is negligible. A case wherein information indicating the mode "1" or mode "2" is supplied will be described later.

In mode "0", the operation of the speech decoder 280 is the same as that of the speech decoder 180 in the first embodiment. It decodes the encoded data based on the bit allocation from the bit allocation decoder 270 to generate a reproduction signal of the signal mainly constituted by a speech component and outputs it to the mixer 295.

Specifically, the spectrum envelope decoder 414 reproduces the index of the spectrum envelope and information on the spectrum envelope from the spectrum envelope codebook which is prepared in advance and sends then to the synthesis filter 416. The adaptive excitation decoder 411 receives the information on the adaptive index, extracts a signal which repeats at pitch periods corresponding thereto from the adaptive codebook and outputs it to the excitation reproducer 415. The stochastic excitation decoder 412 receives the information on the stochastic index, extracts a stochastic signal corresponding thereto from the stochastic codebook and outputs it to the excitation reproducer 415. The gain decoder 413 receives the information on the gain index, extracts two kinds of gains, i.e., a gain to be used for a pitch component corresponding thereto and a gain to be used for a stochastic component corresponding thereto from the gain codebook and outputs them to the excitation reproducer 415. The excitation reproducer 415 reproduces an excitation signal (vector) Ex according to the previously described Equation 1 using a signal (vector) Ep repeating at the pitch periods from the adaptive excitation decoder 411, a stochastic signal (vector) En from the stochastic excitation decoder 412 and two kinds of gains Gp and Gn from the gain decoder 413.

The synthesis filter 416 sets synthesis filter parameters for synthesizing speech using the information on the spectrum envelope and receives the input of the excitation signal from the excitation reproducer 415 to generate a synthesized speech signal. Further, the post filter 417 shapes encoding distortion included in the synthesized speech signal to obtain more perceptually comfortable speech which is output to the mixer 295.

Next, in the mode "1", the number of bits allocated to the speech decoder 280 is 0. Therefore, the speech decoder 280 is put in a non-operating state such that it outputs no code to the mixer 295. At this point, attention must be paid to the internal state of a filter used in the speech decoder 280. A process must be performed to return it to the initial state in synchronism with the speech encoder described above, or to update the internal state to prevent any discontinuity of the decoded speech signal, or to clear it to zero.

Next, in mode "2", the speech decoder 280 can use only 78−Y (0<Y<78) bits. The process in this mode "2" is basically the same as that in the mode "0" except that the decoding is carried out by reducing the size of the stochastic codebook or gain codebook which is assumed to have relatively small influence on overall quality by Y bits. Obviously, the various codebooks must be the same as the codebooks in the speech encoder described above.

The noise decoder 290 will now be described.

The noise decoder 290 is comprised of a first noise decoder 601 used in the mode "1" and a second noise decoder 602 in the mode "2". The first noise decoder 601 uses as many as 78 bits for encoded data of a background noise and is used for decoding the shape of a background noise component accurately. The number of bits used for encoded data of a background noise at the second noise decoder 602 is as very small as Y bits, and this decoder is used when the background noise component must be efficiently represented with a small number of bits.

On the other hand, in the mode "0", the number of bits allocated to the noise decoder 290 is 0. Therefore, it decodes nothing and outputs nothing to the. mixer 295. At this point, an appropriate process must be performed on the internal state of the buffer and filter in the noise decoder 290. For example, it is necessary to clear the internal state to zero, or to update the internal state to prevent any discontinuity of the decoded noise signal, or to return it to the initial state. This internal state must be made identical to the internal state of the noise encoder 240 described above by establishing synchronism between them.

Figure 22:
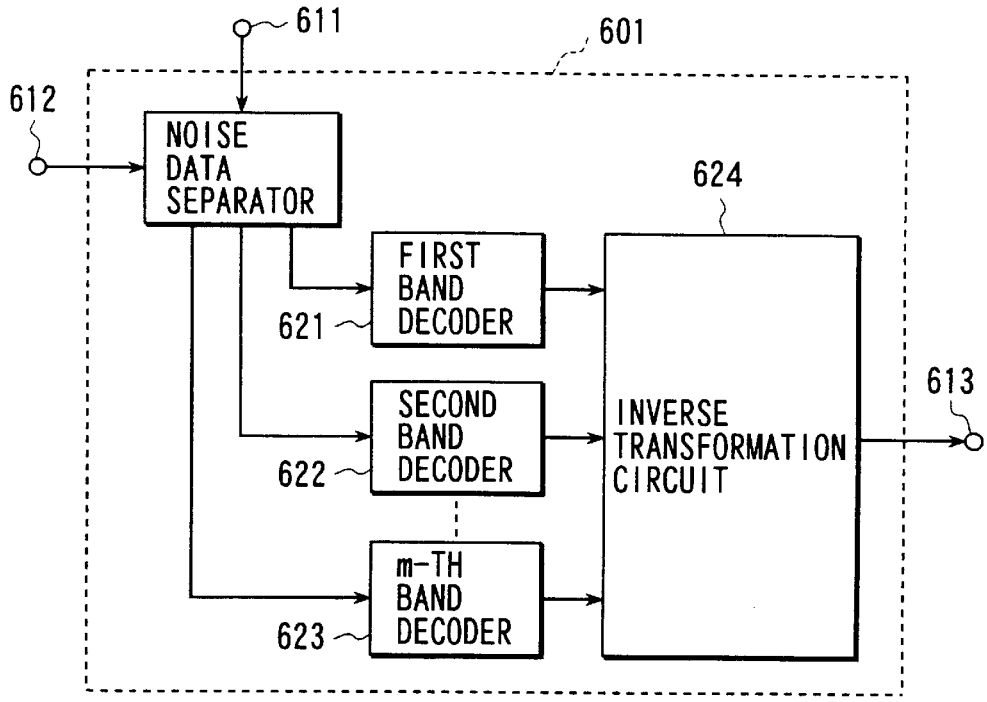
FIG. 22 is a block diagram showing internal configuration of the first noise decoder in FIG. 21.

The first noise decoder 601 will now be described in detail with reference to FIG. 22.

The first noise decoder 601 decodes the mode information representing bit allocation supplied thereto at an input terminal 611 thereof and the encoded data required for the noise decoder supplied thereto an input terminal 612 thereof to generate a reproduction signal mainly constituted by a background noise component which is output to an output terminal 613. Specifically, a noise data separator 620 separates the encoded data into a quantized index of each band; a first band decoder 621, a second band decoder 622, . . . , an m-th decoder 623 decode parameters in respective bands; an inverse transformation circuit 624 performs transformation inverse to the transformation carried out at the encoding end using the decoded parameters to generate a reproduction signal including the component mainly constituted by a background noise. The reproduced component mainly constituted by a background noise is sent to the output terminal 613.

Figure 23:
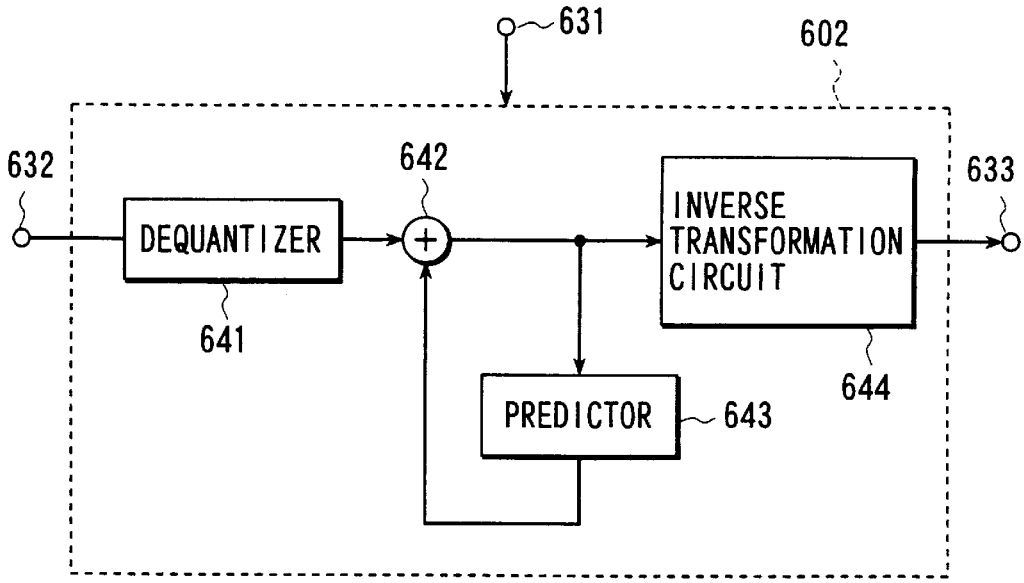
FIG. 23 is a block diagram showing internal configuration of the second noise decoder in FIG. 21.
Figure 24:
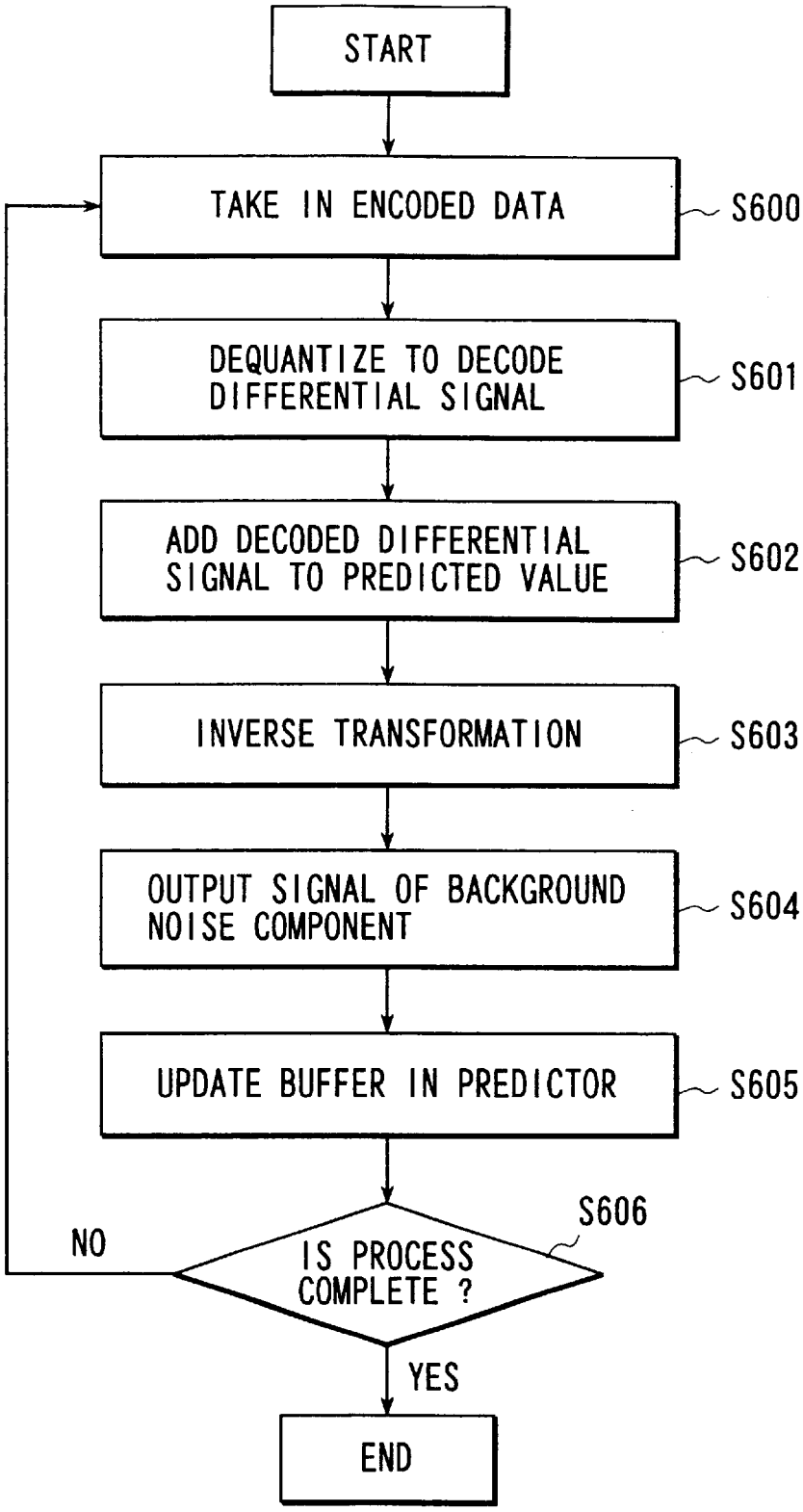
FIG. 24 is a flow chart showing processing steps of a method for decoding speech according to the fourth embodiment.

The second noise decoder 602 will now be described in detail with reference to FIGS. 23 and 24. FIG. 23 is a block diagram showing a configuration of the second noise decoder 602 which is associated with the second noise encoder 502 shown in FIG. 18. FIG. 24 is a flow chart showing processing steps at the second noise decoder 602.

The second noise decoder 602 is activated by a signal supplied to an input terminal 631 thereof by the bit allocation decoder 270 in the mode "2" to fetch the encoded data required for stochastic decoding into a dequantizer 641 (step S600) and decodes the differential signal (step S601).

Next, a predictor 643 estimates the spectral shape of the current frame from the spectral shape of a previous frame; the predicted value and the decoded differential signal are added at an adder 642 (step S602); the result is subjected to inverse transformation at an inverse transformation circuit 644 (step S603) to generate a signal mainly constituted by a background noise and to output it from an output terminal 633 (step S604); and, at the same time, an output signal from an adder 652 is supplied to the predictor 643 to update the contents in a buffer in the predictor 643 (step S605) in preparation to the input of the next frame. The above-described series of operations is repeated until step S606 determines that the process has been completed.

As the spectral shape of a background noise input to the predictor 643, the most recently decoded value must be always supplied and, even when the first noise decoder 601 is selected, a decoded value of the spectral shape of the background noise at that time is to be supplied to the predictor 643.

The inverse transformation circuit used here may be different from or the same as the inverse transformation circuit 644 in the first noise decoder 601. When the same part as the inverse transformation circuit 624 is used as the inverse transformation circuit 644, a single part may be shared instead of separate parts. This equally applies to other embodiments of the invention to be described later.

Prediction is performed for each band, although FIG. 23 shows it in a simplified manner for convenience in illustration. Further, referring to dequantization, scalar dequantization of each band or vector dequantization wherein a plurality of bands are decoded at once is performed depending on the method for quantization in FIG. 18.

Such decoding makes it possible to efficiently decode the spectral shape of a background noise component from a small amount of encoded data.

In the present embodiment, a description will be made on another method for configuring the second noise encoder 502 in FIG. 15 and the second noise decoder 602 in FIG. 21 associated therewith.

The second noise encoder 502 of the present embodiment is characterized in that the spectral shape of a background noise component can be encoded using one parameter (power fluctuation).

Figures 25A, 25B, 25C, 25D:
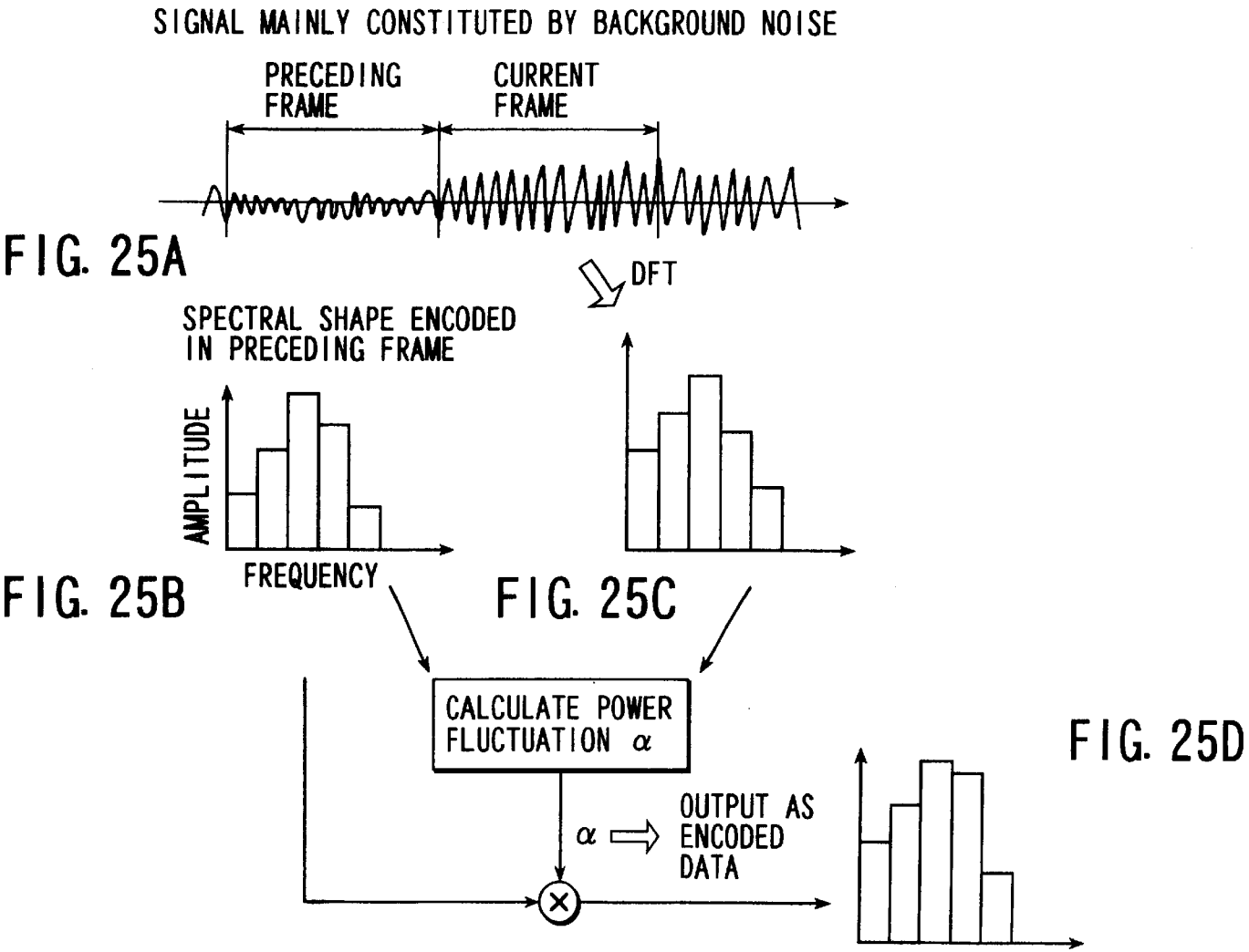
FIGS. 25A to 25D are diagrams for describing the operation of a second noise encoder according to a fifth embodiment of the invention.

First, the basic operation of the second noise encoder 502 of the present embodiment will be described with reference to FIGS. 25A through 25D. FIG. 25A shows the waveform of a signal whose main component is a background noise; FIG. 25B shows a spectral shape obtained as a result of encoding in the preceding frame; and FIG. 25C shows a spectral shape obtained in the current frame. In the present embodiment, only power fluctuation is output as encoded data on an assumption that the spectral shape of the background noise component is constant. Specifically, power fluctuation $\alpha$ is calculated from the spectral shape in FIG. 25B and the spectral shape in FIG. 25C and $\alpha$ is output as encoded data. The second noise decoder 602 to be described later multiplies the spectral shape in FIG. 25B by α to calculated the spectral shape in FIG. 25D and decodes the background noise component based on this shape.

Although the above description has referred to the frequency domain for easier understanding, in practice, the power variation α may be obtained in the time domain.

The power variation α can be quantized with only 4 to 8 bits. Since a background noise component can be thus represented with a small number of bits, more encoding bits can be allocated to the speech encoder 230 described above and, as a result, speech quality can be improved.

Figure 26:
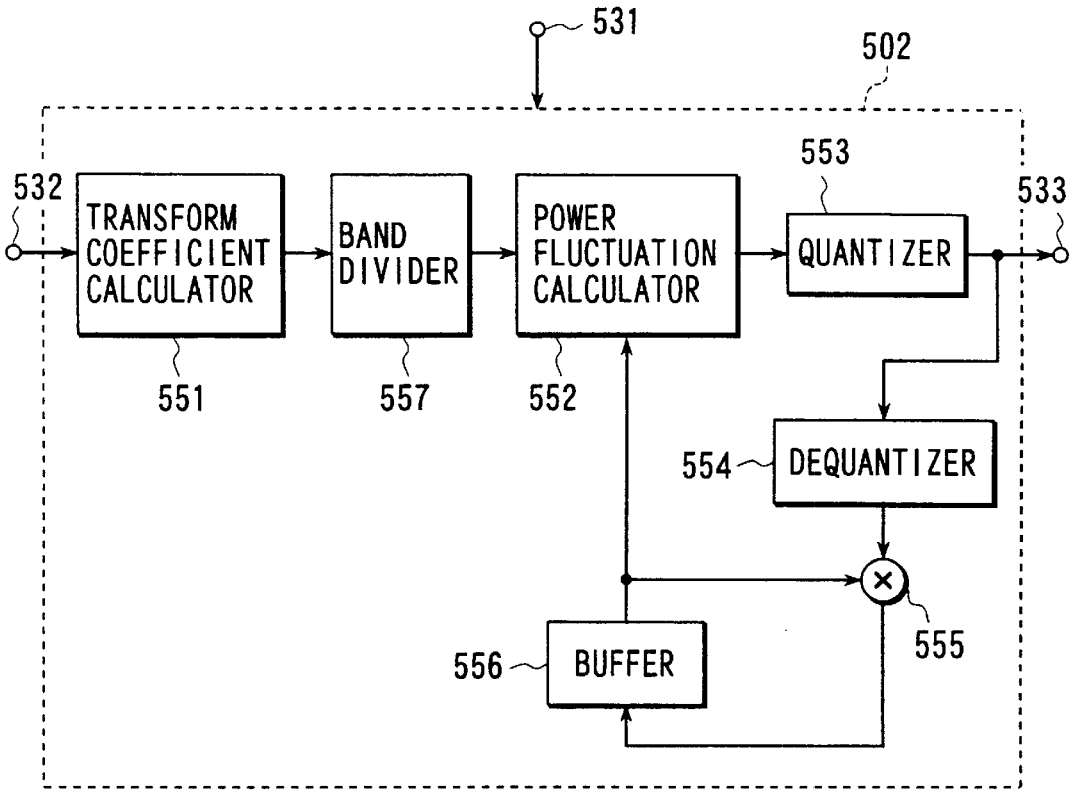
FIG. 26 is a block diagram showing an internal configuration of the second noise encoder according to the fifth embodiment.
Figure 27:
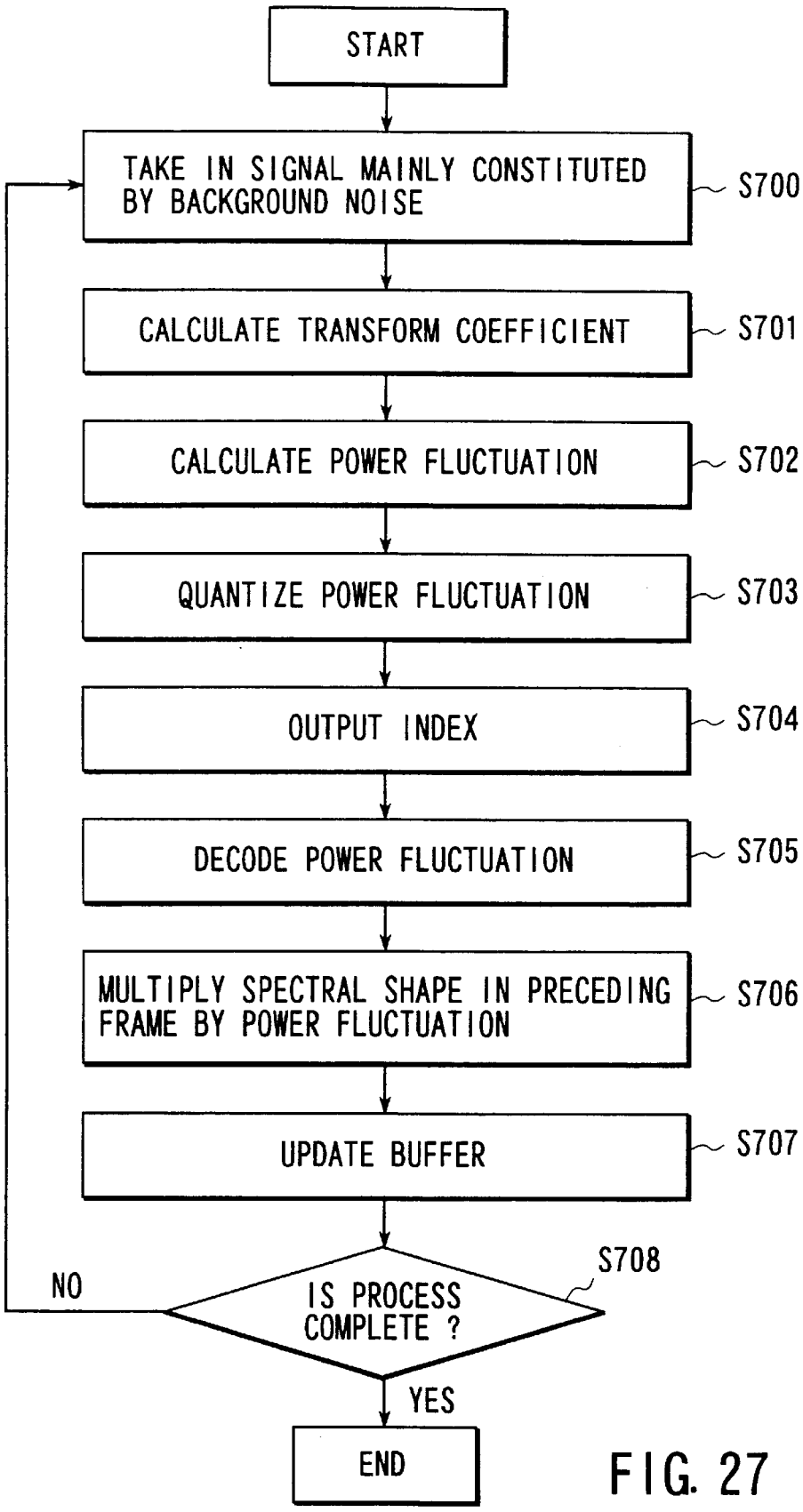
FIG. 27 is a flow chart showing processing steps of the second noise encoder in FIG. 26.

FIG. 26 is a block diagram showing an example of the implementation of the second noise encoder 502 based on this principle, and FIG. 27 is a flow chart showing processing steps of the second noise encoder 502.

The second noise encoder 502 is activated by a signal supplied to an input terminal 531 thereof from the bit allocation selector 220 in the mode "2". It takes in a signal mainly constituted by a background noise through an input terminal 532 thereof (step S700), calculates a transform coefficient at an transform coefficient calculator 551 to obtain the spectral shape (step S701). A spectral shape obtained as a result of encoding in the preceding frame is stored in a buffer 556, and a power fluctuation calculator 552 calculates power fluctuation from this spectral shape and the spectral shape obtained in the current frame (step S702). The power fluctuation α can be expressed by an equation:

$$\alpha = \sqrt{\frac{\sum_{n=0}^{N-1} b^2(n)}{\sum_{n=0}^{N-1} a^2(n)}}$$

where the amplitude of the spectral shape obtained as a result of encoding in the preceding frame (the output of the buffer 556) is represented by {a(n); n=0 to N−1}, and the amplitude of the spectral shape obtained in the current frame (the output of the transform coefficient calculator 551) is represented by {b(n); n=0 to N−1}.

The power fluctuation α is quantized by a quantizer 553 (step S703). An index representing the quantized value is output from an output terminal 533 as encoded data (step S704). At the same time, the power fluctuation α is decoded through dequantization at a dequantizer 554 (step S705). A multiplier 555 multiplies the decoded value by the spectral shape {a(n); n=0 to N−1} obtained as a result of encoding in the preceding frame which is stored in the buffer 556 (step S706). The output a' (n) of the multipliers 555 is expressed by the following equation.

$$a'(n)=\alpha \cdot a(n)$$

The output a' (n) is stored in the buffer 556 to update the same (step S707) in preparation for the input of the spectral shape of the next frame The above-described series of operations is repeated until step S708 determines that the process has been completed.

As the spectral shape of a background noise supplied to the buffer 556, the most recently decoded value must be always supplied and, even when the first n noise encoder 501 is selected, a decoded value of the spectral shape of the background noise at that time is to be supplied to the buffer 556.

Although FIG. 26 is shown in a simplified manner for convenience in illustration, each of the output of a band divider 575 and the output of the buffer 556 is a vector that represents the spectrum amplitude of each frequency band. Further, although a band divider 575 is used in FIG. 26 for convenience in description, power fluctuation can be obtained from the output of the transform coefficient calculator 551 without using the same.

The second noise decoder 602 of the present embodiment will now be described.

Figure 28:
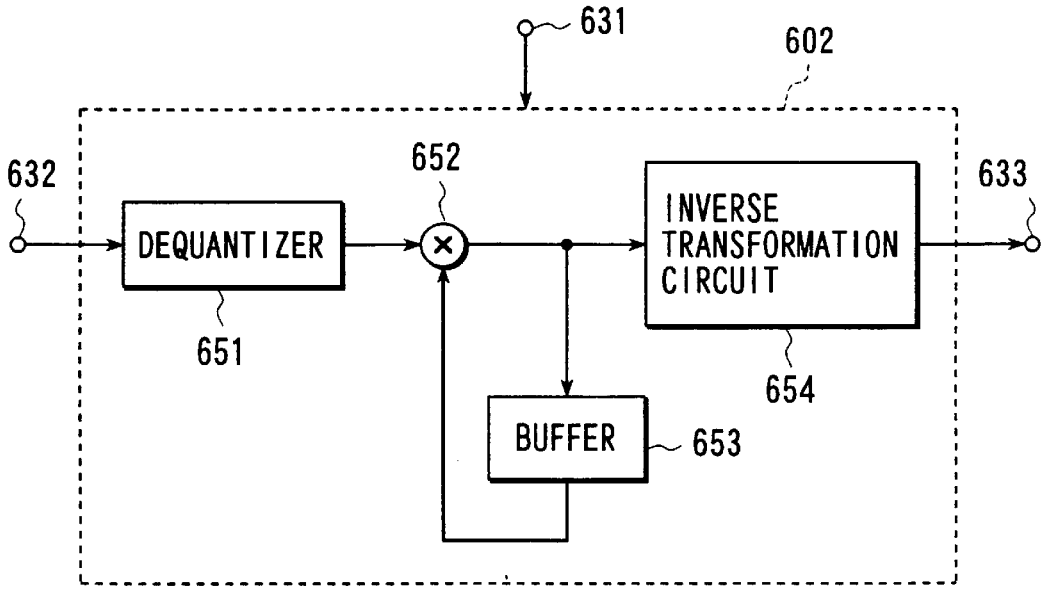
FIG. 28 is a block diagram showing an internal configuration of the second noise decoder according to the fifth embodiment.
Figure 29:
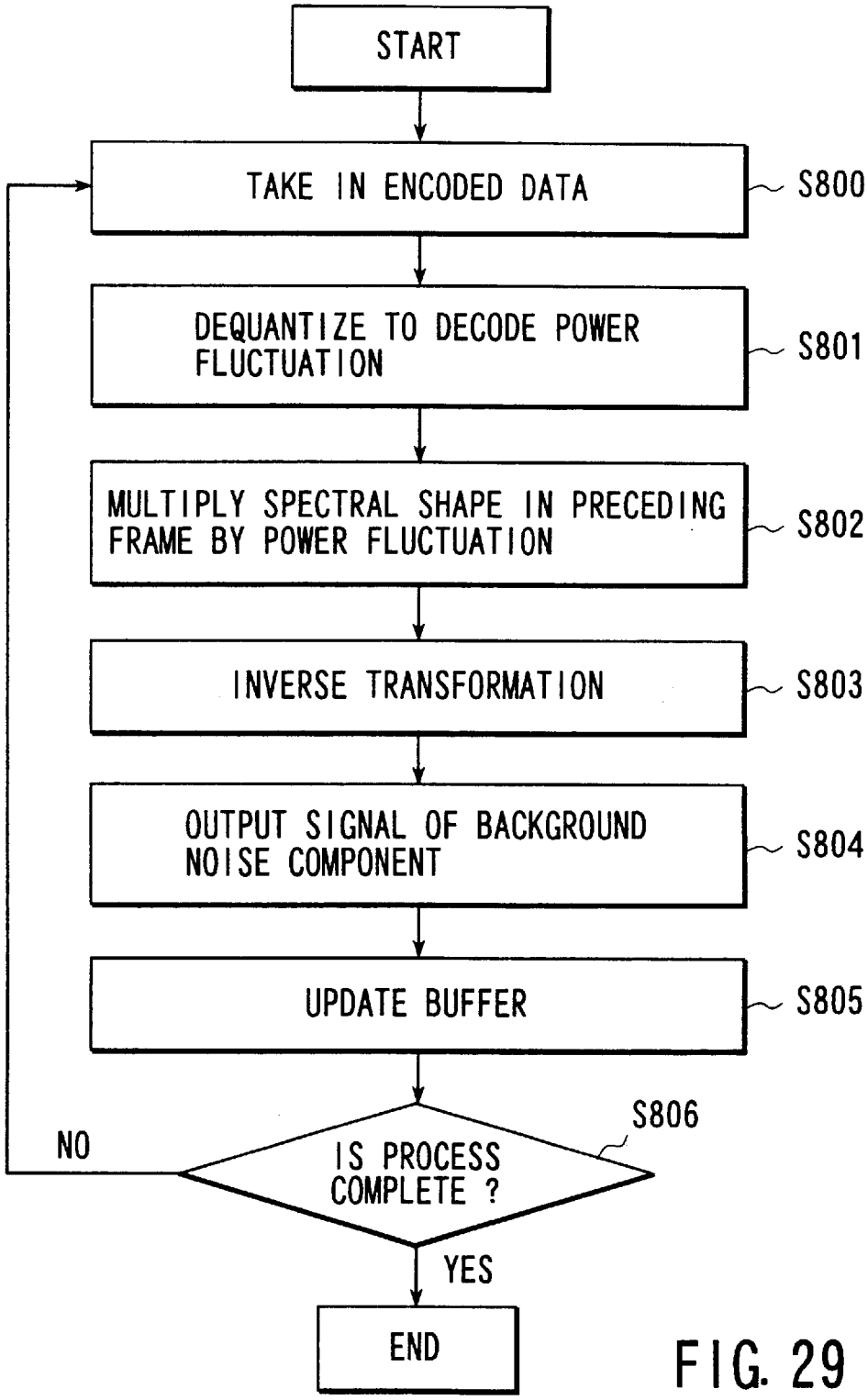
FIG. 29 is a flow chart showing processing steps of a method for decoding speech according to the fifth embodiment.

The second noise decoder 602 in th e pre sent embodiment is characterized in that the spectral shape of a background noise component can be decoded using one parameter (power fluctuation α). FIG. 28 is a block diagram showing a configuration of the second noise decoder 602 which is associated with the second noise encoder 502 shown in FIG. 26. FIG. 29 is a flow chart showing processing steps of the second noise decoder 602.

The second noise decoder 602 is activated by a signal supplied to an input terminal 631 thereof from the bit allocation decoder 270 in the mode "2". Encoded data representing power fluctuation is taken into a dequantizer 651 through an input terminal 632 (step S800) to perform dequantization thereon to decode the power fluctuation (step S801). The spectral shape of the preceding frame is stored in a buffer 653, and this spectral shape is multiplied by the above described decoded power fluctuation at a multiplier 652 to recover the spectral shape of the current frame (step S802). The recovered spectral shape is supplied to an inverse transformation circuit 654 to be inverse-transformed (step S803) to generate a signal mainly constituted by a background noise which is output from an output terminal 633 (Step 804). At the same time, the output signal of the multiplier 652 is supplied to the buffer 653 to update the contents of the same (step S805) in preparation for the input of the next frame. The above-described series of operations is repeated until step S806 determines that the process has been completed.

As the spectral shape of a background noise supplied to the buffer 653, the most recently decoded value must be always supplied and, even when the first noise decoder 601 is selected, a decoded value of the spectral shape of the background noise at that time is to be supplied to the buffer 653.

The present embodiment makes it possible to efficiently represent the spectral shape of a background noise component with very little encoded data on the order of 8 bits at the encoding end and to efficiently recover the spectral shape of the background noise component with very little encoded data at the decoding end.

In the present embodiment, a description will be made on another method for configuring the second noise encoder 502 in FIG. 15 and the second noise decoder 602 in FIG. 21 which is associated with the same.

Th second noise encoder 502 in the present embodiment is characterized in that a frequency band is determined according to predefined rules and a spectral shape in the frequency band is encoded. The basic operation of the same will now be described with reference to FIGS. 30A through 30D.

Figures 30A, 30B, 30C, 30D:
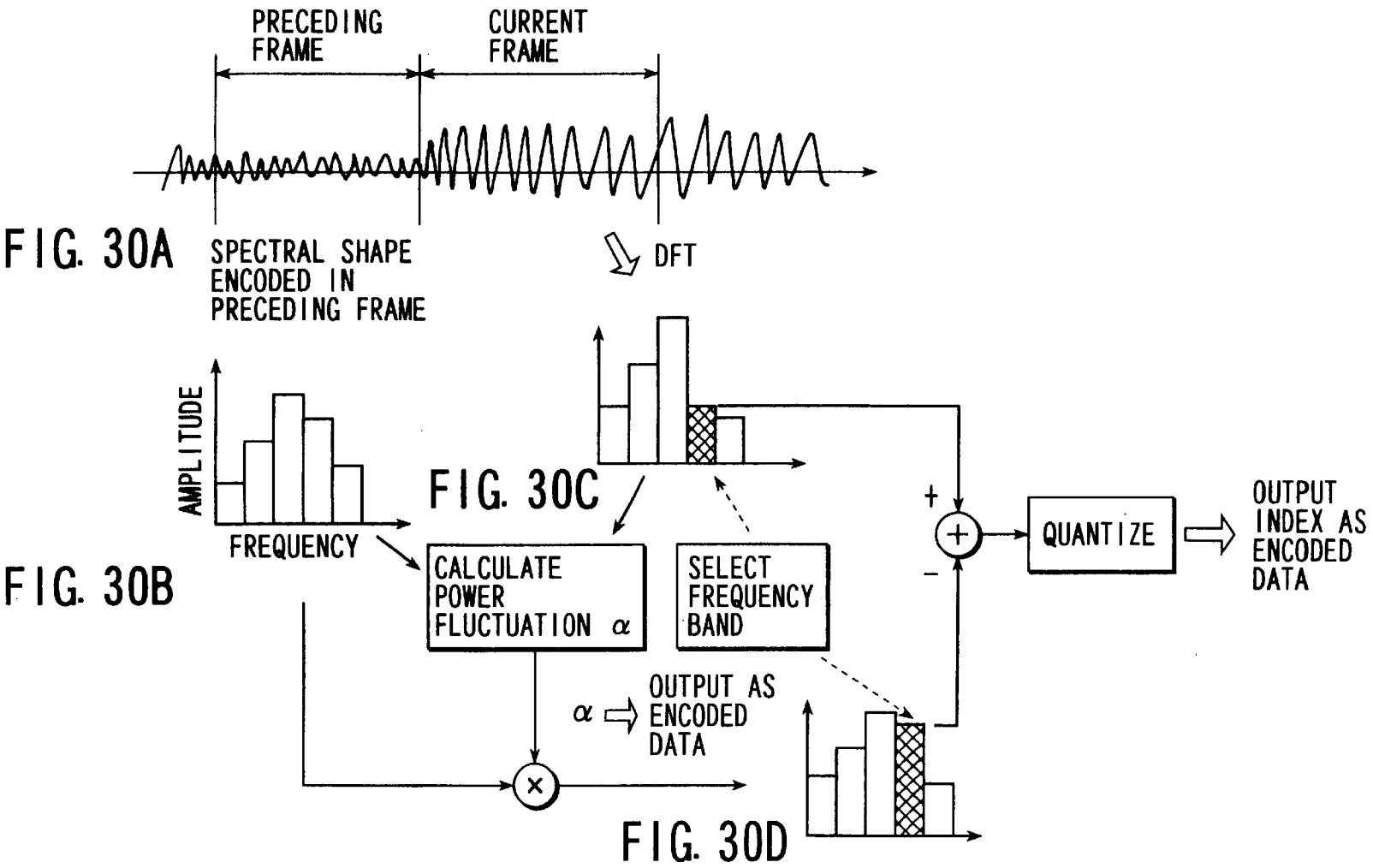
FIGS. 30A to 30D are diagrams for describing the operation of a second noise encoder according to a sixth embodiment of the invention.

FIG. 30A shows the waveform of a signal whose main component is a background noise; FIG. 30B shows a spectral shape obtained as a result of encoding in the preceding frame; and FIG. 30C shows a spectral shape obtained in the current frame. The present embodiment is characterized in that, on an assumption that the spectral shape of the background noise component is substantially constant, power fluctuation is output as encoded data and, at the same time, quantization is performed such that the amplitude of the same in a frequency band selected according to certain rules coincides with the amplitude of the current frame.

The present embodiment has the following advantage. Specifically, although the spectral shape of a back-ground noise component can be regarded constant for a relatively long period of time, the same shape is not maintained for an infinite time and a change in the spectral shape is observed between sections separated by a certain long period of time. It is an object of the present embodiment to efficiently encode the spectral shape of a background noise component which undergoes such a gradual change. Specifically, power fluctuation $\alpha$ is calculated from the spectral shape (FIG. 30B) and the spectral shape (FIG. 30C): the power fluctuation $\alpha$ is quantized; and an index of the same is output as encoded data. This is like the fifth embodiment described above. Next, the spectral shape (FIG. 30B) is multiplied by the quantized power fluctuation $\alpha$, and a differential signal between the result of the multiplication and the spectral shape of the current frame (FIG. 30D) in a frequency band determined according to predefined rules, the differential signal being quantized.

For example, the rules for determining a frequency band mentioned here may be a method which visits all frequency bands one after another on a cyclic basis within a predetermined period of time to determine such a frequency band. An example of this is shown in FIGS. 31A and 31B. Here, the entire band is divided into five frequency bands as shown in FIG. 31A. In each frame k, each frequency band is selected one after another as shown in FIG. 31B. Although this takes a somewhat long time (five frames in this example), encoding is required only for one frequency band and, therefore, it is possible to encode a change in the spectral shape with a small number of bits. Therefore, this method is a process which is available for a signal such as a background noise having a low rate of change. Further, since a frequency band to be encoded is determined according to predefined rules, there is no need for additional information that indicates which frequency band has been encoded.

Figure 32:
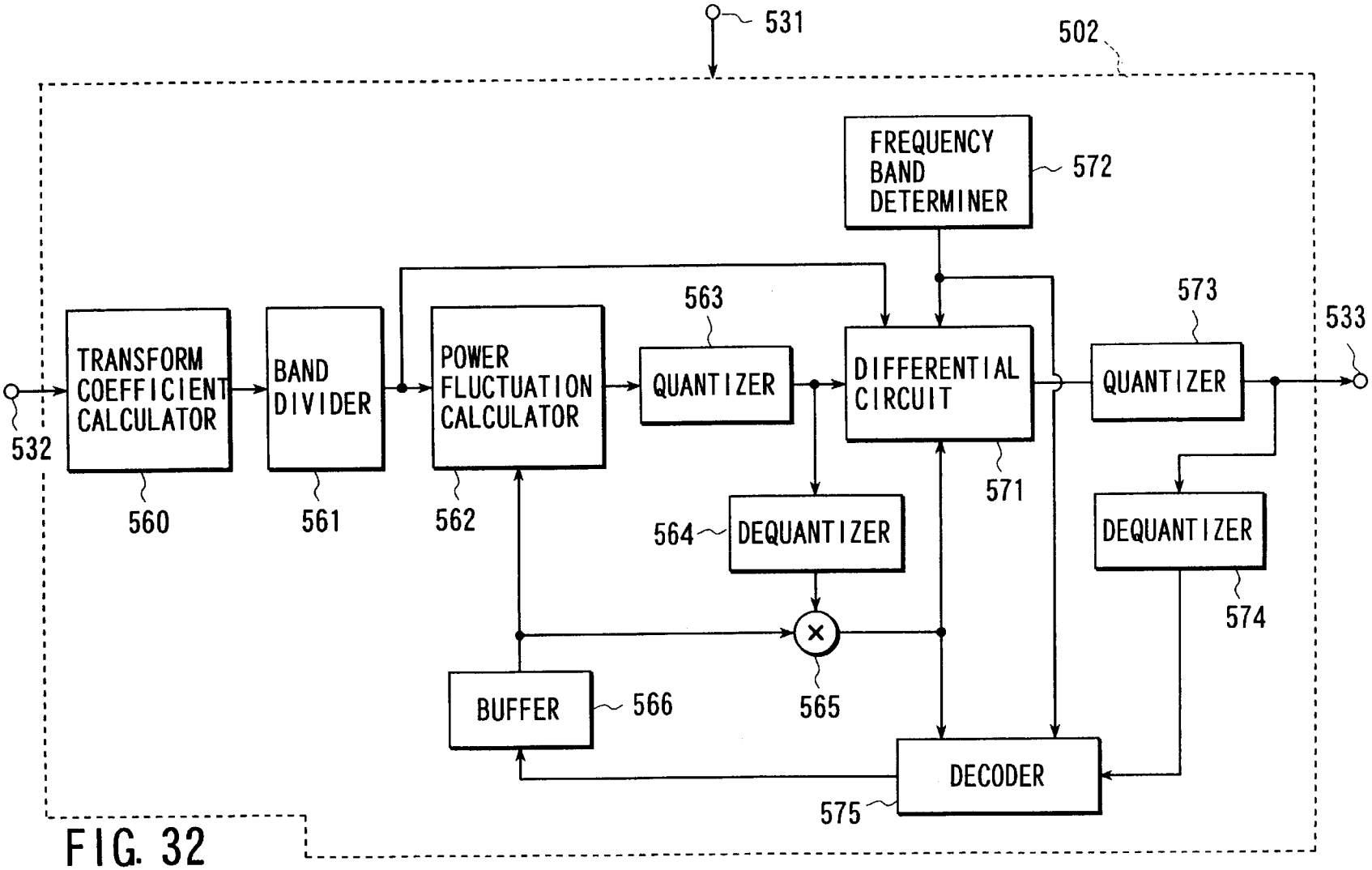
FIG. 32 is a block diagram showing an internal configuration of the second noise encoder according to the sixth embodiment.
Figure 33:
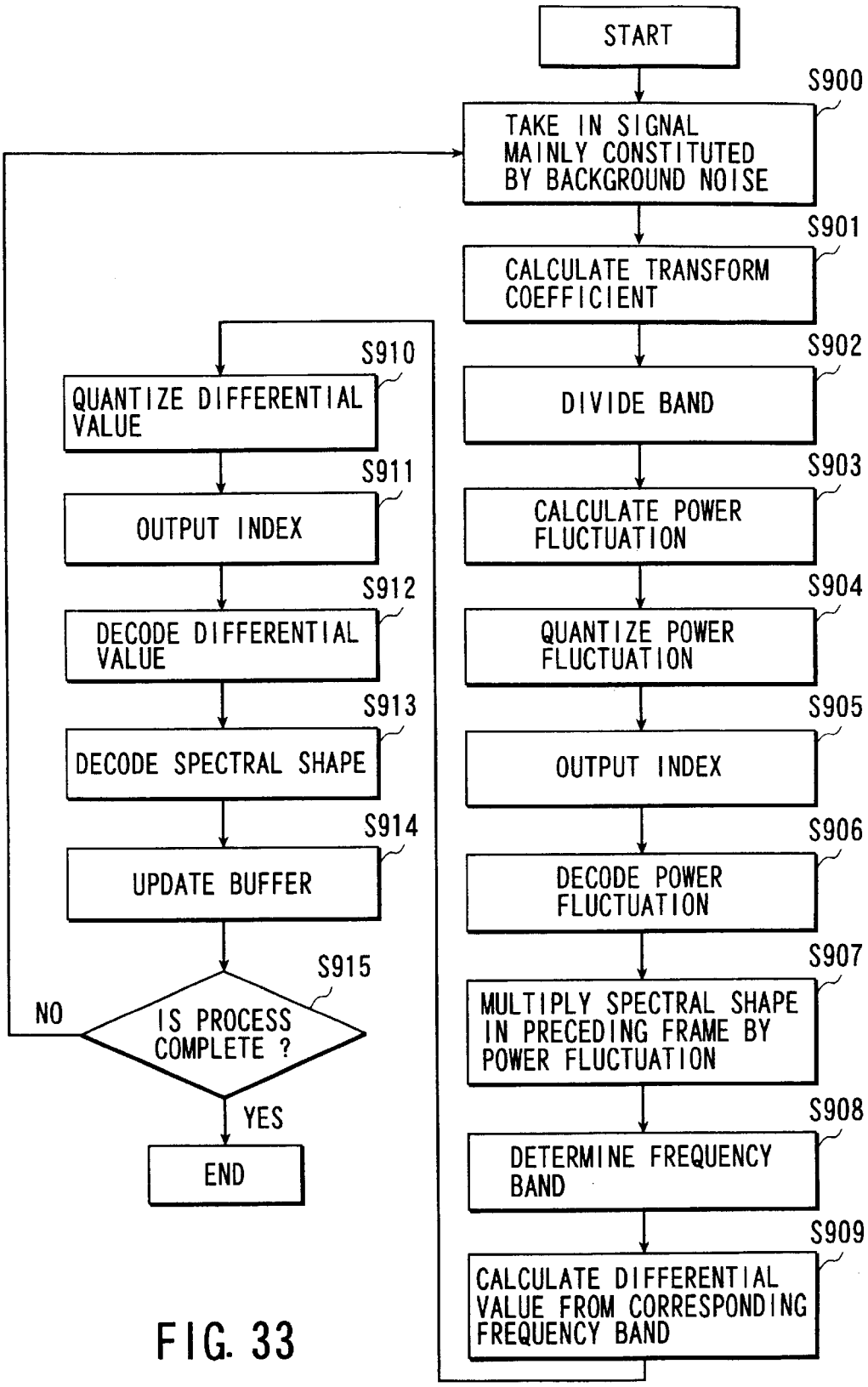
FIG. 33 is a flow chart showing processing steps of the second noise encoder in FIG. 32.

FIG. 32 is a block diagram showing an example of the implementation of the second noise encoder 502 based on this principle, and FIG. 33 is a flow chart processing steps of the second noise encoder 502.

The second noise encoder 502 is activated by a signal supplied to the input terminal 531 thereof by the bit allocation selector 220 in the mode "2". It takes in a signal mainly constituted by a background noise through the input terminal 532 (step S900), calculates a transform coefficient at a transform coefficient calculator 560 (step S901) and performs band division in a band divider 561 to obtain a spectral shape (step S902). A spectral shape obtained as result of encoding in the preceding frame is stored in a buffer 566, and a power fluctuation calculator 562 obtains power fluctuation from that spectral shape and a spectral shape obtained in the current frame (step S903). The power fluctuation $\alpha$ can be expressed by Equation 1 shown above where the amplitude of the spectral shape obtained as a result of encoding in the preceding frame is represented by $\{a(n); n=0 \text{ to } N-1\}$, and the amplitude of the spectral shape obtained in the current frame is represented by $\{b(n); n=0 \text{ to } N-1\}$.

Next, the power fluctuation a is quantized by a quantizer 563 (step S904). An index representing the quantized value is output as encoded data (step S905). At the same time, the power fluctuation a is decoded through dequantization at a dequantizer 654 (step S906). A multiplier 565 multiplies the decoded value by the spectral shape $\{a(n); n=0 \text{ to } N-1\}$ obtained as a result o f encoding in the preceding frame which is stored in the buffer 566 (step S907). The output a' (n) of the multiplier 565 can be expressed by $a'(n)=\alpha \cdot a(n)$ as described above.

A process unique to the present embodiment will now be described.

First, a frequency band determiner 572 selects and determines one frequency band for each frame from among a plurality of frequency bands as a result of division as described with reference to FIGS. 31A and 31B on a cyclic basis (step S908). In one example of the implementation of the frequency band determiner 572, the output of the frequency band determiner 572 can be expressed by (fc mod N) where N represents the number of the divided bands and fc represents a frame counter. Here, mod represents the modulo operation. For the purpose of description, it is assumed that the frequency determiner 572 has selected and determined a frequency band k.

A differential calculator 571 calculates a differential value between b(k) and a' (k) where the spectral shape of the current frame after band division is represented by $\{b(n); n=0 \text{ to } N-1\}$ and a spectral shape after power correction at the multiplier 565 is represented by $\{a'(n); n=0 \text{ to } N-1\}$ (step S909). The differential value obtained at the differential calculator 571 is quantized by a quantizer 573 (step S910), and an index thereof is output from the output terminal 533 as encoded data (step S911). Therefore, according to the present embodiment, the index output by the quantizer 563 and the index output by the quantizer 573 are output as encoded data.

The index from the quantizer 573 is supplied also to a dequantizer 574 which decodes the differential value (step S912). A decoder 575 adds the decoded differential value to the frequency band k of the spectral shape $[a'(n); n=0 \text{ to } N-1\}$ after power correction to decide a spectral shape $\{a''(n); n=0 \text{ to } N-1\}$ (step S913) which is stored in the buffer 566 in preparation for the input of the next frame (step S914). The above-described series of operations is repeated until step S915 determines that the process has been completed.

Although FIG. 32 is simplified for convenience in illustration, the outputs of the band divider 561, buffer 566, multiplier 565 and decoder 575 are a vector representing the spectrum amplitude of each frequency band.

As the spectral shape of a background noise supplied to the buffer 566, the most recently decoded value must be always supplied and,. even when the first noise encoder 501 is selected, a decoded value of the spectral shape of the background noise at that time is to be supplied to the buffer 566.

The second noise decoder 602 according to the present embodiment is characterized in that a frequency band is determined according to predefined rules and a spectral shape in the frequency band is decoded.

Figure 35:
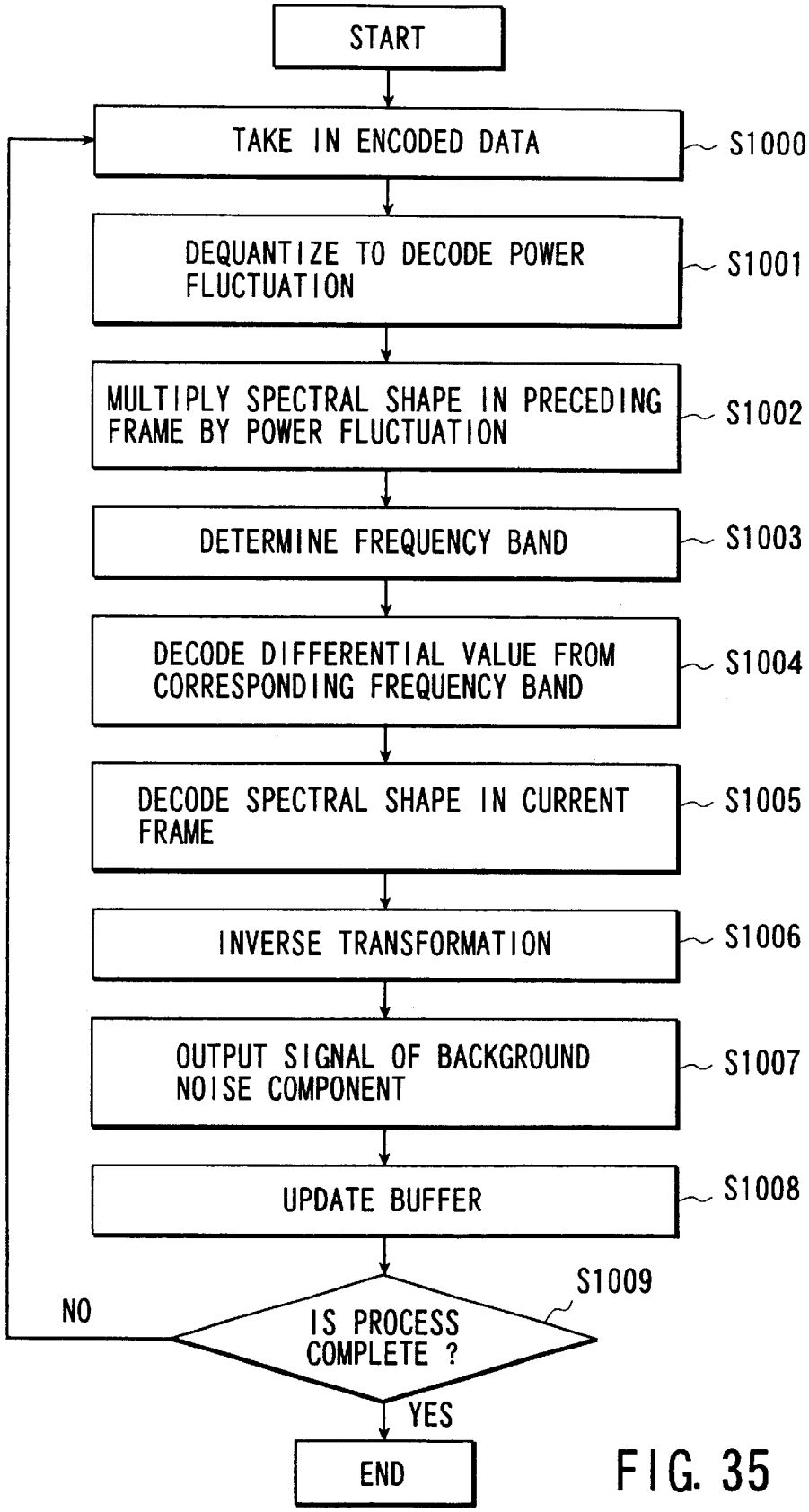
FIG. 35 is a flow chart showing processing steps of a method for decoding speech according to the sixth embodiment.

FIG. 34 is a block diagram showing an example of the implementation of the second noise decoder 602 according to the present embodiment, and FIG. 35 is a flow chart processing steps of the second noise decoder 602.

The second noise decoder 602 is activated by a signal supplied to the input terminal 631 thereof by the bit allocation decoder 270 in the mode "2". Encoded data representing power fluctuation is fetched into a dequantizer 661 through the input terminal 632 (step S1000) to perform dequantization thereon to decode the power fluctuation (step S1001). A spectral shape obtained in the preceding frame is stored in a buffer 663, and this spectral shape is multiplied by the power fluctuation decoded as described above at a multiplier 1902 (step S1002).

Meanwhile, an input terminal 634 takes in encoded data representing a differential signal in one frequency band, and a dequantizer 665 decodes the differential value in one frequency band (step S1004). At this point, a frequency band determination circuit 667 selects and determines the same frequency band in synchronism with the frequency band determination circuit 572 in the second noise encoder 502 described with reference to FIG. 32 (step S1003).

Next, a decoder 666 performs the same process as that in the decoder 575 in FIG. 32 to decode the spectral shape of the background noise component of the current frame based on the output signal of the multiplier 662, the decoded differential signal in one frequency band from the dequantizer 665 and the information on the frequency band determined at the frequency band determiner 667 (step S1005). The decoded spectral shape is supplied to an inverse transformation circuit 664 where inverse transformation is performed (step S1006) to generate a signal mainly constituted by a background noise which is output from an output terminal 603 (step S1007). At the same time, the recovered spectral shape of the background noise component is supplied to the buffer 663 to update the contents thereof (step S1008) in preparation for the input of the next frame. The above-described series of operations is repeated until step S1009 determines that the process has been completed.

As the spectral shape of a background noise supplied to the buffer 663, the most recently decoded value must be always supplied and, even when the first noise decoder 601 is selected, a decoded value of the spectral shape of the background noise at that time is to be supplied to the buffer 663.

According to the present embodiment, encoded data of the spectral shape of a background noise component can be represented by power fluctuation and a differential signal in one band to represent the spectral shape of the background noise very efficiently at the encoding end, and the spectral shape of the background noise component can be recovered from the power fluctuation and the differential signal at the decoding end.

Although the sixth embodiment has referred to a method wherein one frequency band is encoded and decoded, a configuration can be provided wherein a plurality of frequency bands are quantized according to predefined rules and a plurality of frequency bands are decided according to predefined rules.

Figures 36A, 36B:
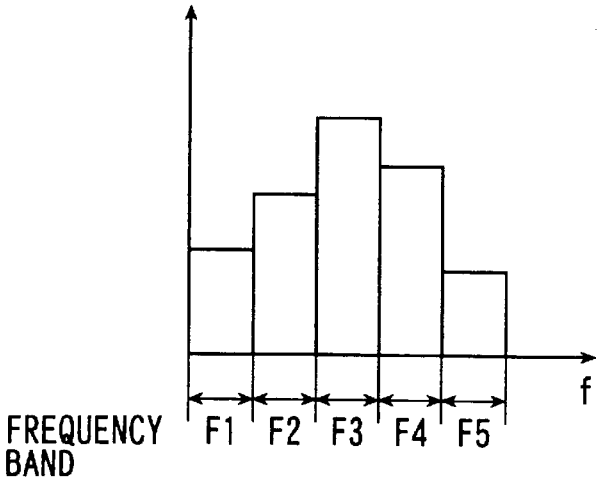
FIGS. 36A and 36B are diagrams for describing rules for determining a frequency band for a second noise encoder according to a seventh embodiment of the invention.

A specific example of such a configuration will be described with reference to FIGS. 36A and 36B. As shown in FIG. 36A, in this example, an entire band is divided into five frequency bands and two frequency bands are selected and quantized for each frame as shown in FIG. 32B.

As previously described, a frequency band No. 1 selected for quantization can be represented by (fc mod N) and is cyclically selected where fc represents a frame counter and N represents the number of divided bands. Here, mod represents the modulo operation. Similarly, a frequency band No. 2 selected for quantization is represented by ((fc+2) mod N) and is cyclically selected. This procedure can be extended to cases where the number of frequency bands to be quantized is three or more. However, what is important for the present embodiment is that a frequency band to be quantized is determined according to certain rules, and the rules for determining such a frequency band are not limited to those described above.

Further, a method is possible wherein a frequency band having a large differential value is quantized and encoded and then decoded instead of selecting a frequency band to be quantized according to certain rules. In this case, however, there is a need for additional information indicating which frequency band has been quantized and additional information indicating which frequency band is to be decoded.

In the present embodiment, a description will be made on typical configurations of the noise encoder 240 in FIG. 15 and the noise decoder 290 in FIG. 29 with reference to FIGS. 37 and 39, respectively. FIGS. 38 and 40 show flow charts associated with FIGS. 37 and 39, respectively. A description will now be made on the relationship between the first noise encoder 501 and second noise encoder 502 in the noise encoder 240 and between the first noise decoder 601 and second noise decoder 602 in the noise decoder 290.

The noise encoder 240 will be described with reference to FIGS. 37 and 38. First, a component mainly constituted by a noise component is supplied from an input terminal 702 to a transform coefficient calculator 704 (step S1101). The transform coefficient calculator 704 performs a process such as discrete Fourier transform on the component mainly constituted by a noise component and outputs a transform coefficient (step S1102). Mode information is supplied from an input terminal 703. In mode "1", a switch 705, a switch 710 and a switch 718 are switched to activate the first noise encoder and, in mode "2", the switches 705, 710 and 718 are switched to activate the second noise encoder (step S1103).

When the first noise encoder 501 is activated, a band divider 707 performs band division (step S1104); a noise encoding bit allocation circuit 706 allocates the number of bits for each frequency band (step S1105); and a band encoder 708 encodes each frequency band (step S1106). Although the illustration is simplified for convenience, the band encoder 708 is represented as a single block which is functionally equivalent to the first band encoder 523, second band encoder 524 and m-th band encoder 525 in FIG. 16 in combination.

A quantization index obtained at the band encoder 708 is output from an output terminal 720 through an encoded data output section 709 (step S 1107). A band decoder 711 decodes a spectral shape using this encoded data (step S1108), and this value is supplied to a buffer 719 to update the contents thereof (step S1114). The band decoder 711 is represented as a single block which is functionally equivalent to the first band decoder 621, second band decoder 622 and m-th band decoder 623 in combination.

When the second noise encoder 502 is activated, the output of the transform coefficient calculator 704 is supplied to a power fluctuation calculator 712 to obtain power fluctuation (step S1109). This power fluctuation is quantized by a quantizer 713 (step S1110), and a resultant index is output from an output terminal 720 (step S1111). At the same time, the index is supplied to a dequantizer 714 to decode the power fluctuation (step S1112). The decoded power fluctuation and the spectral shape of the preceding frame obtained from the buffer 719 are multiplied together at a multiplier 715 (step S1113), and the result is supplied to a buffer 719 to update the contents thereof in preparation to the input of the next frame (step S1114). The above-described series of operations is repeated until step S1115 determines that the process is complete.

The noise decoder 290 will now be described with reference to FIGS. 39 and 40. Encoded data is supplied from an input terminal 802 (step S1201). At the same time, mode information is supplied from an input terminal 803. In mode "1", a switch 804, a switch 807 and a switch 812 are switched to activate the first noise decoder and, in mode "2", the switches 804, 807 and 812 are switched to activate the second noise decoder (step S1202).

When the first noise decoder is activated, a noise data separator 805 separates the encoded data into a quantization index for each band (step S1203) and, based on this information, a band decoder 806 decodes the amplitude of each frequency band (step S1204). The band decoder 806 is represented as a single block which is functionally equivalent to the first band decoder 621, second band decoder 622 and m-th band decoder 623 in FIG. 22 in combination.

An inverse transformation circuit 808 performs transformation which is the inverse of the transformation performed at the encoding end using a decoding parameter to reproduce a component mainly constituted by a background noise (step S1207) and outputs it from an output terminal 813 (step S1208). In parallel with this, information on the amplitude of each of the decoded frequency bands is supplied to a buffer 811 through the switch 812 to update the contents thereof (step S1209).

When the second noise decoder is activated, the encoded data is supplied to a dequantizer 809 to decode power fluctuation (step S1205), and this power fluctuation and the spectral shape of the preceding frame supplied by the buffer 811 are multiplied together at a multiplier 810 (step S1206). A resultant decoding parameter is supplied to the inverse transformation circuit 808 through the switch 807 and is subjected to transformation which is the inverse of the transformation performed at the encoding end at the inverse transformation circuit 808 to reproduce the component mainly constituted by a background noise (step S1207) which is output from the output terminal 813 (step S1208). In parallel with this, the decoding parameter is supplied through the switch 812 to the buffer 811 to update the contents thereof (step S1209). The above described series of operations is repeated until step S1210 determines that the process has been completed.

In the present embodiment, alternative configurations of the noise encoder 240 in FIG. 15 and the noise decoder 290 in FIG. 29 will be described with reference to FIGS. 41 and 43, respectively. FIGS. 42 and 44 show flow charts associated with FIGS. 41 and 43, respectively. The present embodiment is different from the eighth embodiment in the configurations of the second noise encoder and second noise decoder.

Specifically, in the eighth embodiment, the magnitude of power relative to the spectral shape of the preceding frame was referred to as "power fluctuation" and was the object of quantization. According to the present, however, the object of quantization is the absolute power of a transform coefficient calculated in the current frame, which simplifies the configuration of the noise encoder.

Figure 37:
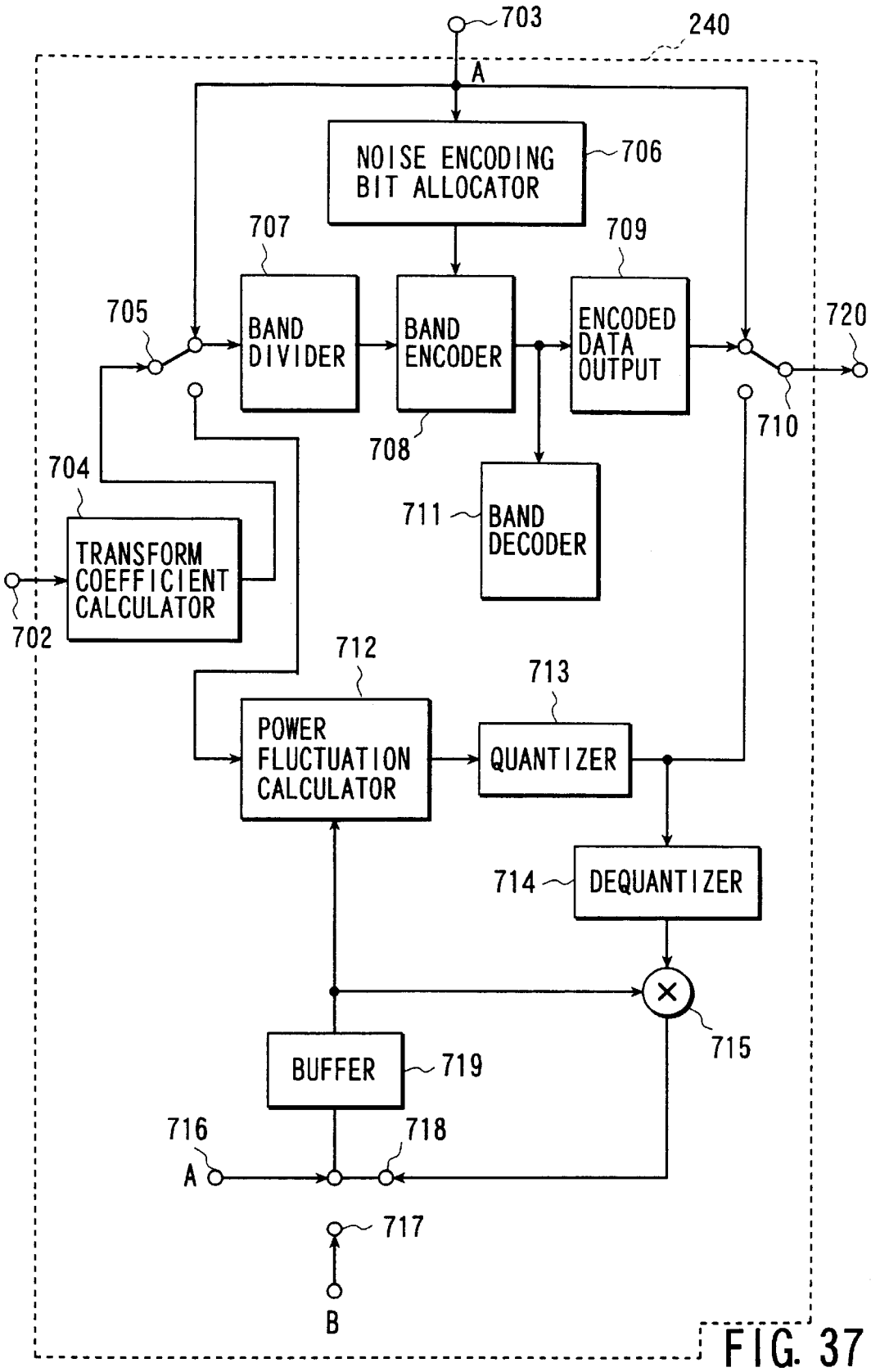
FIG. 37 is a block diagram showing a configuration of a noise encoder according to an eighth embodiment of the invention.
Figure 38:
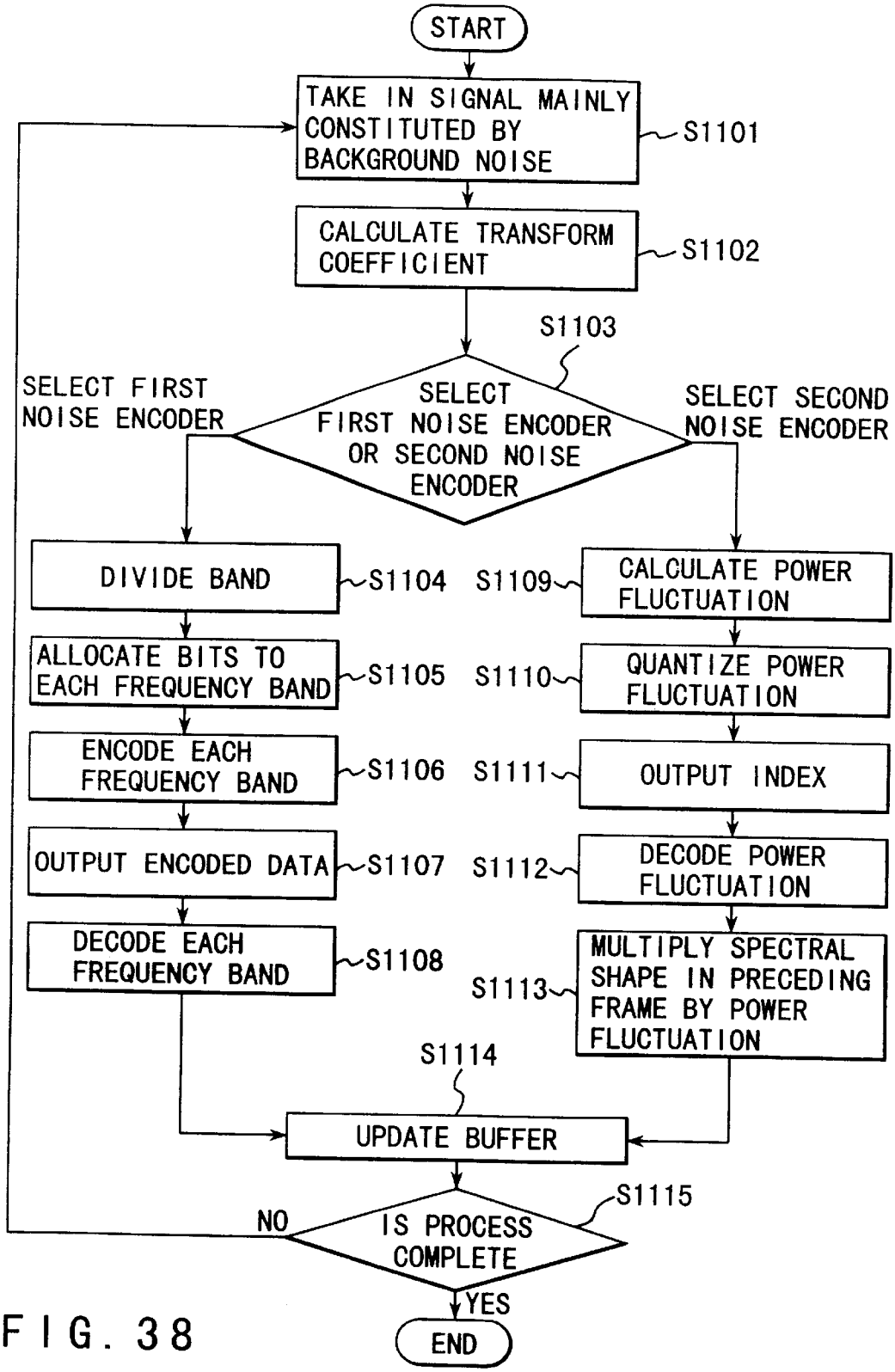
FIG. 38 is a flow chart showing processing steps of the noise encoder in FIG. 37.
Figure 41:
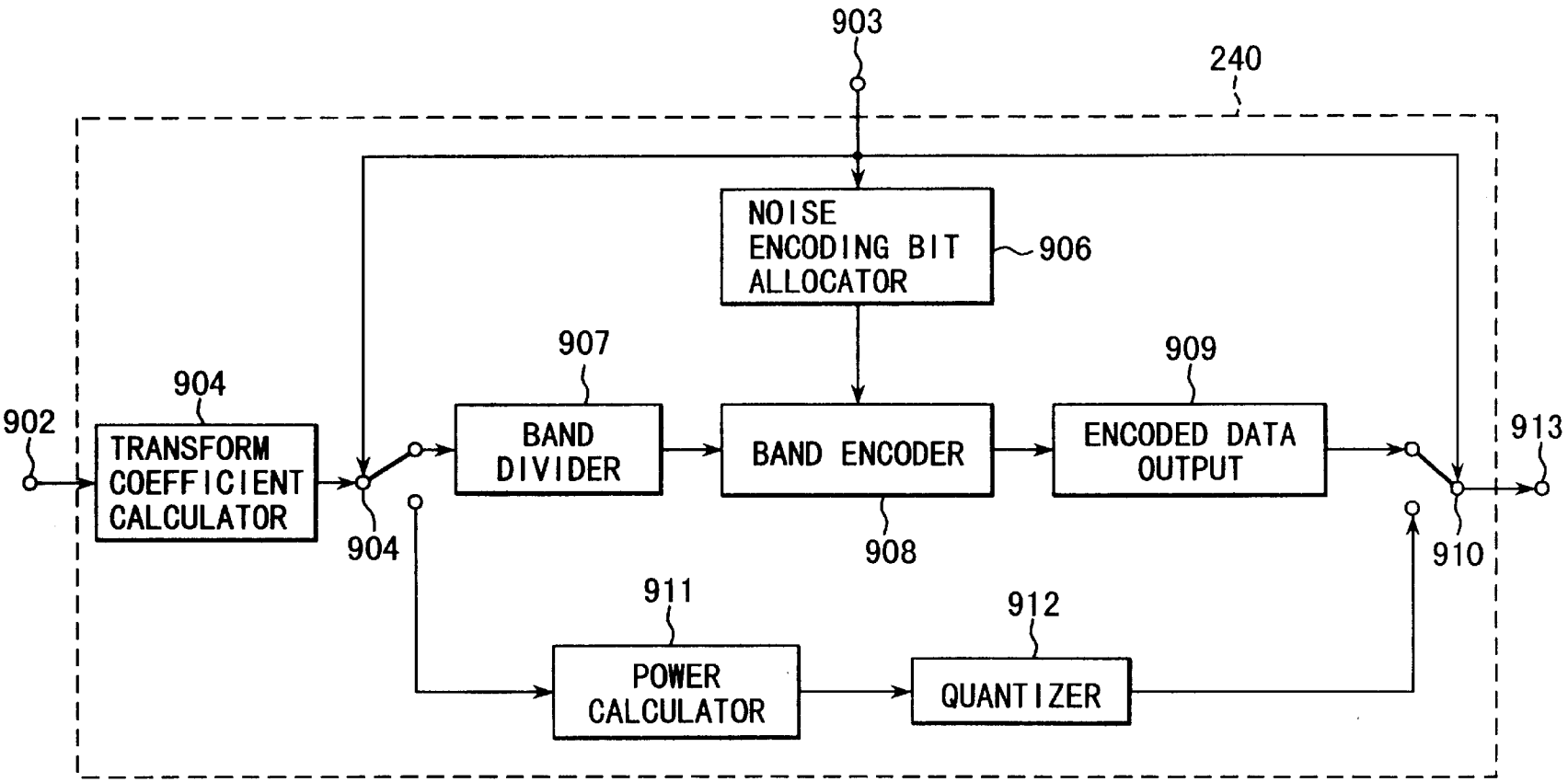
FIG. 41 is a block diagram showing a configuration of a noise encoder according to a ninth embodiment of the invention.
Figure 42:
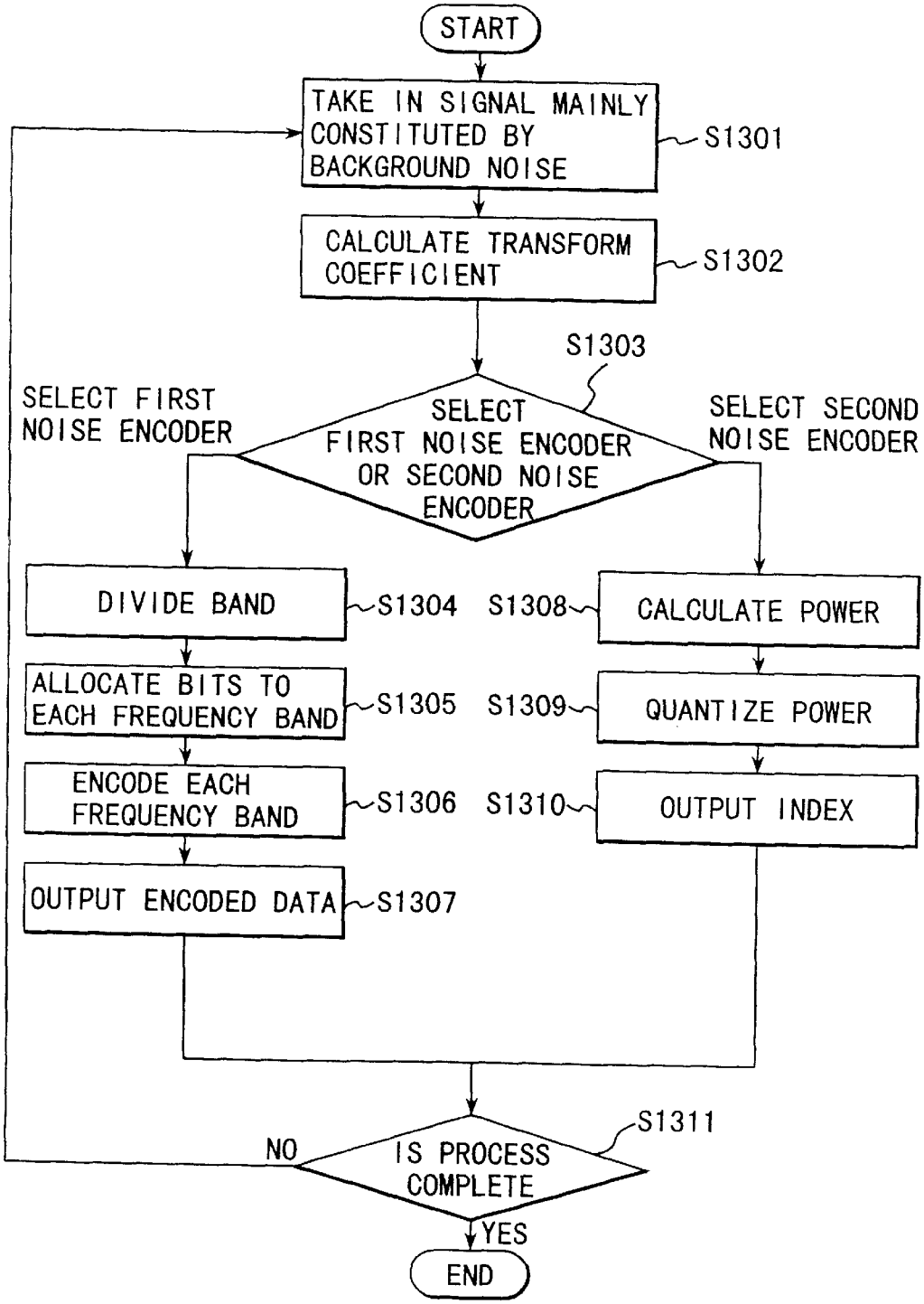
FIG. 42 is a flow chart showing processing steps of the noise encoder in FIG. 41.

Elements in FIG. 41 referred to as the same names as those in FIG. 37 have the same functions and will not be described here. A transform coefficient output by a transform coefficient calculator 904 is supplied to a power calculator 911, and the power of a frame is obtained using the transform coefficient (step S1308). Power can be calculated in the time domain and can alternatively be obtained from an input signal mainly constituted by a background noise supplied from an input terminal 902. This power information is quantized by a quantizer 912 (step S1309), and a resultant index is output from an output terminal 913 through a switch 910 (step S1310).

Figure 39:
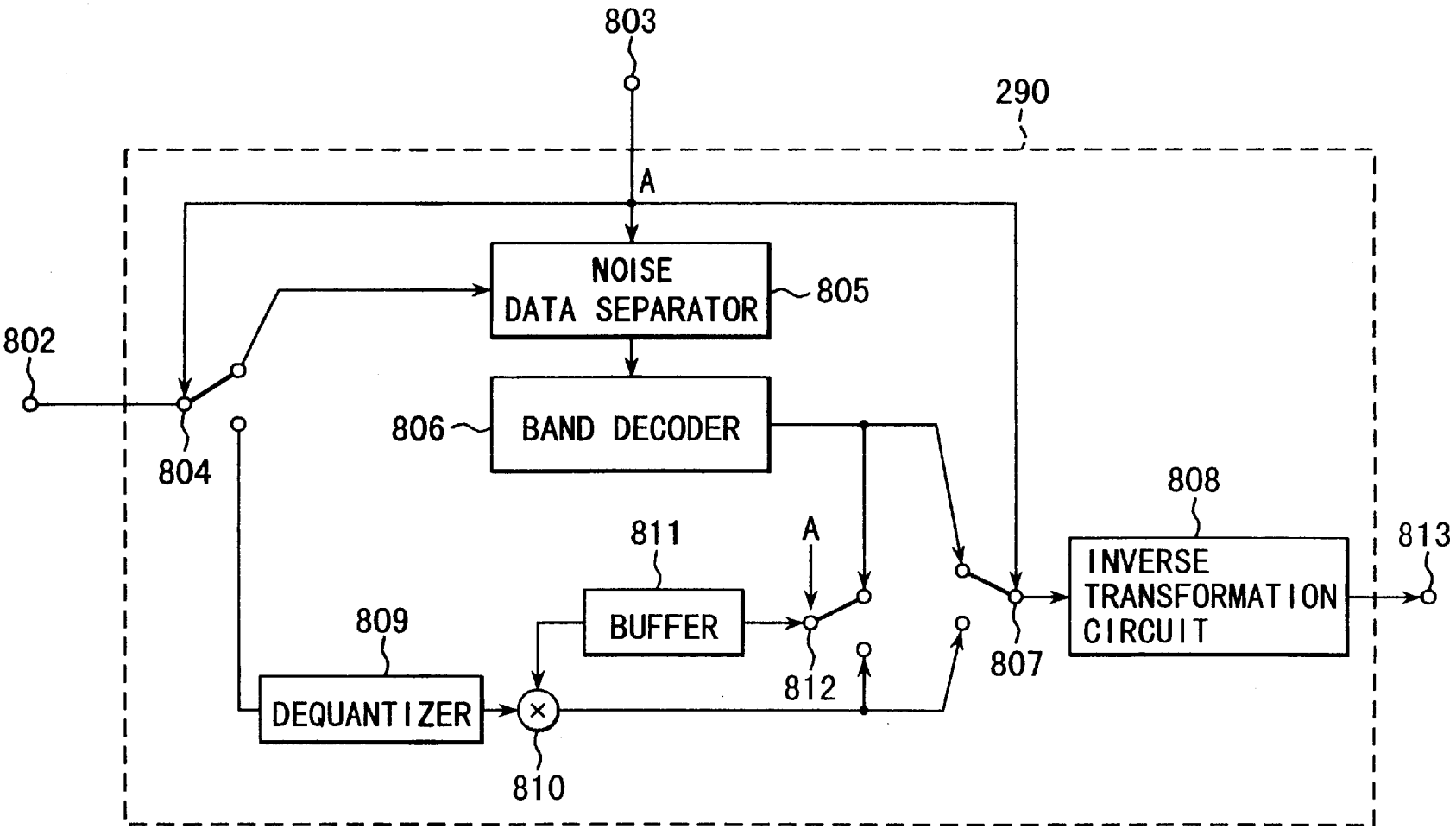
FIG. 39 is a block diagram showing a configuration of a noise decoder according to the eighth embodiment.
Figure 40:
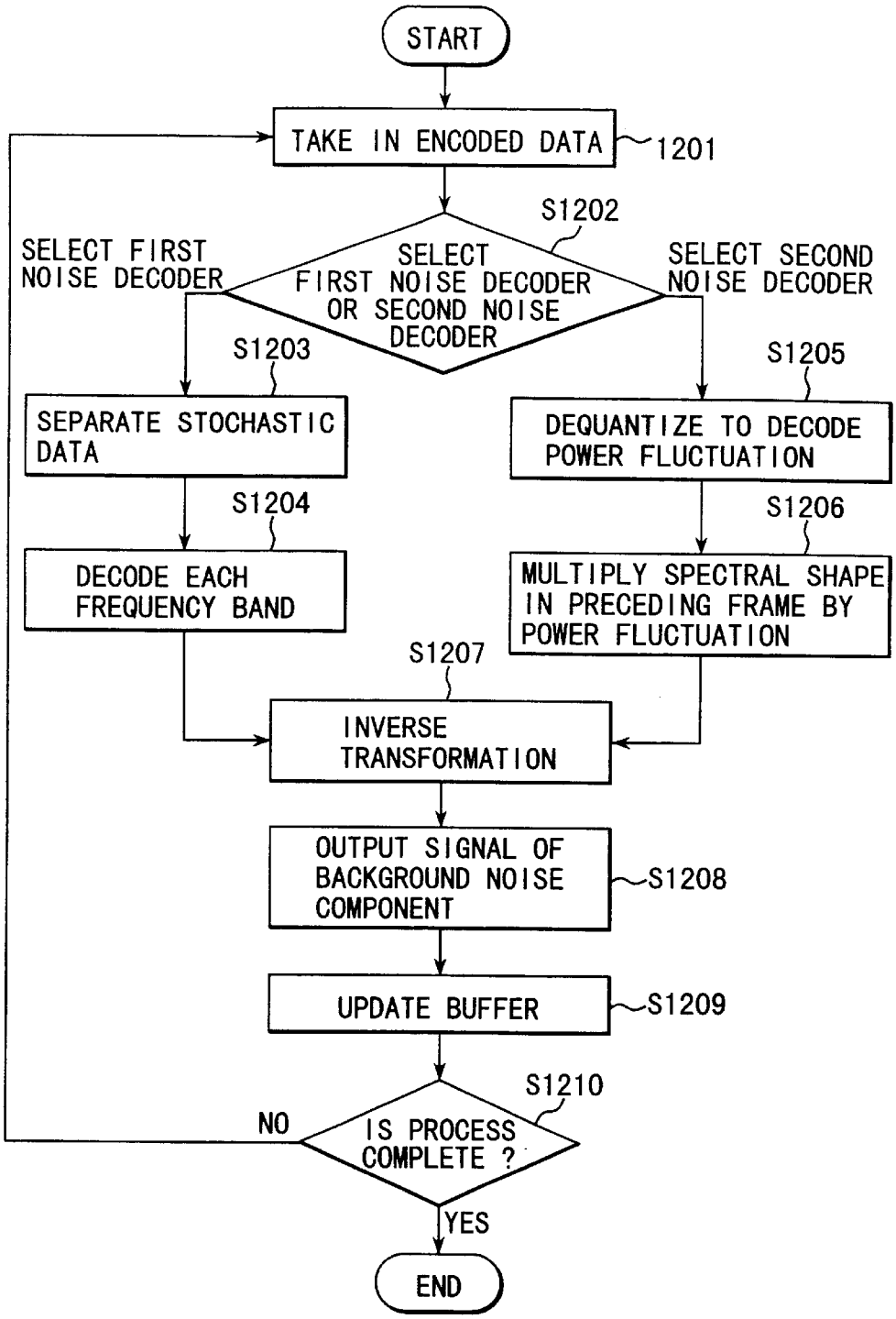
FIG. 40 is a flow chart showing processing steps of the noise decoder in FIG. 39.
Figure 43:
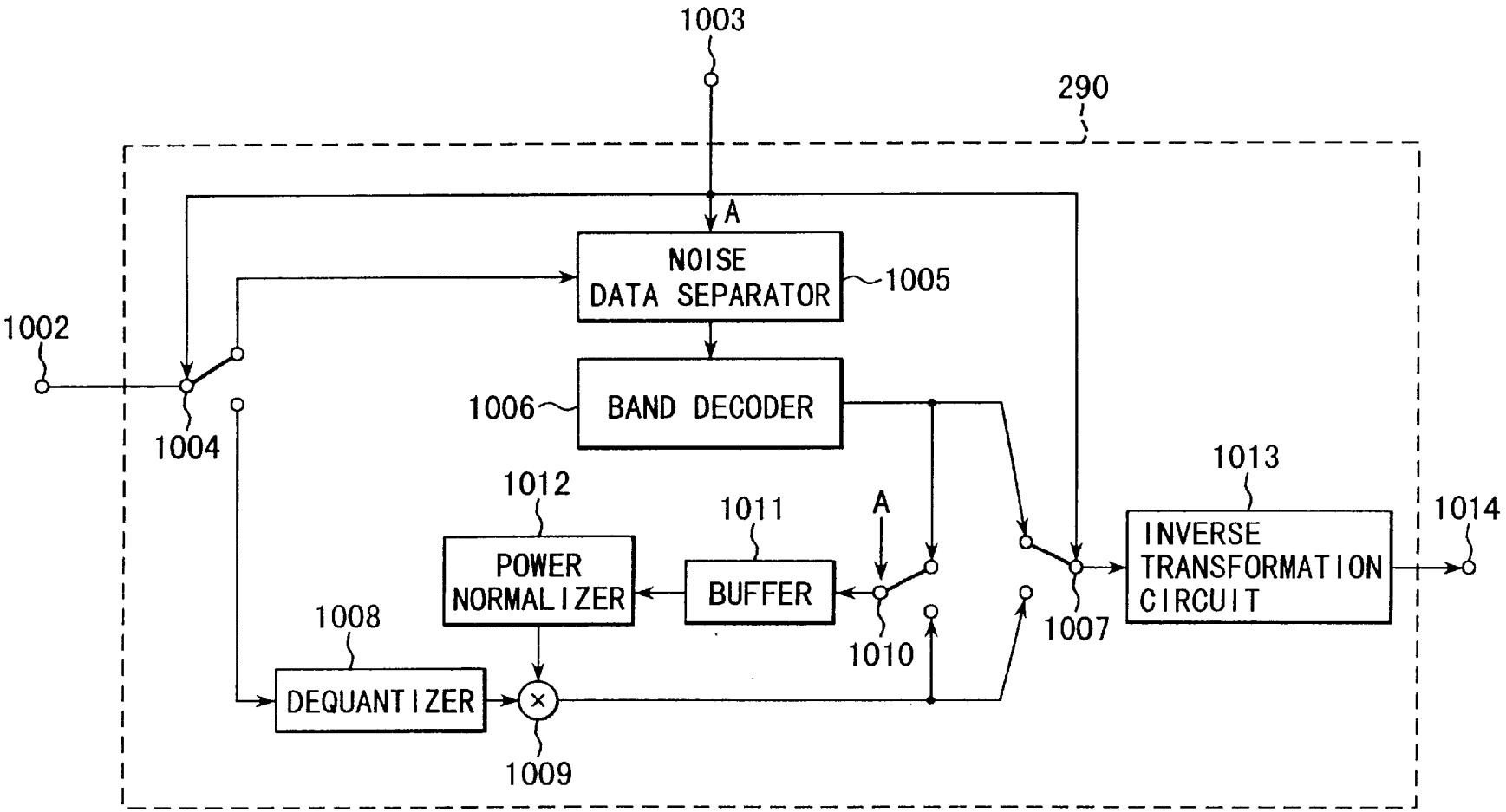
FIG. 43 is a block diagram showing a configuration of a noise decoder according to the ninth embodiment.
Figure 44:
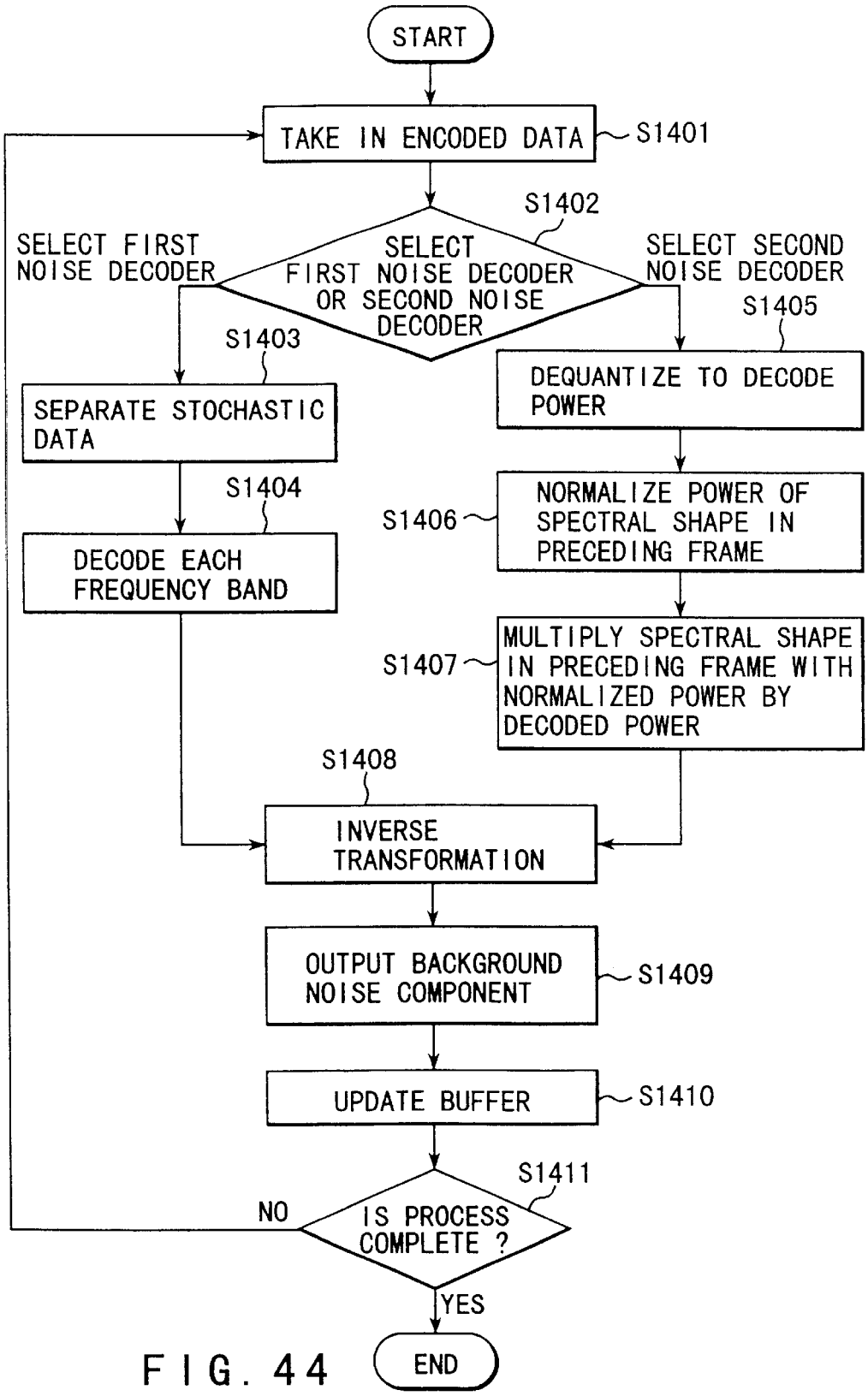
FIG. 44 is a flow chart showing processing steps of the noise decoder in FIG. 43.

Elements in FIG. 43 having the same names as those in FIG. 39 have the same functions and will not be described here. Encoded data taken in at an input terminal 1002 is supplied through a switch 1004 to a noise data separator 1005 or a dequantizer 1008. The noise data separator 1005 separates the encoded data into a quantization index for each band. A band decoder 1006 decodes the amplitude of each frequency band based on the information of the noise data separator 1005. The dequantizer 1008 dequantizes the encoded data to decode the power (step S1405). The spectral shape of the preceding frame output by a buffer 1011 is supplied to a power normalization circuit 1012 to be normalized to have power of 1 with the shape kept unchanged (step S1406). A multiplier 1009 multiplies the spectral shape of the preceding frame before the power normalization as described above and the decoded power as described above together (step S1407) and supplies the output to an inverse transformation circuit 1013 through a switch 1007.

The inverse transformation circuit 1013 performs transformation which is the inverse of the transformation performed at the encoding end on the output of the multiplier 1009 to reproduce the component mainly constituted by a background noise (step S1408) and outputs it from an output terminal 1014 (step S1409). In parallel, the output of the multiplier 1009 is supplied through a switch 1010 to a buffer 1011 to update the contents thereof (step S1410). The above-described series of operations is repeated until step S1411 determines that the process has been completed.

As described above, the present invention provides a method for encoding speech and a method for decoding speech at a low rate wherein speech along with a background noise can be reproduced in a manner which is as close to the original speech as possible.

Figure 45:
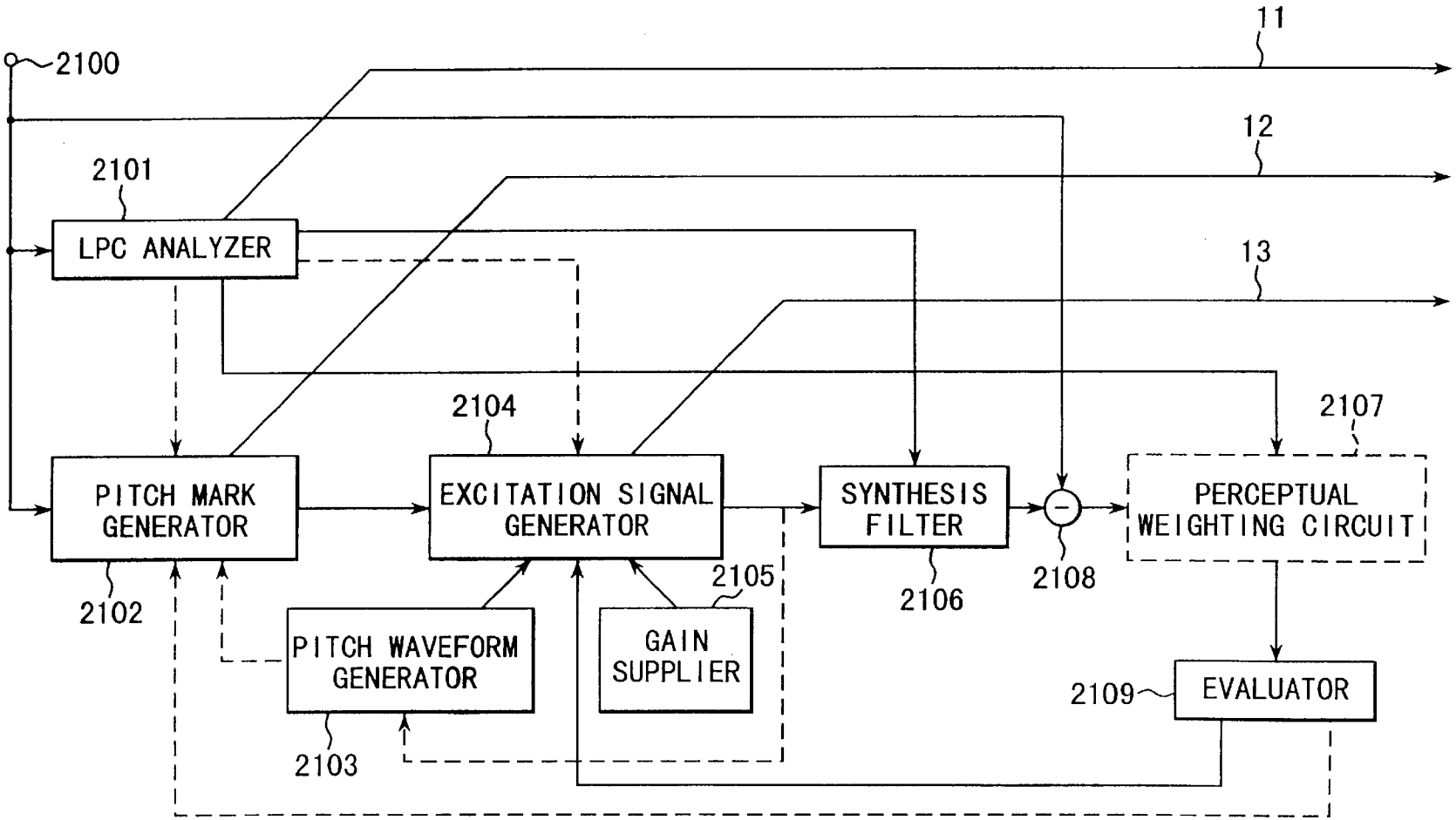
FIG. 45 is a block diagram showing a configuration of a speech encoding apparatus according to a tenth embodiment of the invention.

A description will now be made with reference to FIG. 45 on a speech encoding apparatus according to a twelfth embodiment of the invention employing a method for encoding speech wherein encoding is performed so as to reflect abrupt variations and fluctuations of pitch periods to obtain high quality decoded speech.

According to the present embodiment, a speech signal to be encoded is input to an input terminal 2100 in units of length corresponding to one frame, and an LPC analyzer 2101 performs linear prediction coding analysis (LPC analysis) in synchronism with the input of such a speech signal corresponding to one frame to obtain a liner prediction coding coefficient. The linear prediction coding coefficient is quantized as needed or interpolated with the linear prediction coding coefficient of the preceding frame. The quantization or interpolation process is normally carried out by transforming the prediction coding coefficient into a parameter referred to as "LSP (line spectrum pair)".

A linear prediction coding coefficient (hereinafter referred to as "LPC coefficient") obtained through such a process is set in a synthesis filter 2106 and, at the same time, is output as LPC information 11 which is synthesis filter characteristic information representing the transfer characteristics of the synthesis filter 2106. The LPC coefficient may further be passed to a pitch mark generator 2102 and an excitation signal generator 2104 as indicated by the broken lines depending on the configurations of the pitch mark generator 2102 and excitation signal generator 2104.

The input speech signal at the input terminal 2100 is also input to the pitch mark generator 2102. The pitch mark generator 2102 analyzes the input speech signal and sets a mark that indicates the position in the frame where a pitch waveform is to be put (hereinafter referred to as "pitch mark"). The pitch mark generator 2102 outputs information 12 indicating how the pitch mark was set (hereinafter referred to as "pitch mark information"). The pitch mark information 12 indicates local pitch periods representing the time lengths of waveforms of one pitch of the input speech signal and is passed to the excitation signal generator 2104 and is simultaneously output as information indicating the local pitch period.

Figure 46A:
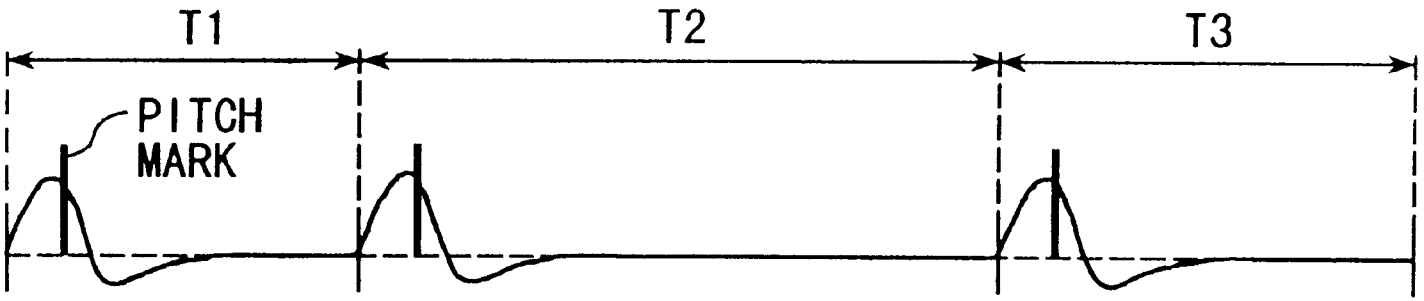
FIGS. 46A and 46B are diagrams showing the pitch waveforms and pitch marks of a prediction error signal and an energizing signal obtained from an adaptive codebook.

FIG. 46A shows an example of how to set pitch marks. In this example, pitch marks are set in the positions of peaks in a pitch waveform. How to set pitch marks and how to insert pitch waveforms will be described in detail later in the description of a fourteenth embodiment of the invention.

The number of pitch marks varies depending on the pitch of speech. This number increases as the pitch becomes high because the intervals between the marks become small as the pitch becomes high. Further, while the pitch marks are at substantially equal intervals in a voiced speech section, they are at irregular intervals in an unvoiced speech section.

The excitation signal generator 2104 inserts pitch waveforms where pitch marks are located and applies a gain thereto to generate an excitation signal. This may be accomplished using various methods including a method wherein the same pitch waveform and gain are applied to all pitch marks in a frame and a method wherein an optimum pitch waveform and gain are selected for each pitch mark. The selection of a pitch waveform and gain is preferably carried out using a method based on closed loop search. Specifically, this is a method wherein all excitation signals that can be generated are filtered by the synthesis filter 2106; errors of the filtered excitation signals from the input speech signal are calculated by a subtracter 2108; the errors are weighted by a perceptual weighting circuit 2107; and the excitation signal for which the error power, i.e., distortion of the input speech signal is minimum is selected.

A simple method for generating pitch waveforms in the pitch waveform generator 2103 is to store a plurality of template pitch waveforms in a codebook in advance and to select the optimum pitch waveform from them through closed loop search. However, pitch waveforms are in strong temporal correlation with each other, and pitch waveforms adjacent to each other in terms of time often resemble each other in shape. For this reason, an efficient method is to store pitch waveforms used in the past in a memory referring to the output of the excitation signal generator 2104 and to correct the difference between those waveforms and the current pitch waveforms using pitch waveforms stored in the codebook. Similarly, the amount of data transmitted by a gain supplier 2105 can be reduced by utilizing the nature that gain changes smoothly between adjoining pitch waveforms. The excitation signal generator 2104 finally outputs information 13 on pitch waveforms and gain to terminate the encoding of the current frame.

Thus, in the speech encoding apparatus according to the present embodiment, the LPC information 11 which is synthesis filter characteristic information, the pitch mark information 12 which is information representing local pitch periods and the information 13 on pitch waveforms and gain representing an excitation signal are output as encoded data, and synthesized by a multiplexer (not shown) to be output as an encoded data stream.

The present invention focuses attention on changes in pitch waveforms in a frame such as abrupt variations and fluctuations of pitch periods in order to achieve improvement of the quality of decoded speech. There are conventional methods that focus attention on changes in pitch waveforms in a frame and attempt to improve speech quality by gradually changing pitch periods. Such conventional techniques are on an assumption that pitch periods change in a fixed pattern and, in many cases, employ a pattern which changes from one pitch period to another at a constant rate with respect to time. However, the speed of an actual change is not constant, and pitch periods can go on changing with their length becoming long and short although slightly. It is therefore difficult to improve speech quality using a method that assumes a fixed pattern. Especially, pulse-shaped waveforms (pitch pulses) included in an excitation signal significantly affect speech quality when they are out of position because of high power they have.

Figure 46B:
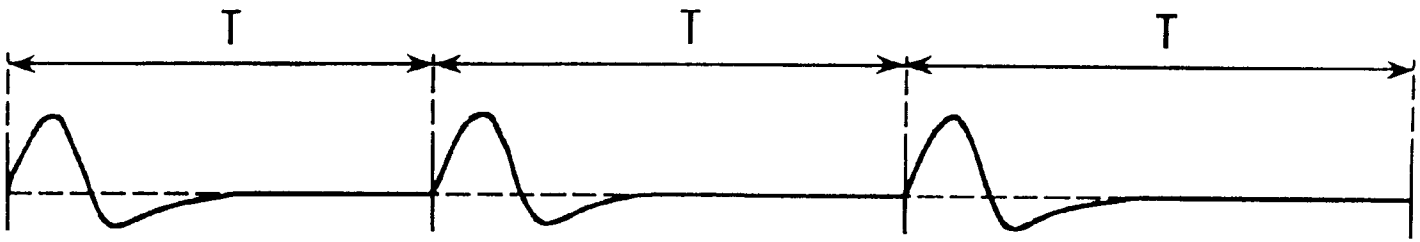

Under such circumstances, according to the present embodiment, it is assumed that pitch periods change in resolution on the order of waveforms of one pitch, and such pitch periods are referred to as "local pitch periods" as described above. Specifically, the local pitch periods represent time lengths of waveforms of one pitch of an input speech signal and correspond to T1, T2 and T3 shown in FIG. 46A. The local pitch periods serve as encoding sections for the excitation signal generator 2104, and an excitation signal is generated for which distortion of a synthesized speech signal in each encoding section is minimized. On the contrary, pitch periods obtained by conventional methods for analyzing a pitch, i.e., pitch periods calculated in a window applied on a signal having a predetermined length (several times the pitch waveforms) using an auto correlation function are referred to as "global pitch periods". The global pitch periods represent average pitch periods of a plurality of consecutive pitch waveforms of input speech and correspond to T shown in FIG. 46B.

While there are various possible methods for obtaining local pitch periods, the present embodiment achieves it by setting pitch marks as described above. In this case, since the pitch marks are searched such that they are each set in the positions of the peaks of one-pitch waveforms as shown in FIG. 46A, the intervals between the pitch marks represent the local pitch periods. A preferred way of setting pitch marks will be specifically described in the description of a fourteenth embodiment of the invention to follow.

A perceptual weighting filter 2107 is provided downstream of the subtracter 2108 in the present embodiment. Depending on the configuration of the perceptual weighting filter, a weighted synthesis filter having the functions of both of a perceptual weighting filter and a synthesis filter may provided upstream of the subtracter 2108. This is a well-known technique for the CELP encoding system and the like, and the position of the perceptual weighting filter may be either of those shown in FIGS. 45 and 48. This equally applies to the embodiments to follow.

In the pitch mark generator 2102 may change the pitch mark to be generated at the same time as the search of the excitation signal performed by an evaluator 2109. That is, the pitch pattern and pitch waveform can be simultaneously searched. Although this necessitates a great amount of computation, speech quality is improved correspondingly. This equally applies to the embodiments to follow.

The encoding sections divided based on the local pitch periods are sections to be subjected to the encoding of a pitch waveform and does not necessarily coincide with encoding sections for other parameters (a linear prediction coding coefficient, gain, stochastic code vector and the like). For example, it is sufficient in most cases that a stochastic code vector is obtained for each frame and a linear prediction coding coefficient is obtained for each several frames.

Further, there are several methods for ordering the calculations in each encoding section. A first example is a sequential method of calculation wherein distortion is calculated in each encoding section sequentially (in the order of time) from the left to determine a parameter for each section. This method has a simple structure and requires only small amounts of calculation and memory because the process is completed in one encoding section. When a pitch waveform obtained in a certain encoding section is passed through the synthesis filter, the response thereto is extended to the next encoding section. It is essentially necessary to consider the influence of the response on the next encoding section in determining the parameters in the current encoding section, but the first example ignores this.

Taking above-described situation into consideration, a second example is proposed wherein distortion in a frame as a whole is calculated with the parameters changed from section to section. According to this method, since a combination of parameters among encoding sections are calculated for each frame, the accuracy of encoding is improved, although the amount of calculation and the capacity of memory are increased.

The method for encoding speech according to the present embodiment has a greater effect of improving speech quality in voiced sections and a smaller effect in unvoiced sections. It is therefore preferable to use the method for encoding speech according to the present embodiment only in voiced sections and to use a codec exclusively used for unvoiced sections (e.g., a speech encoding apparatus based on the CELP system which used no adaptive codebook) in unvoiced sections as long as such an arrangement creates no problem in practical use.

As described above, according to the present embodiment, to search and encode an excitation signal that results in minimum distortion in a synthesized speech signal when input to the synthesis filter 2106, encoding sections are determined based on local pitch periods representing time lengths of one-pitch waveforms of the input speech signal and the excitation signal is generated at the excitation signal generator 2104 for each of the encoding sections. This makes it possible to perform encoding that reflects abrupt variations and fluctuations of the pitch periods of the input speech signal and, therefore, the quality of decoded speech obtained at the decoding end can be improved.

Figure 47:
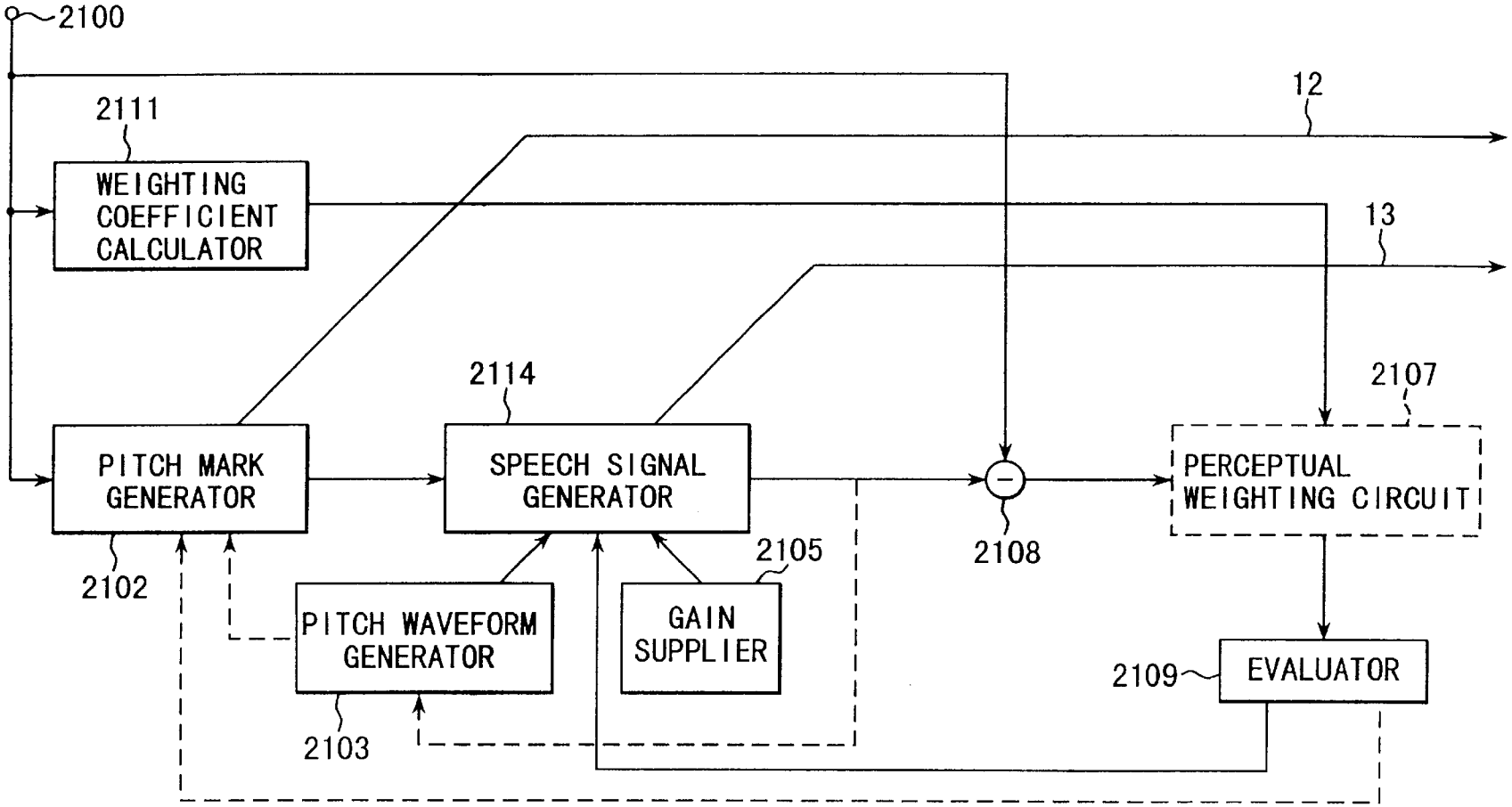
FIG. 47 is a block diagram showing a configuration of a speech encoding apparatus according to an eleventh embodiment of the invention.

FIG. 47 shows a speech encoding apparatus according to a thirteenth embodiment employing a method for encoding speech according to the invention. This speech encoding apparatus has a configuration which is obtained by removing the synthesis filter 2106 from the speech encoding apparatus of the twelfth embodiment and replacing the excitation signal generator 2104 with a speech signal generator 2114.

The speech signal generator 2114 has the same configuration as the excitation signal generator 2104, uses local pitch periods obtained in the pitch mark generator 2102 as encoding sections and generates a synthesized speech signal whose distortion is minimum in each of the encoding section. The excitation signal generator 2104 eventually generates information 13 on a pitch waveform and gain to terminate encoding in the current frame.

Thus, the speech encoding apparatus in the present embodiment outputs pitch mark information 12 which is information representing the local pitch periods and the information 13 on a pitch waveform and gain which is information on the synthesized speech signal is output as encoded data which is synthesized by a multiplexer (not shown) to output an encoded stream.

The twelfth embodiment employs a technique wherein an input speech signal is encoded after being separated into an LPC coefficient and a residual signal according to linear prediction analysis and the residual signal is encoded using local pitch periods. The present embodiment is a system in which an input speech signal is directly encoded, and the residual signal in the twelfth embodiment corresponds to the speech signal (synthesized speech signal) itself in the present embodiment.

It is also preferable in the present embodiment to evaluate an error from the subtracter 2108 at the evaluator 2109 after weighting it at the perceptual weighting filter 2107 in order to make quantization noises less perceptible during encoding utilizing human perceptual characteristics. The coefficient used for weighting at the perceptual weighting filter 2107 is obtained at a weighting coefficient calculator 2111 from the input speech signal.

It is known that LPC analysis exhibits excellent performance especially when applied to human voice. Therefore, the twelfth embodiment utilizing LPC analysis is preferable in applications which exclusively deal with human voice such as telephones. However, the performance of LPC analysis may be less than expected when it is used to encode sound signals, environmental sound signals, audio signals and the like other than human voice. In such cases, it is more advantageous to encode waveforms directly and, in deed, it is common not to perform LPC analysis during decoding of audio signals. The present embodiment is effective in encoding such types of speech signals for which LPC analysis works poorly.

As described above, to generate and encode a synthesized speech signal that results in minimum distortion without using a synthesis filter, according to the present embodiment, encoding sections are determined based on local pitch periods as in the first embodiment and a synthesized speech signal is generated for each of the encoding section at the speech signal generator 2114. This makes it possible to cause the synthesized speech signal to reflect abrupt variations and fluctuations of the pitch periods of the input speech signal, thereby improving the quality of decoded speech obtained at the decoding end.

Figure 48:
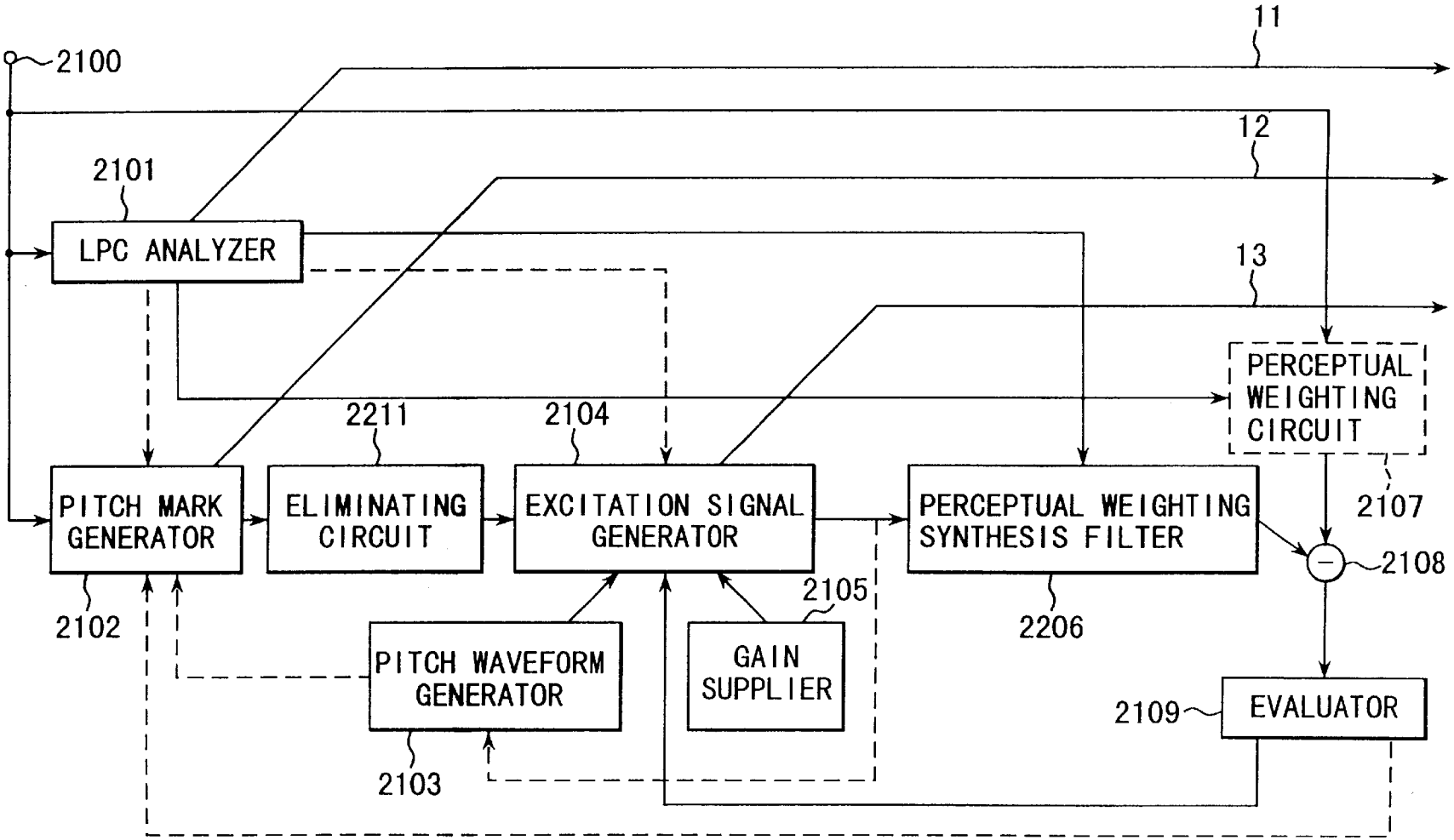
FIG. 48 is a block diagram showing a configuration of a speech encoding apparatus according to a twelfth embodiment of the invention.

FIG. 48 shows a speech encoding apparatus according to a fourteenth embodiment of the invention employing a method of encoding speech of the present invention. This speech encoding apparatus is different from the twelfth embodiment shown in FIG. 45 in that an eliminating circuit 2211 is inserted downstream of the pitch mark generator 2102. Further, the synthesis filter 2106 shown in FIG. 45 is replaced with a perceptual weighting synthesis filter 2206. A decrease in the length of pitch periods inevitably results in an increase in the number of pitch marks. The eliminating circuit 2211 has a function of eliminating less efficient pitch marks to prevent an unnecessary increase in the number of pitch marks, thereby reducing the bit rate required for the transmission of the pitch mark information 12.

Figure 49A:
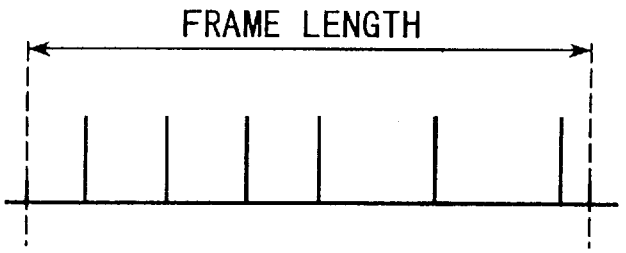
FIGS. 49A to 49F are diagrams showing how to set pitch marks in the twelfth embodiment.

First, a description will be made with reference to FIGS. 49A to 49F on an example of how to set pitch marks according to the present embodiment. First, global pitch periods are obtained in advance using a conventional method for pitch analysis. An energization signal constituted by pulses is produced utilizing the fact that pitch pulses rise substantially at the global pitch periods. The positions where the pulses rise may be obtained using a technique similar to conventional multi-pulse encoding. Specifically, an error between an input speech signal and a synthesized speech signal (distortion of the synthesized speech signal) is calculated with the positions of the pulses changed gradually to search the point at which the distortion is minimized. Thus, an energization signal constituted by pulses as shown in FIG. 49A is generated.

Next, a frame is divided into subframes at each of the local pitch periods. Encoding is performed for each of such subframes. Attention must be paid to prevent a pitch mark from extending across two subframes because a pitch mark is in a position where a pitch pulse rises. Further, pitch mark are preferably in a fixed position from the beginning of the subframes irrespective of the local pitch periods. The reason is that this places the pitch pulses in a fixed position of stochastic code vectors to be described later and, as a result, improves the effect of learning of the stochastic code vectors easily. Although it is possible to match predetermined positions of the stochastic code vectors with the pitch marks without locating the pitch marks in fixed positions, it necessitates a process of positioning.

Figure 49B:
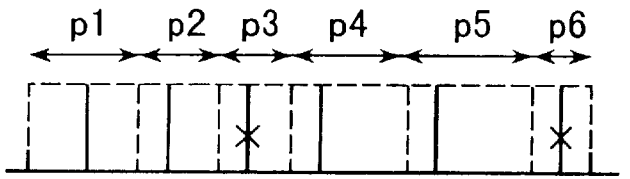

FIG. 49B shows division of a frame into subframes at each of the local pitch periods. A region enclosed in dotted lines represents one subframe, and p1 through p6 represents the length of respective subframes. p2 through p5 represents local pitch periods. p1 and p6 are exceptions because they are adjacent to the frame boundaries. As apparent from FIG. 49B, a method assuming constant pitch periods or a change at a constant speed in the prior art can not achieve matching of the pitch pulses for a frame in which the pitch periods stay constant halfway the frame and then change.

Next, a pitch waveform is pasted in alignment with the pitch mark in each of the subframes thus obtained, and a gain is applied thereto to generate an excitation signal. A pitch waveform can be efficiently created by combining an adaptive pitch waveform obtained from a previous excitation signal and a stochastic pitch waveform obtained from the stochastic codebook. Each pitch waveform is accompanied by a pitch mark, and the positions of the pitch pulses of the residual signal can be maintained by pasting the pitch waveforms in positions in alignment with the pitch marks of a subframe.

The symbols "X" in FIG. 49B indicate pulses eliminated by the eliminating circuit 2211. A decrease in the length of the pitch periods results in an increase in the number of pulses, which inevitably leads to an increase in the number of subframes. When encoding is performed on a subframe basis, the number of pitch waveforms and gain to be transmitted is increased to increase the amount of transmission.

In the present embodiment, pitch marks are eliminated to reduce the amount of transmission. Specifically, after pitch marks are set, a search is made to find and eliminate marks located at intervals which are relatively constant. In a section in which such elimination has been carried out, a waveform which actually corresponds to two pitches is treated as a waveform of one pitch. However, no shift of pitch positions occurs as long as the intervals of the marks are stable. That is, since the pulses of an adaptive pitch signal resulting from a previous signal rise at equal intervals, the elimination of a pulse corresponding to two pitches will result in no shift of pulse positions.

Another instance of the pulse elimination at the eliminating circuit 2211 occurs when there is an extremely short subframe at the end of a frame. Allocating a pitch waveform and gain to an extremely short subframe not only results in reduced efficiency but also can adversely affect the leading part of the next frame. Such a pulse is preferably eliminated.

Figure 49C:
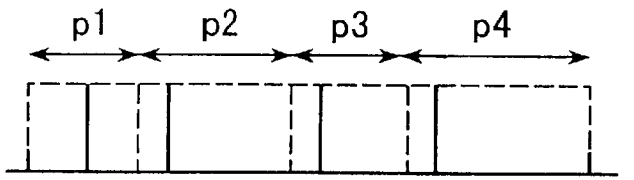

FIG. 49C shows a state that occurs when the pulses indicated by the symbols "X" in FIG. 49B. In this case, the local pitch periods p2 and p3 in FIG. 49B are concatenated to obtain a local pitch indicated by p2 in FIG. 49C (which is referred to as "local concatenated pitch period"). Similarly, the local pitch periods p4 and p5 in FIG. 49B are concatenated to obtain a local concatenated pitch indicated by p4 in FIG. 49C.

An example of encoding of frames having a fixed frame length has been described above. In this case, although a frame includes subframes having a length that is not related to local pitch periods at both ends thereof, this creates no problem in light of the principle of the invention. For example, when subframes of 1.5 pitches are produced, waveforms in previous excitation signals may be cut out from locations where the length of 1.5 pitches can be obtained, and such waveforms may be pasted in alignment with pitch marks. However, this requires corresponding searches into the past and disallows the use of recent excitation signals.

Figure 49D:
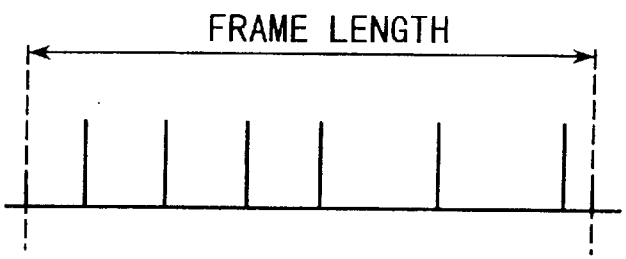

The frame length can be variable in storage type applications where there is less limitations on delay and the like. FIGS. 49D and 49F show such situations.

Figure 49E:
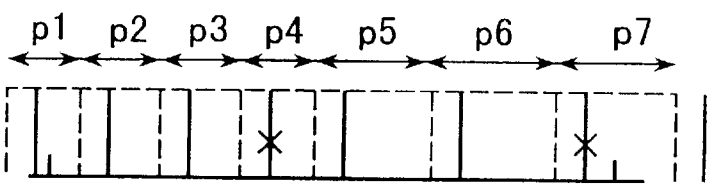
Figure 49F:
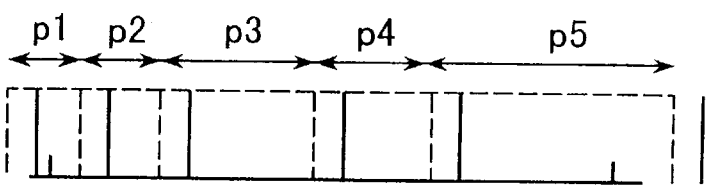

Referring to FIG. 49E, the subframe p1 is extended to the last pitch mark of the preceding frame such that it has a length corresponding to a local pitch period. Similarly, the subframe p7 is extended to the first pitch mark of the succeeding frame such that it has a length corresponding to a local pitch period.

FIG. 49F shows subframe lengths obtained as a result of elimination, which correspond to local pitch periods (the subframes p1, p2 and p4 have such lengths) or to local concatenated pitch periods obtained by concatenating adjoining pitch periods (the subframes p3 and p5 have such lengths).

As described above, according to the present embodiment, local concatenated pitch periods which are appropriate combinations of adjoining local pitch periods are obtained in addition to local pitch periods; encoding sections are determined based on those local pitch periods and local concatenated pitch periods; and the excitation signal generator 2104 generates an excitation signal for each of the encoding sections. This is advantageous in that encoding can be carried out such that abrupt variations and fluctuations of the pitch periods of an input speech signal are reflected to improve the quality of decoded speech obtained at the decoding end. In addition, there is an advantage in that encoding efficiency is improved as a result of a decrease in the bit rate required to transmit the pitch mark information 12 which is information indicating the local pitch periods and local concatenated pitch periods.

Figure 50:
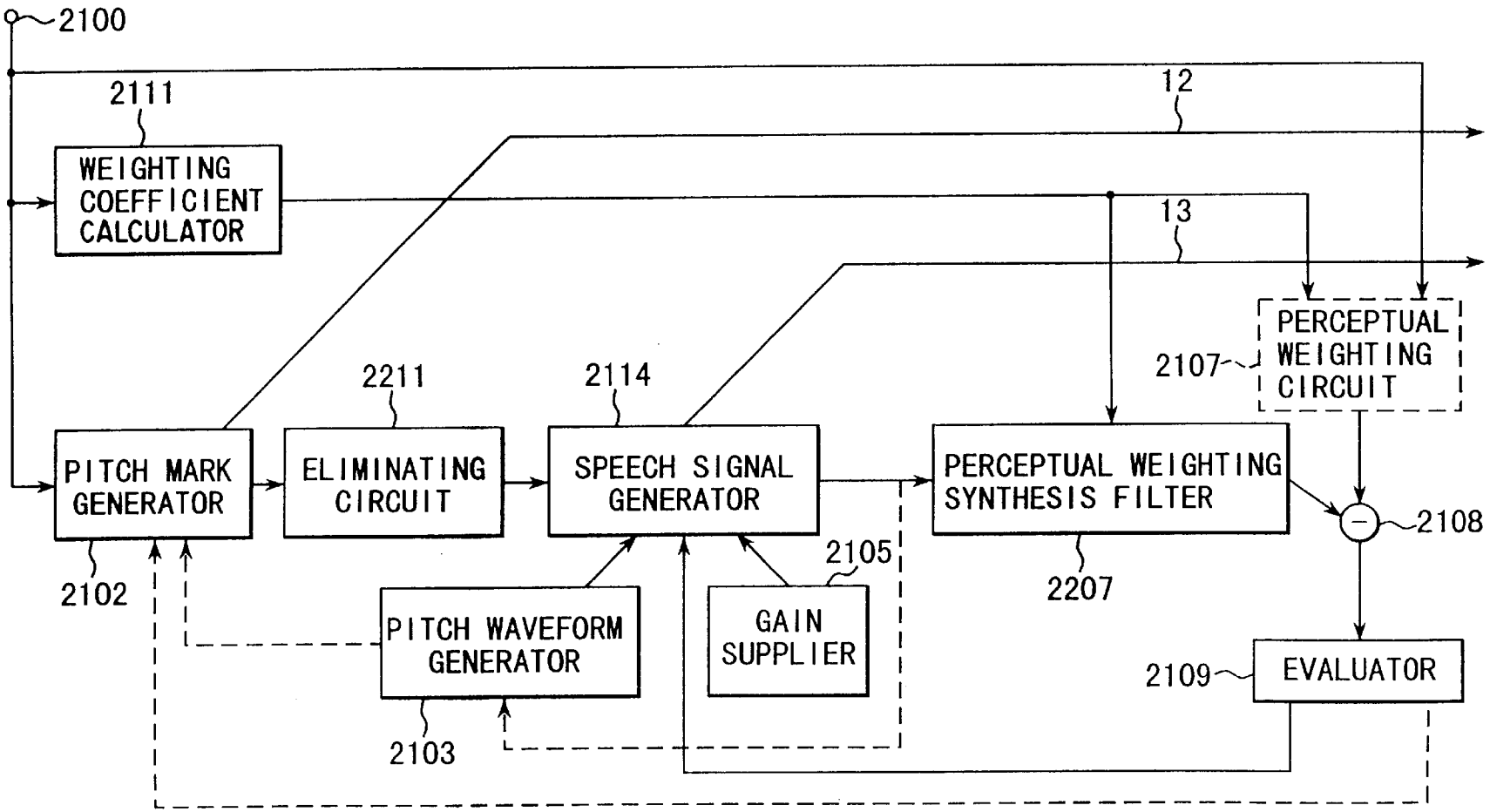
FIG. 50 is a block diagram showing a configuration of a speech encoding apparatus according to a thirteenth embodiment of the invention.

FIG. 50 shows a speech encoding apparatus according to a fifteenth embodiment of the invention employing a method for encoding speech according to the invention. It has a configuration wherein the perceptual weighting synthesis filter 2206 in FIG. 48 is deleted and replaced with a perceptual weighting circuit 2207 and wherein the excitation signal generator 2104 is replaced with a speech signal synthesizer 2114 accordingly. The fifteenth embodiment in a relationship to the fourteenth embodiment which is analogous to the relationship of the second embodiment to the twelfth embodiment and has the same effects as the fourteenth embodiment.

According to the present embodiment, encoding is carried out by generating a synthesized speech signal having minimized distortion without using a synthesis filter in a manner similar to the fourteenth embodiment, i.e., local concatenated pitch periods which are appropriate combinations of adjoining local pitch periods are obtained in addition to local pitch periods; encoding sections are determined based on those local pitch periods and local concatenated pitch periods; and the excitation signal generator 2114 generates an excitation signal for each of the encoding sections. This is advantageous in that encoding can be carried out such that abrupt variations and fluctuations of the pitch periods of an input speech signal are reflected to improve the quality of decoded speech obtained at the decoding end. In addition, there is an advantage in that encoding efficiency is improved as a result of a decrease in the bit rate required to transmit the pitch mark information 12 which is information indicating the local pitch periods and local concatenated pitch periods.

Figure 51:
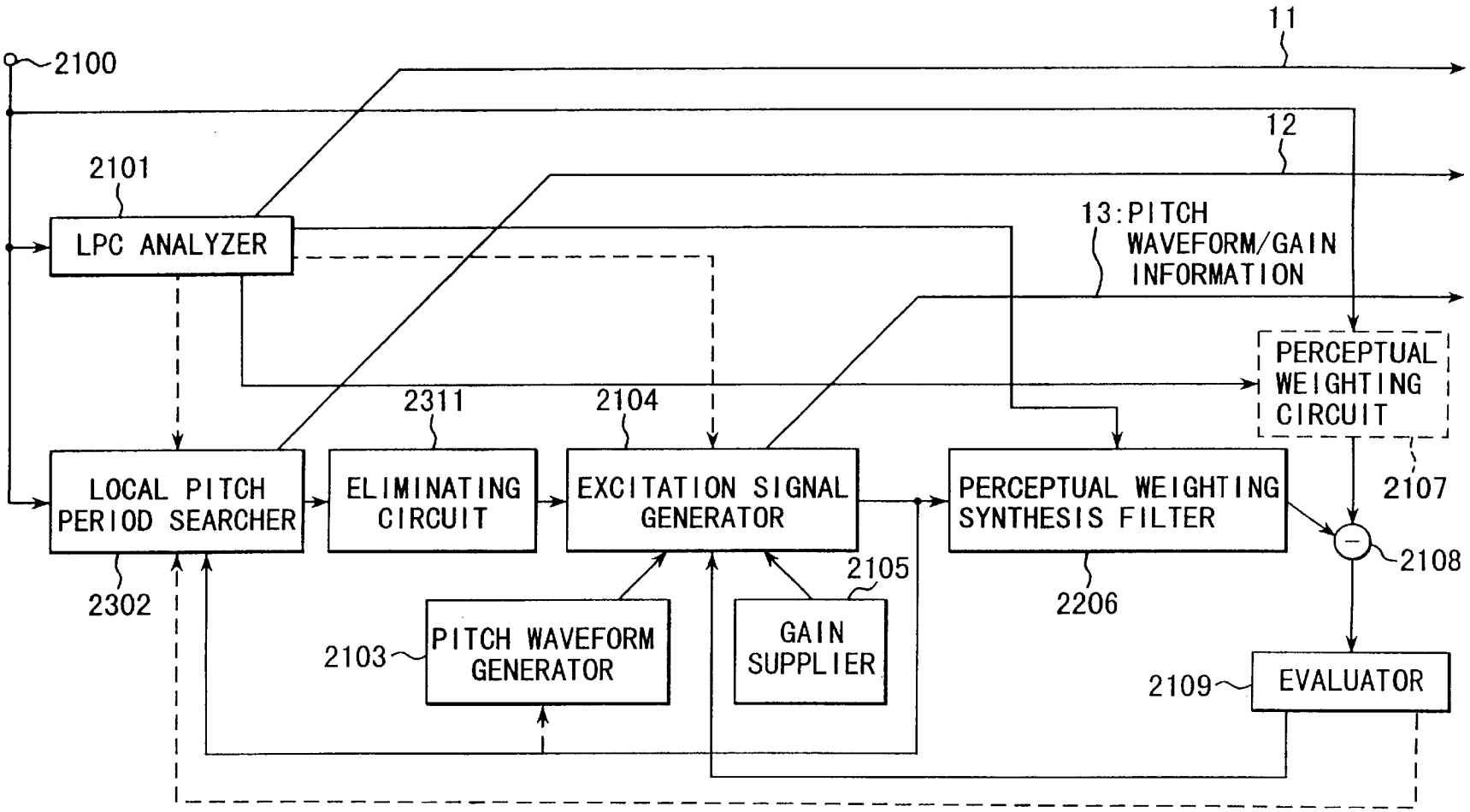
FIG. 51 is a block diagram showing a configuration of a speech encoding apparatus according to a fourteenth embodiment of the invention.

FIG. 51 shows a speech encoding apparatus according to a sixteenth embodiment of the invention employing a method for encoding speech according to the invention. It has a configuration wherein the pitch mark generator 2102 of the fourteenth embodiment shown in FIG. 48 is replaced with a local pitch period searcher 2302. Further, an eliminating circuit 2211 in the present embodiment has a configuration which includes some modification from the eliminating circuit 2211 in FIG. 48 reflecting the above-described replacement.

As previously mentioned, there are various possible methods for searching local pitch periods. The present embodiment obtains local pitch periods using a technique which utilizes an adaptive codebook as used in the CELP system and the procedure of which will be described below.

First, the most recent pitch vector having a length T is extracted from the adaptive codebook. While the CELP system uses such an extracted pitch vector repeatedly until a subframe length is reached, a subframe length is set at T in the present embodiment so as not to repeat the pitch vector.

Next, SNR under the optimum gain is calculated for a subframe having a length T, and SNR is similarly calculated with the value T varied. Thus, SNR is calculated for all pitch periods, and the value of T which results in the highest SNR is chosen as the local pitch period and as the length of the subframe. Thereafter, an adaptive pitch waveform and a stochastic pitch waveform are obtained as in the above-described embodiment to generate an excitation signal. This operation is repeated until the end of the frame is reached.

Although the present embodiment involves an amount of calculation greater than that in the method wherein pitch marks are set as in the above-described embodiment, more accurate local pitch periods can be obtained because searching is carried out using a waveform which is close to a pitch waveform in actual use.

Figure 52:
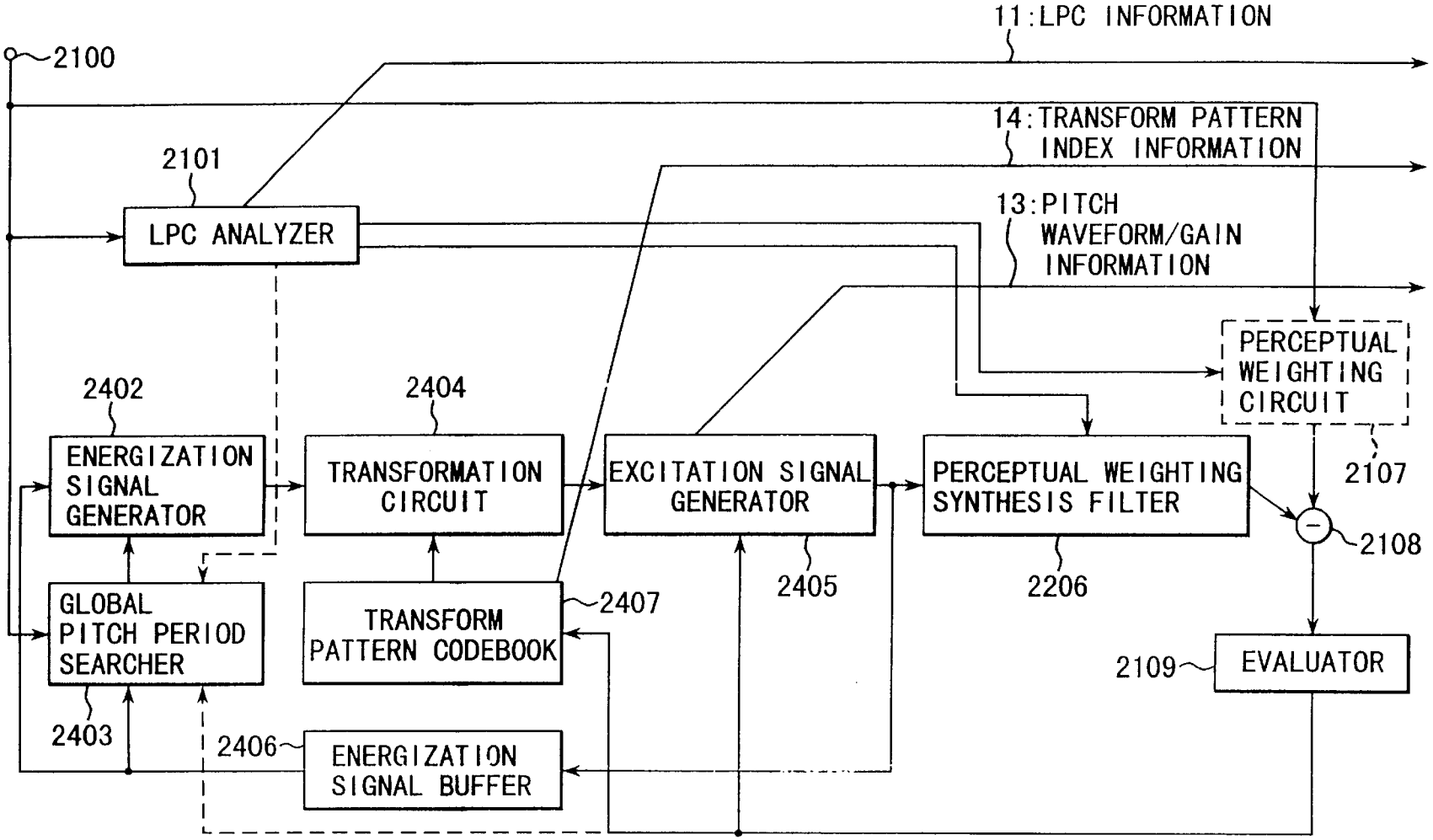
FIG. 52 is a block diagram showing a configuration of a speech encoding apparatus according to a fifteenth embodiment of the invention.

FIG. 52 shows a speech encoding apparatus according to a seventeenth embodiment of the invention employing a method for encoding speech of the present invention. This speech encoding apparatus obtains global pitch periods representing average pitch periods of a plurality of successive pitch waveforms in an input speech signal to produce a first pitch energization signal that repeats at such periods and transforms the first pitch energization signal in terms of time and amplitude to align the signal with the position of the pitch pulses of an excitation. signal, thereby providing a second energization signal which is equivalent to an excitation signal generated by obtaining local pitch periods.

Specifically, according to the present embodiment, a global pitch period searcher 2403 obtains global pitch periods as described above from an input speech signal using a conventional technique. An energization signal generator 2402 generates a first pitch energization signal based on the global pitch periods and a previous excitation signal stored in an energization signal buffer 2406. The first pitch energization signal has a pitch waveform which repeats at equal intervals corresponding to the global pitch periods.

A transformation circuit 2404 performs transformation on the first pitch energization signal in terms of time and amplitude (expansion, shifting and the like) with reference to a transform pattern codebook 2407 to generate a second energization signal which is passed to an excitation signal generator 2405. The excitation signal generator 2405 adds a stochastic code vector to the first energization signal as needed to generate an excitation signal which is supplied to a perceptual weighting synthesis filter 2206. The transform pattern and stochastic code vector are searched on a closed loop basis.

The present embodiment provides LPC information 11 representing both of information on the transfer characteristics of the perceptual weighting synthesis filter 2206 and information representing the global pitch periods, a transform pattern code index 14 into the transform pattern codebook 2407 which is information representing th transformation performed on the first energization signal, and information 13 representing the excitation signal.

As described above, according to the present embodiment, the global pitch period searcher 2403 obtains global pitch periods representing average pitch periods of a plurality of pitch waveforms in an input speech signal; the energization signal generator 2402 generates a first pitch energization signal based on the global pitch periods; the transformation circuit 2404 performs transformation on the first pitch energization signal in terms of, for example, time and amplitude to allow the excitation signal generator 2405 to generate a second pitch energization signal which is equivalent to an excitation signal generated based on local pitch periods; and the second energization signal is input to the perceptual weighting synthesis filter 2206. As a result, the required amount of calculation is smaller then that in the method wherein local pitch periods are directly obtained, and the excitation signal reflects abrupt variation and fluctuations of the pitch period of the input speech signal to improve the quality of the decoded speech. In addition, a method equivalent to the conventional technique wherein pitch periods changes at a constant rate can be realized by preparing a pattern for expanding waveforms in proportion to time as the transform pattern.

An eighteenth embodiment of the method for encoding of the invention is an example of the application of the seventeenth embodiment to the method of directly encoding a speech signal similarly to the thirteenth embodiment. Specifically, the energization signal generator 2402 and excitation signal generator 2405 in FIG. 52 are replaced with a first and second speech signal generators, respectively; the first speech signal generator generates a first synthesized speech signal based on global pitch periods; and the second speech signal generator transforms the first synthesized speech signal to generate a second synthesized speech signal which has minimized distortion from the input speech signal. Further, the LPC analyzer 2101 and perceptual weighting synthesis filter 2206 are deleted, and the second synthesized speech signal is directly passed to the subtracter 2108.

In this case, information representing the global pitch periods and information representing the second synthesized speech signal is output as encoded data.

As described above, according to the present embodiment, encoding is carried out by generating a synthesized speech signal having minimized distortion without using a synthesis filter according to a method wherein a first synthesized speech signal is generated based on global pitch periods as in the seventeenth embodiment and wherein the first synthesized speech signal is transformed in terms of, for example, time and amplitude to generate a second synthesized speech signal which is equivalent to a synthesized speech signal generated based on local pitch periods. This is advantageous compared to the method wherein local pitch periods are directly obtained in that abrupt variations and fluctuations of the pitch periods of the input speech signal can be reflected on the synthesized speech signal to improve the quality of the decoded speech with a reduced amount of required calculation.

Figure 53:
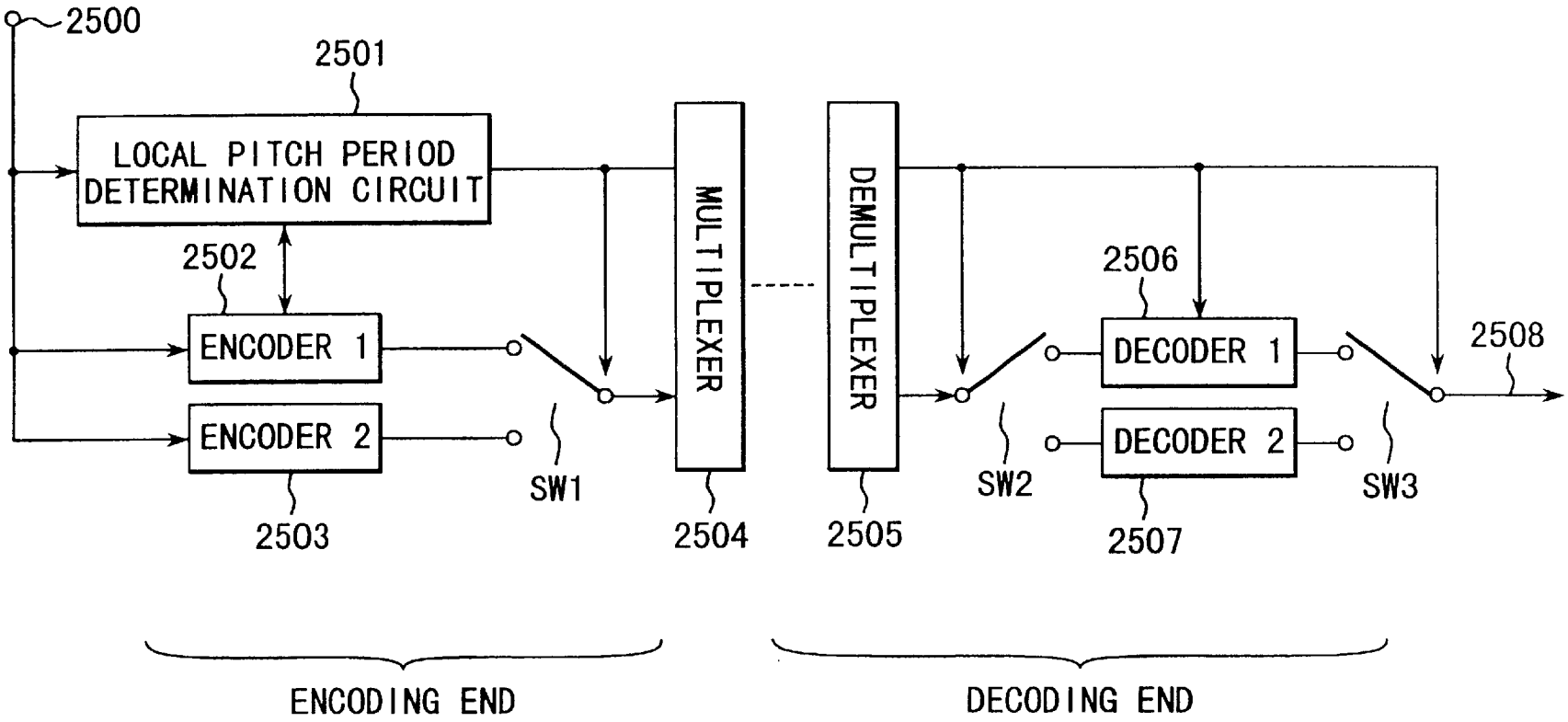
FIG. 53 is a block diagram showing a speech encoding/decoding system according to a sixteenth embodiment of the invention.

FIG. 53 shows a speech encoding/decoding system according to the eighteenth embodiment of the invention employing the method of encoding speech of the present invention. In this speech encoding/decoding system, a local pitch period determination circuit 2501 at the encoding end determines local pitch periods based on an input speech signal from an input terminal 2500. According to the result of the determination, either a first encoder 2502 or a second encoder 2503 is selected by a switch SW1, and the result of the determination at the local pitch period determination circuit 2501 is transmitted through a multiplexer 2504 along with an encoded bit stream from the selected encoder.

At the decoding end, according to the result of determination which has been separated by a demultiplexer 2505, either a first decoder 2506 or a second decoder 2507 is selected by switches SW2 and SW3, and the result of decoding at the selected decoder is provided as a reproduced speech signal 2508.

As described above, local pitch periods are irregular in unvoiced sections of an input speech signal, although they are cyclic in voiced sections. A great amount of transmission required to transmit all of such patterns. Taking this situation into consideration, the local pitch period determination circuit 2501 is adapted to examine the degree of the continuity of local pitch periods in order to determine whether an encoding method based on local pitch periods is suitable or not. Specifically, it is determined whether, for example, pitch marks are located at substantially equal intervals, i.e., the degree of the continuity of local pitch periods is determined. If an encoding method based on local pitch periods is suitable, the first encoder 2502 is used and, if not, the second encoder 2503 is used. The first encoder 2502 may be a speech encoder utilizing the method described in the above embodiments, and the second encoder 2503 may be a codec exclusively used for unvoiced sections such as a CELP type speech encoder using no adaptive codebook.

According to the present embodiment, the number of bits required for transmitting pitch mark information can be reduced and, in addition, the speech quality of a speech encoding/decoding system can be improved through the use of codecs which are suitable for voiced and unvoiced sections, respectively.

Figure 54:
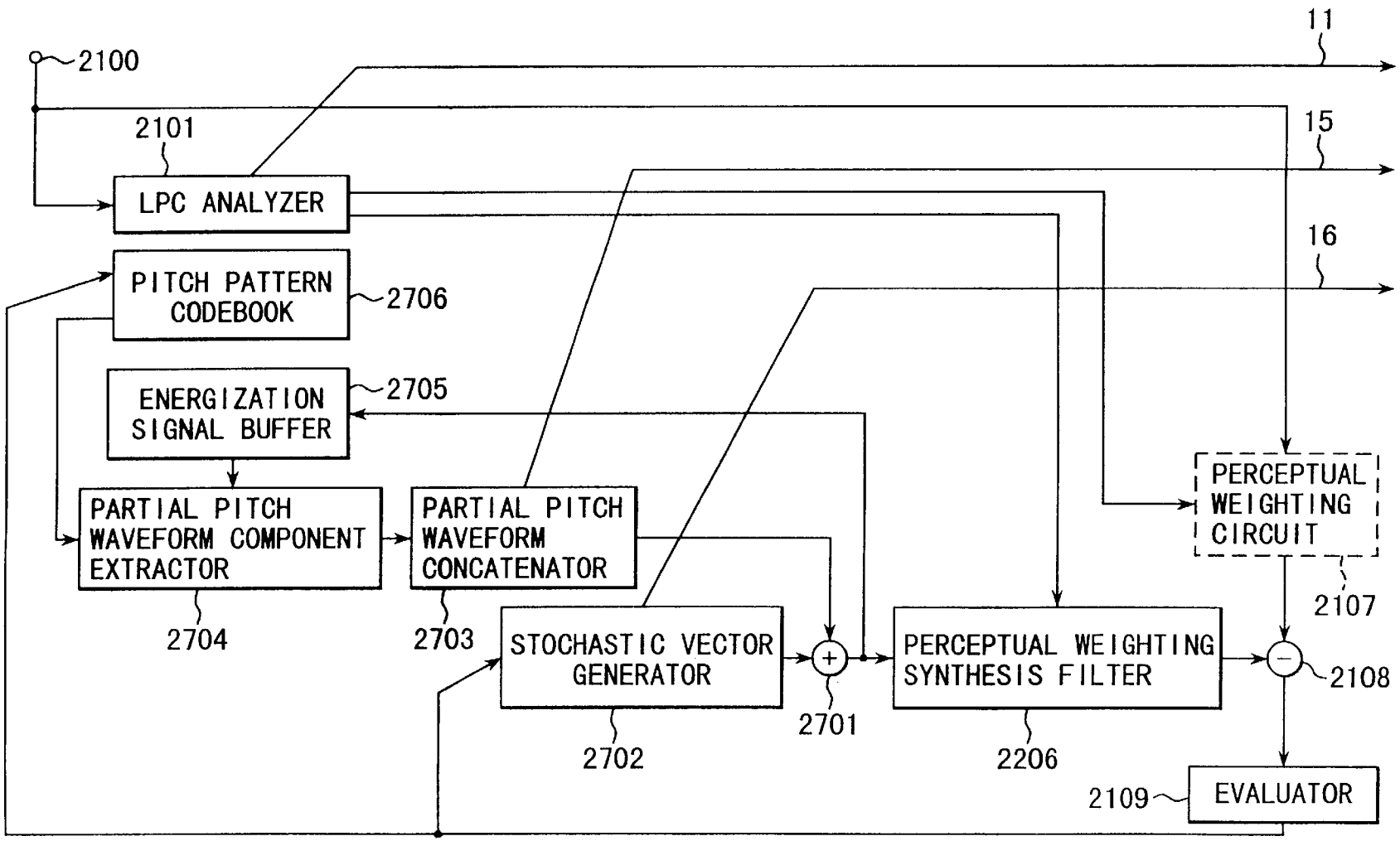
FIG. 54 is a block diagram showing a configuration of a speech encoding apparatus according to a seventeenth embodiment of the invention.

FIG. 54 shows a speech encoding apparatus according to a nineteenth embodiment of the invention employing a method for encoding speech of the invention.

The speech encoding apparatus of the present embodiment has a configuration wherein the pitch mark generator 2102, pitch waveform generator 2103, excitation signal generator 2104, gain supplier 2105 and eliminating circuit 2211 of the fourteenth embodiment are replaced with an adder 2701, a stochastic vector generator 2702, a partial pitch waveform mixer 2703, a partial pitch waveform extractor 2704, an energization signal buffer 2705 and a pitch pattern codebook 2706.

A speech signal to be encoded is input to an input terminal 2100 in units of length corresponding to one frame. This input speech signal is analyzed by an LPC analyzer 2101 similarly to the above-described embodiments to obtain an LPC coefficient (linear prediction coding coefficient) based on which the coefficients for a perceptual weighting synthesis filter 2206 and a perceptual weighting circuit 2107 are determined, and LPC information 11 which is synthesis filter characteristic information representing the transfer characteristics of a synthesis filter 2106 is output. While the LPC analyzer 2101 obtains the LPC coefficient for each frame, an excitation signal input to the perceptual weighting synthesis filter 2206 is obtained for each of several subframes obtained by dividing a frame.

The pitch pattern codebook 2706 stores a plurality of pitch patterns. Each of the pitch patterns is constituted by information on pitch periods of each of mini-frames which are subdivisions of the subframes. The energization signal buffer 2705 receives the input of a previous energization signal (excitation signal) for exciting the perceptual weighting synthesis filter 2206 from the adder 2701 and stores a predetermined length of this energization signal.

Based on the pitch periods of each mini-frame indicated by a pitch pattern, the partial pitch waveform extractor 2704 extracts a plurality of partial pitch waveforms in the length of the mini-frame from the energization signal buffer 2705 and outputs the same. The partial pitch waveform mixer 2703 concatenates the partial pitch waveforms to generate a pitch energization signal in the length of the subframe as an excitation signal for the current frame. At this point, the excitation signal for the current frame is obtained by multiplying the pitch energization signal by a certain gain if necessary. Further, as information representing the excitation signal for the current frame, pitch energization signal information 15 is output which is information concerning the extraction and concatenation of the partial pitch waveforms, i.e., information indicating how the partial pitch waveforms have been concatenated at the partial pitch waveform mixer 2703 based on which pitch pattern.

The stochastic vector generator 2702 generates a stochastic vector in the same manner as in the CELP system. Specifically, it selects an optimum energization signal from among a plurality of noise or energization signals obtained through learning as a stochastic vector candidate and multiplies the same by a certain gain if necessary to provide a stochastic energization signal. The stochastic vector generator 2702 outputs the selected stochastic vector candidate and the gain as stochastic energization signal information 16.

The pitch energization signal from the partial pitch waveform mixer 2703 and the stochastic energization signal from the stochastic vector generator 2702 are added by the adder 2701 and the result is passed through the perceptual weighting synthesis filter 2206 to provide a perceptually weighted synthesized speech signal.

Meanwhile, the input speech signal is passed through the perceptual weighting circuit 2107 to be output as a perceptually weighted speech signal. The subtracter 2108 calculates the error of the perceptually weighted synthesized speech signal output by the perceptual weighting synthesis filter 2206 from this perceptually weighted speech signal and inputs the error to an evaluator 2109. The evaluator 2109 selects an optimum pitch pattern and an stochastic energization signal respectively from the pitch pattern codebook 2706 and stochastic vector generator 2702 such that the error is minimized.

In conventional methods for encoding speech including the CELP system, an adaptive codebook has been used to obtain a pitch energization signal which is the output of the partial pitch waveform mixer 2703. An adaptive codebook stores previous excitation signals to provide a pitch energization signal by repeating a one-pitch waveform closest to the target vector. As already described, however, pitch variations and fluctuations can not be represented by simply repeating a waveform and, therefore, sufficient performance can not be achieved.

In order to solve this, according to the present embodiment, a mini-frame is made shorter than an average pitch period (global pitch period) in a subframe. In other words, pitch periods represented by a pitch pattern vary at a cycle which is shorter than the length of a one-pitch waveform. One possible method of simply achieving this is to set the updating cycle of pitch periods at a fixed value which is equal to or less than the minimum pitch period (on the order of 4 msec for human voice) treated during encoding. With this arrangement, the change rate of a pitch pattern can be always faster than the pitch periods regardless of the value of the global pitch periods.

Important factors of a pitch waveform are the position and shape of the peak thereof. Conventional adaptive codebooks have had a problem in that since the pitch waveform closest to a target vector is repeated, the position and shape of the peak may not accurately agree with the target. In order to solve this problem, according to the present embodiment, pitch patterns are prepared in advance to update pitch periods indicated by a pitch pattern at an updating cycle shorter than the global pitch periods. Since a one-pitch waveform normally has one peak position, the position and shape of the peak can be conformed to a target vector more accurately by changing the waveform at a cycle shorter than the one pitch period.

From the viewpoint of encoding, such a method can result in an abrupt increase in transmission rate. However, only limited patterns actually occur from among many patterns and this can be confirmed by simulating learning of pitch patterns. Therefore, off-line learning of pitch patterns will allow such encoding to be performed at a transmission rate which is substantially equal to that of conventional adaptive codebook. Sufficient learning provides a pitch pattern unique to a speech signal reflecting fluctuations and variations on pitch periods, which makes it possible to improve the encoding efficiency of a pitch energization signal.

Further, in conventional adaptive codebooks, the numbers of bit allocated to one subframe has been fixed to 7 or 8 bits. This is because pitch periods correspond to 16 to 150 samples for a sampling rate of 8 kHz. When 8 bits are allocated to one subframe, non-integer pitch periods (20.5 and the like) are frequently used. The allocation of bits in a higher quantity will not result in significant improvement of speech quality. The reason is that there is neither pitch period as long as several hundred samples nor pitch period as short as a few samples.

According to the present embodiment, the number of pitch patterns increases with the number of bits. Therefore, speech quality is monotonously improved, although the degree of the improvement is gradually reduced. This is advantageous in that freedom in bit allocation is increased when there is a sufficient number of bits. For example, when a high quality codec is to be designed, more bits can be allocated to it in an attempt to improve speech quality.

Further, a pattern codebook adapted to a particular speaker can be created by using data of the particular speaker as learning data when the pitch patterns are learned. For example, where only voice of females such as announcers is to be processed, speech quality can be improved by learning only voice of females to generate many patterns having high pitch periods.

A description will now be made with reference to FIGS. 55A through 55D and 56A through 56D on a difference between pitch energization signals generated using adaptive codebooks according to the present invention and the prior art. In FIGS. 55A through 55D and 56A through 56D, the older the samples, the closer they are to the left side of the figures. The length of the vector corresponds to one subframe and is equally divided into four mini-frames. FIGS. 55A through 55D show a case of short pitch periods and 56A through 56D show a case of long pitch periods.

Figure 55A:
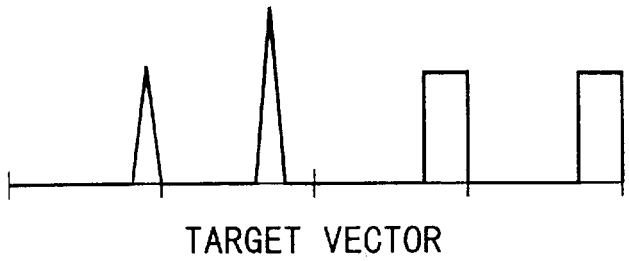
FIGS. 55A to 55D are illustrations of a pitch excitation signal for short pitch periods that describes the operation of the seventeenth embodiment.

First, the case of short pitch periods will be described with reference to FIGS. 55A through 55D. FIG. 55A shows a pitch energization signal as a target vector. A pitch energization signal as close to the target vector is to be generated. As a measure to indicate how a pitch energization signal is close to the target vector, for example, the distance of a pitch energization signal to the vector after it is passed through the perceptual weighting synthesis filter 2206 (distortion at the level the speech signal) is used. In the case of the target vector of this example, the period is substantially the length of a mini-frame; the overall shape of the pulses in the first half of the figure is different from that of the pulses in the second half; and the second pitch in the first half is slightly shifted from the other pulses in magnitude and phase.

Figure 55B:
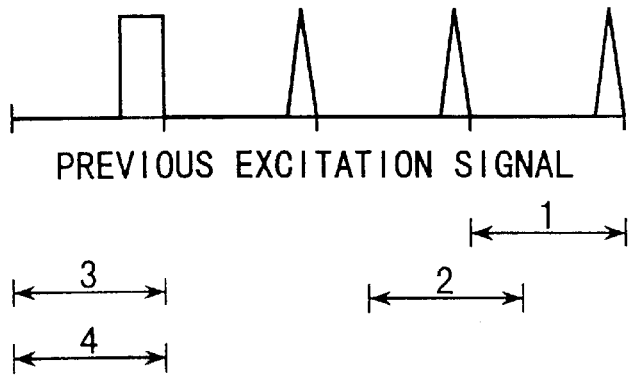
Figure 55C:
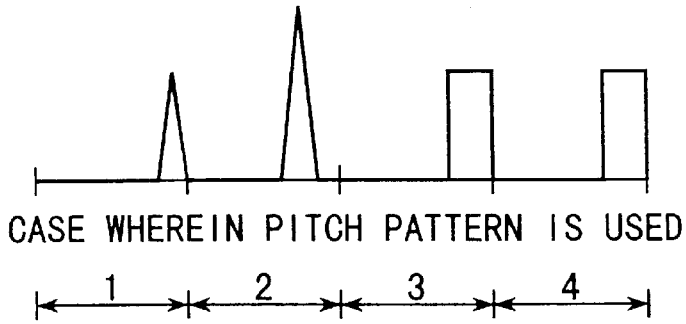

FIG. 55B shows a previous excitation signal stored in the energization signal buffer 2705. In the CELP system, an element corresponding to the energization signal buffer 2705 is referred to as "adaptive codebook". In the present embodiment, the partial pitch waveform extractor 2704 extracts waveforms corresponding to the positions indicated by the numbers "1" through "4" in the lower part of FIG. 55B from the energization signal buffer 2705 as partial pitch waveforms which are concatenated by the partial pitch waveform mixer 2703 after being supplied with an appropriate gain to provide a pitch energization signal as shown in FIG. 55C. Pitch pattern is information indicating the location of each of the sections "1" through "4" in the energization signal buffer 2705.

In the case shown in FIGS. 55A through 55D, a pitch energization signal identical to the target vector shown in FIG. 55A is obtained as shown in FIG. 55C because an optimum pitch pattern exists and the pulse shapes in the second half of the target vector happens to exist in the energization signal buffer 2705. In practice, such a successful result is rarely obtained, and a pattern that minimizes distortion on the speech level is selected. Specifically, a pattern that provides the best overall balance is selected taking the shape and phase into consideration.

Figure 55D:
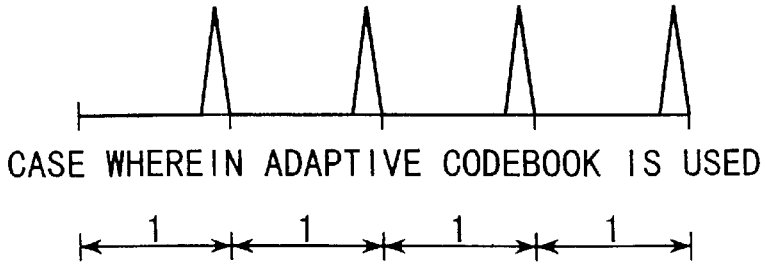

FIG. 55D shows an example of a pitch energization signal (excitation signal) generated according to a conventional method using an adaptive codebook which is normally used in a CELP system utilizing an adaptive codebook. Specifically, a waveform corresponding to one pitch (the section "1") which is closest to the target vector in an adaptive codebook corresponding to the energization signal buffer 2705 shown in FIG. 55B is repeated until the length of the subframe is reached. FIG. 55D shows a pitch energization signal thus obtained. It has a structure which can not represent a shape change and a phase shift of the waveforms in the subframe in principle.

Figure 56A:
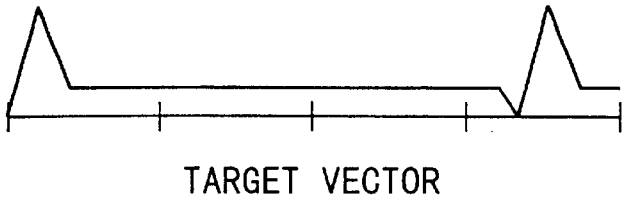
Figure 56B:
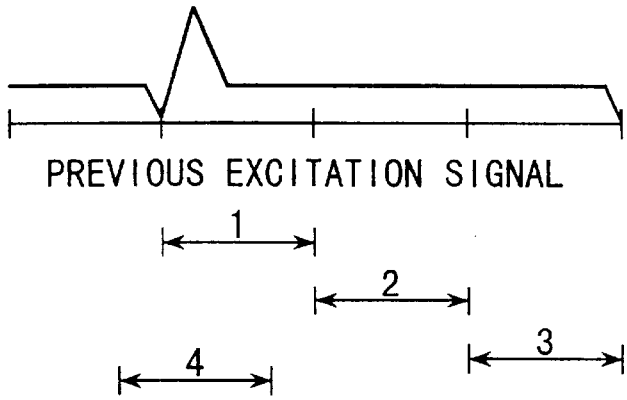
Figure 56C:
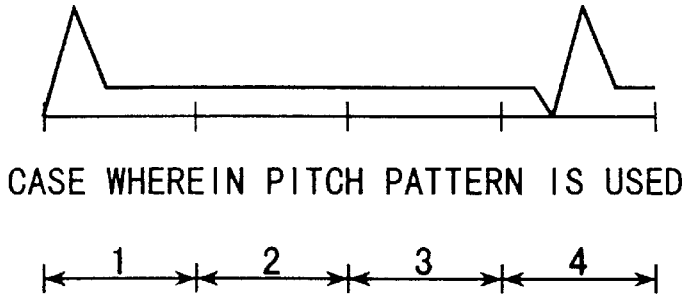
Figure 56D:
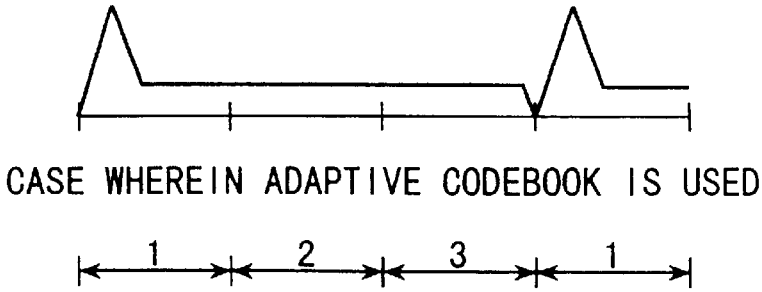

A description will now be made with reference to FIGS. 56A through 56D on the case of long pitch periods. While the length of the pitch waveform of the target vector shown in FIG. 56A is slightly longer than three mini-frames, the length of the pitch waveform in the energization signal buffer 2705 shown in FIG. 56B is equal to three mini-frames. In the present embodiment, a pitch energization signal having an expanded pitch period as shown in FIG. 56C can be generated by concatenating pitch waveforms extracted from the positions indicated by the numbers "1" through "4" shown in the lower part of FIG. 56B. On the contrary, the conventional method results in a pitch energization signal as shown in FIG. 56D because it only repeats one pitch which is closest to the target vector in the adaptive codebook. Thus, it has a structure which can not represent a change in a pitch period in principle.

Strictly speaking, the CELP system performs the operation of selecting one pitch closest to a target vector in a closed loop. Specifically, it calculates distortion at the level of a speech signal for all pitch periods and selects a pitch period which results in the minimum distortion. Therefore, a pitch period which is visually regarded as average can be different from a pitch period obtained by searching an adaptive codebook where pitch periods are unstable.

As apparent from the above description, the method for encoding speech in the present embodiment makes it possible to generate a pitch energization signal which can adapt to changes in the shape and phase of pitch waveforms and slow changes of pitch periods. It is also possible to obtain decoded speech of high quality because slight shifts in pitch parameters can be represented not only in regions where pitch periods change abruptly but also in regions where pitch periods are steady.

Further, the learning of the pitch pattern codebook 2706 makes it possible to create an optimum codebook for a bit rate. In addition, by limiting the voice used for learning the pitch pattern codebook 2706 to the voice of a particular speaker, a codebook adapted to a speaker can be created to allow further improvement of speech quality.

The speech encoding apparatus of the present embodiment can be configured such that is operates in completely the same manner as an apparatus with a conventional adaptive codebook by creating pitch patterns appropriately. Such a configuration does not deteriorate the accuracy of quantization when compared to conventional methods.

As described above, according to the present embodiment, when an excitation signal is to be searched and decoded which provides a synthesized speech signal having minimum distortion when it is input to the perceptual weighting synthesis filter 206, waveforms shorter than the pitch periods of the input speech signal are extracted as partial pitch waveforms from an excitation signal in a previous frame based on the pitch periods indicated by a pitch pattern showing changes in the pitch periods in sections shorter than, for example, an average pitch period of the current frame, and the extracted partial pitch waveforms are concatenated to generate an excitation signal for the current frame. This allows the encoding to be performed such that it reflects abrupt variations and fluctuations of the pitch periods of the input speech signal to provide an advantage that the quality of the decoded speech obtained at the decoding end is improved.

The present embodiment may advantageously incorporate the technique already described in the eighth embodiment wherein an input speech signal is classified into pitchy sections, i.e., sections including many pitch components, and non-pitchy sections which are encoded by different methods. Further, in order to improve encoding efficiency, it is possible to classify the mode of pitchy sections into a plurality of modes according to the patterns of changes in the pitch periods, e.g., depending on whether a pitch period is ascending, flat or descending and to switch pitch pattern codebooks for each mode adaptively. This improves the efficiency of quantization because the pitch pattern codebook is optimized for each mode as a result of learning.

Referring to the method for mode classification, a method is possible wherein the pitch of an input speech signal is analyzed at the beginning and end of frames, and frames having a greater pitch gain and frames having a smaller pitch gain are classified into pitchy sections and non-pitchy sections, respectively. Another effective method is to perform classification into three modes "ascending", "flat" and "descending" based on the difference between two pitch periods.

When no mode classification is carried out, a pitch pattern codebook is created in which "ascending" and "descending" patterns are mixed, and the entire codebook is searched during a search. As a result, for example, flat patterns and descending patterns are uselessly searched even when the pitch period is ascending. With the mode classification as described above, for example, searching of only ascending patterns will be sufficient for a section in which the pitch period is ascending. This improves efficiency and allows a significant reduction in the amount of calculation.

Figure 57:
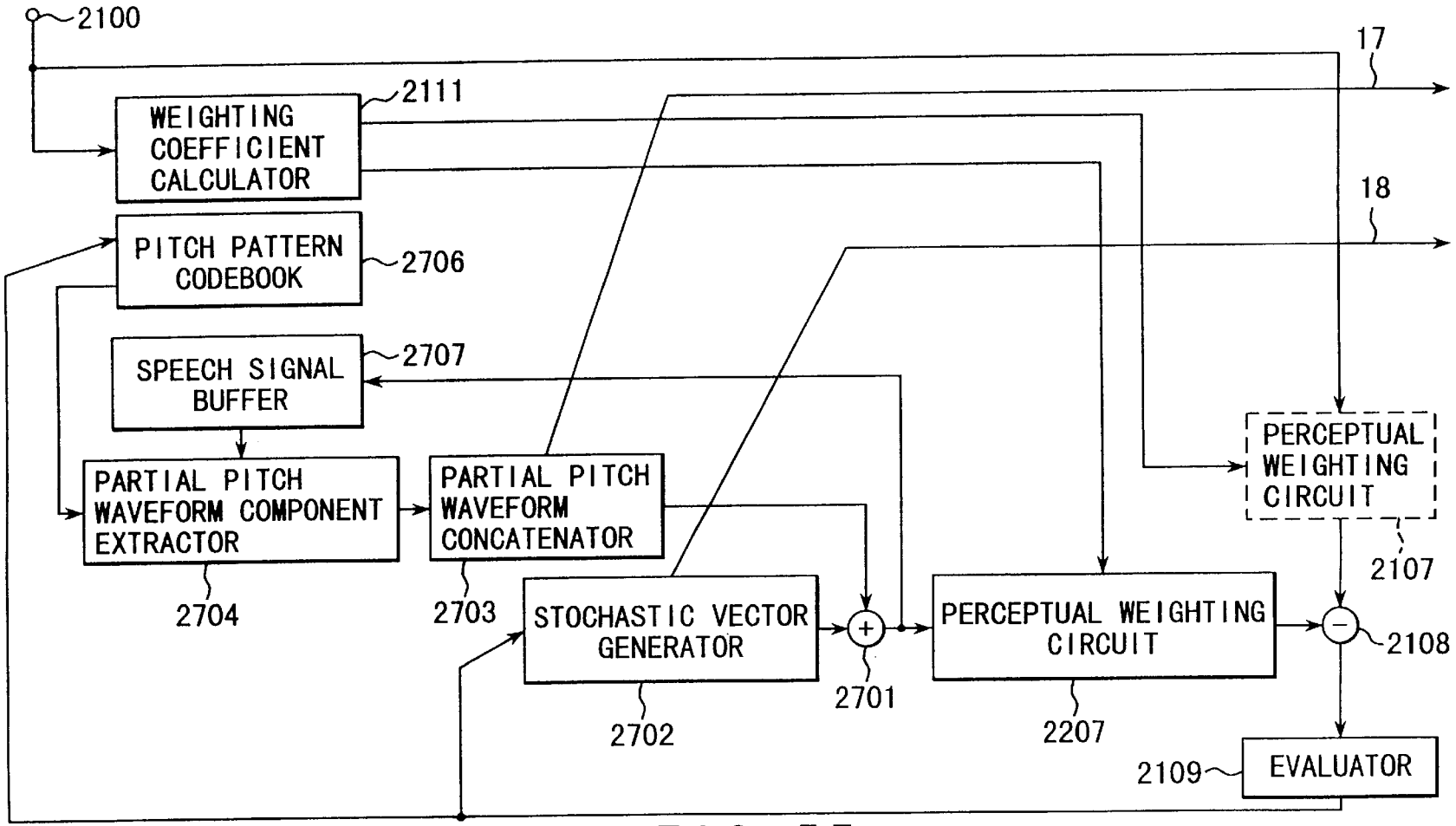
FIG. 57 is a block diagram showing a configuration of a speech encoding apparatus according to an eighteenth embodiment of the invention.

FIG. 57 shows a speech encoding apparatus according to a twentieth embodiment of the invention employing a method for encoding of the invention. This speech encoding apparatus has a configuration in which the perceptual weighting synthesis filter 2206 in FIG. 54 according to the nineteenth embodiment is deleted and replaced with a perceptual weighting circuit 2207 and the energization signal buffer 2705 is replaced by a speech signal buffer 2707 accordingly. Further, the LPC analyzer 2101 is replaced with a weighting coefficient calculator 2111. In addition, the pitch energization signal information 15 and stochastic energization signal information 16 in the nineteenth embodiment is replaced by pitch signal information 17 and noise signal information 18 representing information on a synthesized speech signal, respectively. The twentieth embodiment is in a relationship to the nineteenth embodiment which is analogous to the relationship of the thirteenth embodiment to the twelfth embodiment and has the same effects as the nineteenth embodiment.

Specifically, according to the present embodiment, when a synthesized speech signal having minimum distortion is to be generated and encoded without using a synthesis filter, waveforms shorter than the pitch periods of the input speech signal are extracted as partial pitch waveforms from the synthesized speech signal of a previous frame based on the pitch periods indicated by a pitch pattern showing changes in the pitch periods in sections shorter than, for example, an average pitch period of the current frame, and the extracted partial pitch waveforms are concatenated to generate a synthesized speech signal for the current frame. This allows the encoding to be performed such that it reflects abrupt variations and fluctuations of the pitch periods of the input speech signal to provide an advantage that the quality of the decoded speech obtained at the decoding end is improved.

Figure 58:
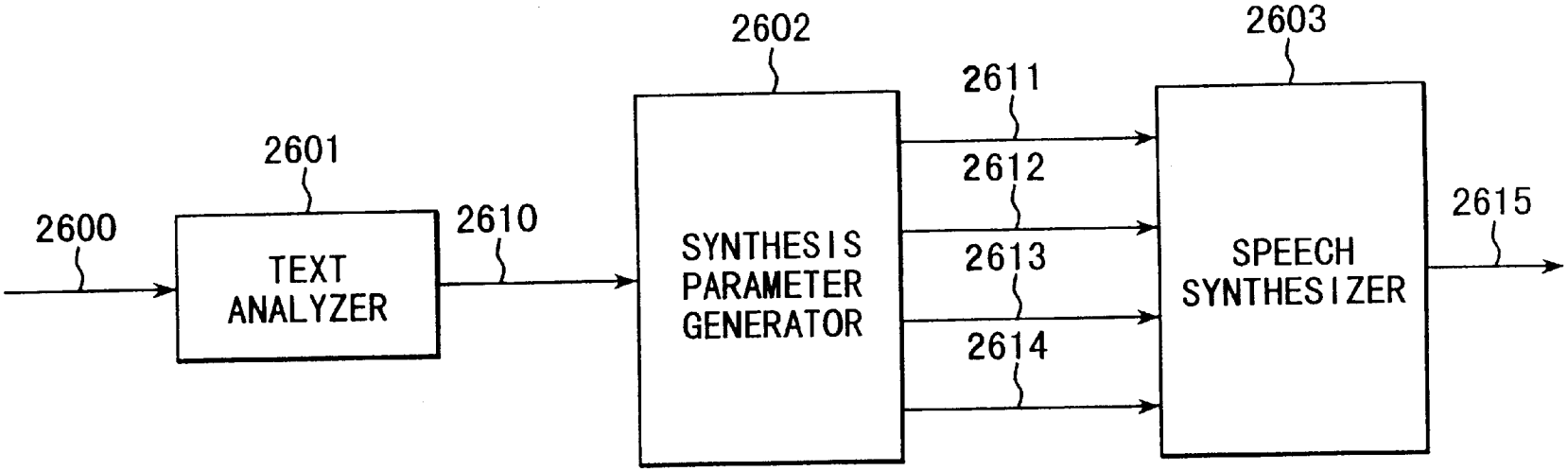
FIG. 58 is a block diagram showing a configuration of a text speech synthesizing apparatus according to a nineteenth embodiment of the invention.

FIG. 58 shows an example of the application of the twentieth embodiment of the invention to a text-to-speech synthesis apparatus. Text-to-speech synthesis is a technique to generate synthesized speech from an input text automatically and has a configuration constituted by three elements as shown in FIG. 58, i.e., a text analyzer 2601 for analyzing a text 2600, a synthesis parameter generator 2602 for generating synthesis parameters and speech synthesizer 2603 for generating synthesized speech. Those elements basically perform processes as described below.

The input text 2600 is first subjected to morphological analysis and syntax analysis at the text analyzer 2601. Next, the synthesis parameter generator 2602 generates synthesis parameters such as a phoneme symbol string 2611, phoneme duration 2612, a pitch pattern 2613 and power 2614 using text analysis data 2610. At the speech analyzer 2603, characteristics parameters in basic small units such as syllables, phonemes and one-pitch sections (referred to as "speech synthesis units) are selected according to information on the phoneme symbol string 2611, phoneme duration 2612 and pitch pattern 2613 and are connected-with the pitch and phoneme duration controlled to generate synthesized speech 2615.

In such a text-to-speech synthesis apparatus, the detecting of local pitch periods described in the above embodiments may be used by the synthesis parameter generator 2602 to generate the pitch pattern 2613.

As described above, the present invention makes it possible to encode abrupt variations and fluctuations of pitch periods, thereby allowing speech encoding that provides decoded speech of high quality.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for encoding speech comprising the steps of:

obtaining first pitch periods of an input speech signal;

changing the pitch periods according to condition of the input speech signal to obtain second pitch periods;

determining encoding sections corresponding to said second pitch periods, respectively;

generating an excitation signal by which distortion of a synthesized speech signal is minimized for each of said encoding sections, the synthesized speech signal being generated by subjecting the excitation signal to synthesis filtering; and outputting at least information representing said changed pitch periods and information on said synthesized speech signal as encoded data.

2. The method for encoding speech according to claim 1, further comprising the step of concatenating said second pitch periods which are at least partially adjacent to each other to obtain concatenated pitch periods, the steps of determining encoding sections determines encoding sections based on said concatenated pitch periods as well as said changed pitch periods, said step of outputting encoded data comprising the step of outputting information representing said local concatenated pitch periods as well as the information representing said changed pitch periods and the information on said synthesized speech signal as encoded data.

3. A method for encoding speech comprising the steps of:

obtaining synthesis filter characteristic information representing the transfer characteristics of a synthesis filter which receives an excitation signal and generates a synthesized speech signal;

obtaining first pitch periods of an input speech signal;

changing the pitch periods according to condition of the input speech signal to obtain second pitch periods;

determining encoding sections corresponding to said second pitch periods, respectively;

generating said excitation signal by which distortion of said synthesized speech signal is minimized for each of said encoding sections; and outputting at least said synthesis filter characteristic information, information representing said second pitch periods and information representing said excitation signal as encoded data.

4. The method for encoding speech according to claim 3, further comprising the step of concatenating said second pitch periods which are at least partially adjacent to each other to obtain concatenated pitch periods, the steps of determining encoding sections determines encoding sections based on said concatenated pitch periods as well as said changed pitch periods, said step of outputting encoded data comprising the step of outputting information representing said concatenated pitch periods as well as said synthesis filter characteristic information, information representing said second pitch periods and information representing said excitation signal as encoded data.

5. A method for encoding speech comprises:

setting a plurality of pitch marks in each frame of an input speech signal, each of the pitch marks indicating a position in the frame at which a pitch wave form is to be put;

obtaining a plurality of pitch periods corresponding pitch marks, respectively, the pitch periods being changed according to condition of the input speech signal;

generating an excitation signal by which distortion of a synthesized speech signal is minimized, for each of said pitch periods, the synthesized speech signal being generated by subjecting the excitation signal to synthesis filtering; and outputting at least information representing said pitch periods and information on said synthesized speech signal as encoded data.

6. A method according to claim 5, wherein the step of generating an excitation signal includes putting pitch waveforms on the pitch marks and applying a gain thereto to generate the excitation signal.

7. A method according to claim 5, wherein the step of generating an excitation signal includes calculating an error between the synthesized speech signal and the input speech signal, weighting the error with a perceptual weighting method, and selecting an excitation signal for which distortion of the input speech signal is minimum.

8. A method according to claim 6, which includes generating the pitch waveforms by sorting a plurality of template pitch waveforms in a codebook in advance and selecting the optimum pitch waveforms from the template pitch waveforms through closed loop search.

9. A method for encoding speech comprising the steps of:

obtaining local pitch periods representing time lengths of one-pitch waveforms of an input speech signal from said input speech signal;

determining encoding sections based on said local pitch periods;

generating a synthesized speech signal for which distortion from said input speech signal is minimized in each of said encoding sections;

outputting at least information representing said local pitch periods and information on said synthesized speech signal as encoded data; and concatenating said local pitch periods which are at least partially adjacent to each other to obtain local concatenated pitch periods, said step of generating a synthesized speech signal comprising the steps of determining encoding sections based on said local pitch periods and said local concatenated pitch periods and generating a synthesized speech signal for which distortion from said input speech signal is minimized in each of said encoding sections, said step of outputting encoded data comprising the step of outputting at least information representing said local pitch periods, information representing said local concatenated pitch periods and information on said synthesized speech signal as encoded data.

10. A method for encoding speech comprising the steps of:

obtaining synthesis filter characteristic information representing the transfer characteristics of a synthesis filter which receives the input of an excitation signal and generates a synthesized speech signal and obtaining local pitch periods representing time lengths of one-pitch waveforms of an input speech signal from said input speech signal;

determining encoding sections based on said local pitch periods;

generating said excitation signal for which distortion of said synthesized speech signal is minimized in each of said encoding sections;

outputting at least said synthesis filter characteristic information, information representing said local pitch periods and information representing said excitation signal as encoded data;

concatenating said local pitch periods which are at least partially adjacent to each other to obtain local concatenated pitch periods, said step of generating an excitation signal comprising the steps of determining encoding sections based on said local pitch periods and said local concatenated pitch periods and generating said excitation signal for which distortion of said synthesized speech signal is minimized in each of said encoding sections, said step of outputting encoded data comprising the step of outputting at least said synthesis filter characteristic information, information representing said local pitch periods, information representing said local concatenated pitch periods and information representing said excitation signal as encoded data.

* * * * *